US009422742B2

(12) United States Patent
Pardoe

(10) Patent No.: US 9,422,742 B2
(45) Date of Patent: Aug. 23, 2016

(54) SYSTEMS, DEVICES, AND/OR METHODS FOR MANAGING SWINGING DOORS

(71) Applicant: Keith Pardoe, Bealeton, VA (US)

(72) Inventor: Keith Pardoe, Bealeton, VA (US)

( * ) Notice: Subject to any disclaimer, the term of this patent is extended or adjusted under 35 U.S.C. 154(b) by 0 days.

(21) Appl. No.: 14/244,847

(22) Filed: Apr. 3, 2014

(65) Prior Publication Data

US 2014/0300119 A1 Oct. 9, 2014

Related U.S. Application Data

(60) Provisional application No. 61/810,167, filed on Apr. 9, 2013.

(51) Int. Cl.
*E05B 15/02* (2006.01)
*E05B 17/00* (2006.01)
*E05C 9/18* (2006.01)

(52) U.S. Cl.
CPC ..... *E05B 15/0205* (2013.01); *E05B 17/007* (2013.01); *E05B 15/02* (2013.01); *E05B 15/0245* (2013.01); *E05C 9/1808* (2013.01); *Y10T 292/685* (2015.04)

(58) Field of Classification Search
CPC ... E05B 15/0205; E05B 17/007; E05B 15/02; E05B 15/0245; Y10T 292/685; E05C 9/1808
USPC ..... 292/340–346
See application file for complete search history.

(56) References Cited

U.S. PATENT DOCUMENTS 851,109 A * 4/1907 Swift ..... E05B 15/0205 292/341.11
1,555,221 A 9/1925 Long
1,913,444 A * 6/1933 Herdeg ..... 292/341.18
2,065,732 A * 12/1936 Peace ..... 292/341.18
2,127,891 A * 8/1938 Starling ..... 292/346
2,312,892 A * 3/1943 Fisher ..... 292/340
2,401,854 A * 6/1946 Berry, Jr. ..... 292/341.19
2,403,182 A * 7/1946 Leary et al. ..... 292/341.18
2,412,497 A * 12/1946 Edwards ..... 292/341.18
2,439,036 A * 4/1948 Bohnsack ..... 292/341.18
2,568,983 A * 9/1951 Best ..... 292/340
2,604,347 A * 7/1952 Snyder ..... E05B 15/0205 292/340
2,695,807 A * 11/1954 Bissot ..... 292/341.18
2,695,808 A * 11/1954 Manchester ..... 292/341.18
2,713,506 A * 7/1955 Wickstrom ..... E05B 15/0245 244/7 R
2,731,822 A * 1/1956 Bargman ..... 70/135
2,946,614 A * 7/1960 Russell ..... 292/341.11
2,993,719 A * 7/1961 Manchester ..... E05B 15/0255 292/341.18
3,395,935 A * 8/1968 Rosenberger ..... 292/341.13

(Continued)

OTHER PUBLICATIONS

575 Mortise Strike for 7500 Mortise Lock, Template No. 30210_b, Von Duprin, Ingersoll Rand, available at http://us.allegion.com/IRSTDocs/Template/107217.pdf.

(Continued)

*Primary Examiner* — Kristina Fulton
*Assistant Examiner* — Faria Ahmad

(57) ABSTRACT

Certain exemplary embodiments can provide a strike plate adapted to receive bolts of latching and locking door hardware on a door. The strike plate can comprise a rigid material. The strike plate can have a lip on one side edge thereof. The strike plate can have a thickness such that, when installed, the strike plate protrudes from a plane of a rabbet of a door frame such that a clearance between the locking door hardware and the strike plate is reduced.

10 Claims, 38 Drawing Sheets

(56) References Cited

U.S. PATENT DOCUMENTS

| | | | | |
|---|---|---|---|---|
| 3,764,173 | A | 10/1973 | Griffith | |
| 3,955,387 | A | 5/1976 | Best | |
| 3,967,845 | A | 7/1976 | Governale | |
| 4,017,106 | A * | 4/1977 | Salazar | E05B 15/0205 292/340 |
| 4,073,527 | A | 2/1978 | Schlage | |
| 4,118,056 | A | 10/1978 | Alexander | |
| 4,171,836 | A | 10/1979 | St. Aubin | |
| 4,183,568 | A * | 1/1980 | Ferracane | 292/341.18 |
| 4,389,061 | A | 6/1983 | Foshee | |
| 4,437,695 | A | 3/1984 | Foshee | |
| 4,483,557 | A * | 11/1984 | Pastva | 292/218 |
| 4,492,397 | A * | 1/1985 | Allenbaugh | 292/341.18 |
| 4,572,556 | A | 2/1986 | Foshee | |
| D283,299 | S | 4/1986 | Mazie | |
| 4,583,382 | A | 4/1986 | Hull | |
| 4,589,691 | A | 5/1986 | Foshee | |
| 4,629,230 | A * | 12/1986 | Tegg | 292/281 |
| 4,674,776 | A | 6/1987 | James | |
| D293,879 | S | 1/1988 | Sundberg | |
| 4,809,400 | A * | 3/1989 | Allen | 16/82 |
| 4,856,832 | A * | 8/1989 | Prevot | 292/341.19 |
| 4,872,717 | A | 10/1989 | McEvoy | |
| 4,920,773 | A | 5/1990 | Surko | |
| D313,162 | S * | 12/1990 | Westphal et al. | D8/343 |
| 5,016,930 | A | 5/1991 | Hamilton | |
| 5,020,343 | A | 6/1991 | Hart | |
| 5,044,184 | A | 9/1991 | Herbers | |
| 5,058,940 | A | 10/1991 | Hart | |
| 5,083,122 | A | 1/1992 | Clark | |
| 5,083,448 | A | 1/1992 | Karkkainen | |
| 5,088,780 | A | 2/1992 | Doherty | |
| 5,094,489 | A | 3/1992 | Jones | |
| 5,127,690 | A | 7/1992 | Kim | |
| 5,177,987 | A | 1/1993 | Shen | |
| D339,056 | S | 9/1993 | Black | |
| D351,781 | S | 10/1994 | DeWitt | |
| 5,368,345 | A | 11/1994 | Watts | |
| 5,421,178 | A | 6/1995 | Hamel | |
| 5,474,347 | A * | 12/1995 | Vigneault et al. | 292/340 |
| 5,474,348 | A | 12/1995 | Palmer | |
| 5,481,890 | A | 1/1996 | Millman | |
| 5,678,870 | A | 10/1997 | Pelletier | |
| 5,813,255 | A | 9/1998 | Tell, III | |
| 5,816,086 | A | 10/1998 | Russell, IV | |
| 5,941,108 | A | 8/1999 | Shen | |
| 6,021,654 | A | 2/2000 | McCaa | |
| 6,085,465 | A * | 7/2000 | Olberding et al. | 49/460 |
| 6,099,053 | A | 8/2000 | Huang | |
| 6,174,004 | B1 | 1/2001 | Picard | |
| 6,279,360 | B1 | 8/2001 | Shen | |
| 6,349,982 | B2 | 2/2002 | Fayngersh | |
| 6,354,121 | B1 | 3/2002 | Frolov | |
| 6,386,603 | B1 | 5/2002 | Huang | |
| 6,393,878 | B1 | 5/2002 | Fayngersh | |
| 6,470,721 | B2 | 10/2002 | Ming | |
| 6,543,264 | B2 | 4/2003 | Frolov | |
| 6,557,909 | B2 | 5/2003 | Morris | |
| 6,578,888 | B1 | 6/2003 | Fayngersh | |
| 6,581,423 | B2 | 6/2003 | Lin | |
| 6,615,630 | B2 | 9/2003 | Wu | |
| 6,619,705 | B2 | 9/2003 | Dalsing | |
| 6,623,053 | B1 | 9/2003 | Hwang | |
| 6,735,993 | B2 | 5/2004 | Eller | |
| 6,742,367 | B2 | 6/2004 | Wu | |
| 6,742,820 | B2 | 6/2004 | Shen | |
| 6,834,897 | B1 | 12/2004 | Walker | |
| 6,860,529 | B2 | 3/2005 | Chong | |
| 6,877,783 | B2 | 4/2005 | Atkinson | |
| 6,901,706 | B2 * | 6/2005 | Olberding et al. | 49/460 |
| 7,100,407 | B2 | 9/2006 | Chen | |
| 7,108,300 | B2 | 9/2006 | Hodgin | |
| 7,188,870 | B2 | 3/2007 | Huang | |
| 7,452,012 | B2 | 11/2008 | Huang | |
| 7,497,486 | B1 | 3/2009 | Davis | |
| 7,836,738 | B2 | 11/2010 | Tien | |
| 8,256,253 | B2 | 9/2012 | Chen | |
| 8,261,584 | B2 | 9/2012 | Yang | |
| 8,287,010 | B2 | 10/2012 | Holzer | |
| 8,419,087 | B2 | 4/2013 | Shen | |
| 8,424,935 | B2 | 4/2013 | Moon | |
| 8,505,345 | B2 | 8/2013 | Sun | |
| 2003/0127864 | A1 | 7/2003 | Dalsing | |
| 2010/0117382 | A1 * | 5/2010 | Tong | E05B 15/0205 292/341.15 |
| 2014/0260017 | A1 | 9/2014 | Noble, III | |

OTHER PUBLICATIONS

576A & 576B Mortise Strike for 7500 Mortise Lock, Template No. 30211_a, Von Duprin, Ingersoll Rand, available at http://us.allegion.com/IRSTDocs/Template/107218.pdf.

575/575-2 Mortise Strike for Double Doors, Template No. 30212_b, Von Duprin, Ingersoll Rand, available at http://us.allegion.com/IRSTDocs/Template/107219.pdf.

Von Duprin Parts Manual 98/9975 Mortise Lock Exit Devices, Jul. 2009, Von Duprin, Ingersoll Rand, available at http://us.allegion.com/IRSTDocs/Manual/108722.pdf.

Von Duprin Parts Manual 8875 Mortise Lock Series Exit Devices, Oct. 2013, Von Duprin, Ingersoll Rand, available at http://us.allegion.com/IRSTDocs/Manual/108732.pdf.

8800 Series Grade 1 Mortise Locks, Yale Locks & Hardware, 225 Episcopal Road, Berlin, CT 06037-4004, available at http://www.grainger.com/ec/pdf/Yale-8800-Mortise-Locks-Catalog.pdf.

8800 Series Parts Manual Grade 1 Mortise Locks, Yale Locks & Hardware, 225 Episcopal Road, Berlin, CT 06037-4004, available at http://www.spesifikasii.com/pdf/8800-series-parts-manual-extranet-assa-abloy-door-security-30721.pdf.

1855 Manual Flush Bolts, Metal Door Application, Architectural Builders Hardware Mfg., Inc., 1222 Ardmore Ave., Itasca, IL 60143, available at www.abhmfg.com/content/documents/0000336_1855_template.pdf.

1860 Automatic Flush Bolts, Metal Door Application, Architectural Builders Hardware Mfg., Inc., 1222 Ardmore Ave., Itasca, IL 60143, available at www.abhmfg.com/content/documents/0000344_1860_template.pdf.

6600 / 69600, Architectural Builders Hardware Mfg., Inc., 1222 Ardmore Ave., Itasca, IL 60143, available at http://www.abhmfg.com/content/documents/0000413_6600_series_hospital_latch_template.pdf.

AM & BM Series Lock, AM-002, Arrow Template, available at http://www.fmgeorge.com/pfds/mortise_lock_templates/TemplateAM-002.pdf.

H Series Service Manual, Best Access Systems, available at http://www.bestaccess.com/service-documents/H%20Series%20Service%20Manual.pdf.

H Series, Heavy Duty Mortise Locks, Best Access Systems, available at http://www.bestaccess.com/media/catalogs/H%20series.pdf.

Installation Specifications for 34H-37H Mortise Locks, Best Access Systems, available at http://www.stanleytemplates.com/templates/T61950p.pdf.

Installation Specification for 38H-39H Mortise Locks, Best Access Systems, available at www.stanleytemplates.com/templates/T61952f.pdf.

40H Series, Heavy Duty Mortise Locks, Best Access Systems, available at www.bestaccess.com/techpubs/T81602b.pdf.

M Series Heavy Duty Mortise Lock Installation Guide, Cal-Royal Products, Inc., available at http://cal-royal.com/products/templates/Installation%20Instructions%20-%20NM%20Series_.pdf.

Mortise Lockset, Entrance / Office, NM8050, Cal-Royal Products, Inc., available at cal-royal.com/products/templates/NM8050%20Mortise%20Lock.pdf.

NM Series Exploded View, Cal-Royal Products, Inc., available at cal-royal.com/products/templates/NM-Series%20Exploded%20View.pdf.

ML2000 Series, Mortise Locksets, Corbin Russwin, available at http://www.corbinrusswin.com/Other/Corbin%20Russwin/Product%20Pages/Mortise%20Locks/ML2000%20Series/Downloads/Catalog/45300.pdf.

(56) References Cited

OTHER PUBLICATIONS

ML2000 Series, Mortise Lock Parts Manual, Corbin Russwin, available at http://extranet.assaabloydss.com/library/partsmanuals/CorbinRusswin/pdf/45305.pdf.
ML2000 Series, Mortise Lock template, T30600-7, Corbin Russwin, available at http://extranet.assaabloydss.com/library/templates/CorbinRusswin/pdf/T30600-7.pdf.
Access 600 TCRNE1 ML20600 Series Mortise Lock, T31070, Corbin Russwin, available at http://extranet.assaabloydss.com/library/templates/CorbinRusswin/pdf/T31070.pdf.
ML2000 x HPSK Push/Pull Paddle Trim, T31192, Corbin Russwin, available at https://extranet.assaabloydss.com/library/templates/CorbinRusswin/pdf/T31192.pdf.
ML2000 Series BLSS Trim, T31195, Corbin Russwin, available at https://extranet.assaabloydss.com/library/templates/CorbinRusswin/pdf/T31195.pdf.
5001, 5002, 5003, 5005 Strike Wood Jamb, Template No. Strike 5001W, Dorma Door Controls, Reamstown, PA 17567, available at http://products.dorma.com/content/download/856/6451/STRIKE_5001-W-M.pdf.
Falcon, MA Series Service Manual, Grade 1 Mortise Lever and Knob Locks, Ingersoll Rand Security Technologies, available at http://www.accesshardware.com/technical/misc/Falcon%20MA%20Series%20Servise%20Manual.pdf.
Falcon, M Series Service Manual, Extra Heavy Duty, Grade 1 Mortise Lever and Knob Locks, Ingersoll Rand Security Technologies, available at http://us.allegion.com/IRSTDocs/Manual/108006.pdf.
Glynn•Johnson, Push/Pull Latches, Ingersoll Rand, available at http://idighardware.com/wordpress/wp-content/uploads/2011/09/GLY_Latches_Catalog.pdf.
Glynn•Johnson, Installation Instructions, HL6-9000 Push/Pull Mortise Latch, Ingersoll Rand, available at us.allegion.com/IRSTDocs/InstallInstructions/107563.pdf.
Drawing No. T-LS00112, Hager Companies 139 Victor Street, St. Louis, MO 63104, available at bgdistribution.ca/wp-content/uploads/2013/10/3800_SERIES.pdf.
Marks USA, Architectural Guide, Marks USA, available at www.bschk.com/iframe/e_catalogues/aiacs/Marks/Marks.pdf.
Mortise Locksets, Marks USA, available at http://www.marksusa.com/getDocument.php?id=636.
Mortise Lockset Functions, Marks USA, available at www.marksusa.com/getDocument.php?id=1173.
Mortise Lockset Parts Marks USA, available at www.marksusa.com/getDocument.php?id=957.
Escutcheon Lever and Ball Knob Trim, Template: W53500, Rev. 3 Nov. 22, 2010, PDQ Manufacturing, 2754 Creek Hill Road, Leola, PA 17540, available at home.pdqlocks.com/pdq4/Templates/MR/W53500.PDF.
Escutcheon Lever and Ball Knob Trim, Template: W53502, Rev. 6 Nov. 22, 2010, PDQ Manufacturing, 2754 Creek Hill Road, Leola, PA 17540, available at home.pdqlocks.com/pdq4/Templates/MR/W53502.PDF.
Sectional Lever and Ball Knob Trim, Template: W53513, Rev. 4 Nov. 22, 2010, PDQ Manufacturing, 2754 Creek Hill Road, Leola, PA 17540, available at home.pdqlocks.com/pdq4/Templates/MR/W53513.PDF.
808 Curved Lip Strike, Template No. 4049W, Sargent Manufacturing Company, 100 Sargent Drive New Haven, CT, available at http://www.allmar.com/products/data/uploads/Sargent_Knobset_8-Line_template_ANSI_Strike.pdf.
7800 / 8200 Series Mortise Lock, Sargent Manufacturing Company, 100 Sargent Drive New Haven, CT, available at www.sargentlock.com/file_broker.php?document_id=6605.
9200 High Security Mortise Lock and M-9200 Mogul Institutional Mortise Lock, Sargent Manufacturing Company, 100 Sargent Drive New Haven, CT, available at http://www.sargentlock.com/file_broker.php?document_id=5094.
7900 Mortise Locks, Sargent Manufacturing Company, 100 Sargent Drive New Haven, CT, available at http://www.sargentlock.com/file_broker.php?document_id=6643.
Basic Technical Fundamentals of Builders Hardware Mortise, Bored and Auxiliary Locks, Sargent Manufacturing Company, 100 Sargent Drive New Haven, CT, available at http://www.sargentlock.com/file_broker.php? document_id=6641.
Template 4375E, Sargent Manufacturing Company, 100 Sargent Drive New Haven, CT, available at http://www.sargentlock.com/file_broker.php?document_id=4280.
Bored Lock Strike 800, Template No. 4131N, Sargent Manufacturing Company, 100 Sargent Drive New Haven, CT, available at http://www.sargentlock.com/file_broker.php?document_id=675.
6500 Line Bored Lock, Template No. 4430 B, Sargent Manufacturing Company, 100 Sargent Drive New Haven, CT, available at http://www.sargentlock.com/file_broker.php?document_id=4317.
Template: 7800, 8200, 9200 & M9200 Series Mortise Lock Curved or Straight Lip Strikes, Template No. 7063 C, Sargent Manufacturing Company, 100 Sargent Drive New Haven, CT, available at http://www.sargentlock.com/file_broker.php?document_id=3831.
L/LV/LM/LMV-Series Door Preparation Template Models L9010, LM9010, L9110, LM9310, Template L899, Schlage, Ingersoll Rand, available at http://us.allegion.com/IRSTDocs/Template/102664.pdf.
L/LV/LM/LMV-Series Door Preparation Template Models L/LV9040, L/LV9440, L/LV9444, Template L901, Schlage, Ingersoll Rand, available at http://us.allegion.com/IRSTDocs/Template/102681.pdf.
L/LV/LM/LMV-Series Door Preparation Template Models L/LV/LM/LMV9050, L/LV/LM/LMV9056, L/LV9453, L/LV9456, L9473, L/LV9480, L/LV9485, LM/LMV9350, LM/LMV9356, Template L827, Schlage, Ingersoll Rand, available at http://us.allegion.com/IRSTDocs/Template/102683.pdf.
L/LV/LM/LMV-Series Door Preparation Template Models L/LV/LM/LMV9070, L/LV9076, L/LV/LM/LMV9080, L/LV9080EL/EU, L9465, LM/LMV9370, LM/LMV9380, Template L906, Schlage, Ingersoll Rand, available at http://us.allegion.com/IRSTDocs/Template/103866.pdf.
L/LV/LM/LMV-Series Lock Case Dimensions, Template L1, Schlage, Ingersoll Rand, available at http://us.allegion.com/IRSTDocs/Template/106371.pdf.
L/LV/LM/LMV-Series Door Preparation Template Model L9010, L9110, Template L892, Schlage, Ingersoll Rand, available at http://us.allegion.com/IRSTDocs/Template/109003.pdf.
Strikes Door Preparation Template Models 10-025, 10-072, 10-087, Template J918, Schlage, Ingersoll Rand, available at http://us.allegion.com/IRSTDocs/Template/102412.pdf.
L-Series Service Manual, Schlage, Ingersoll Rand, available at us.allegion.com/IRSTDocs/Manual/106500.pdf.
ND-Series Service Manual, Schlage, Ingersoll Rand, available at us.allegion.com/IRSTDocs/Manual/106499.pdf.
Simplex 8100 Series Installation Instructions, Kaba Access Control 2941 Indiana Avenue Winston-Salem, NC 27105 USA, available at http://coremedia.kaba-ilco.com/access-control/literature_grid/access_download.aspx?File=simplex_8100_installation_instructions_pkg_2589.pdf&Attachment=True.

* cited by examiner

SYSTEMS, DEVICES, AND/OR METHODS FOR MANAGING SWINGING DOORS

CROSS-REFERENCES TO RELATED APPLICATIONS

This application claims priority to, and incorporates by reference herein in its entirety, pending U.S. Provisional Patent Application Ser. No. 61/810,167, filed 9 Apr. 2013.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
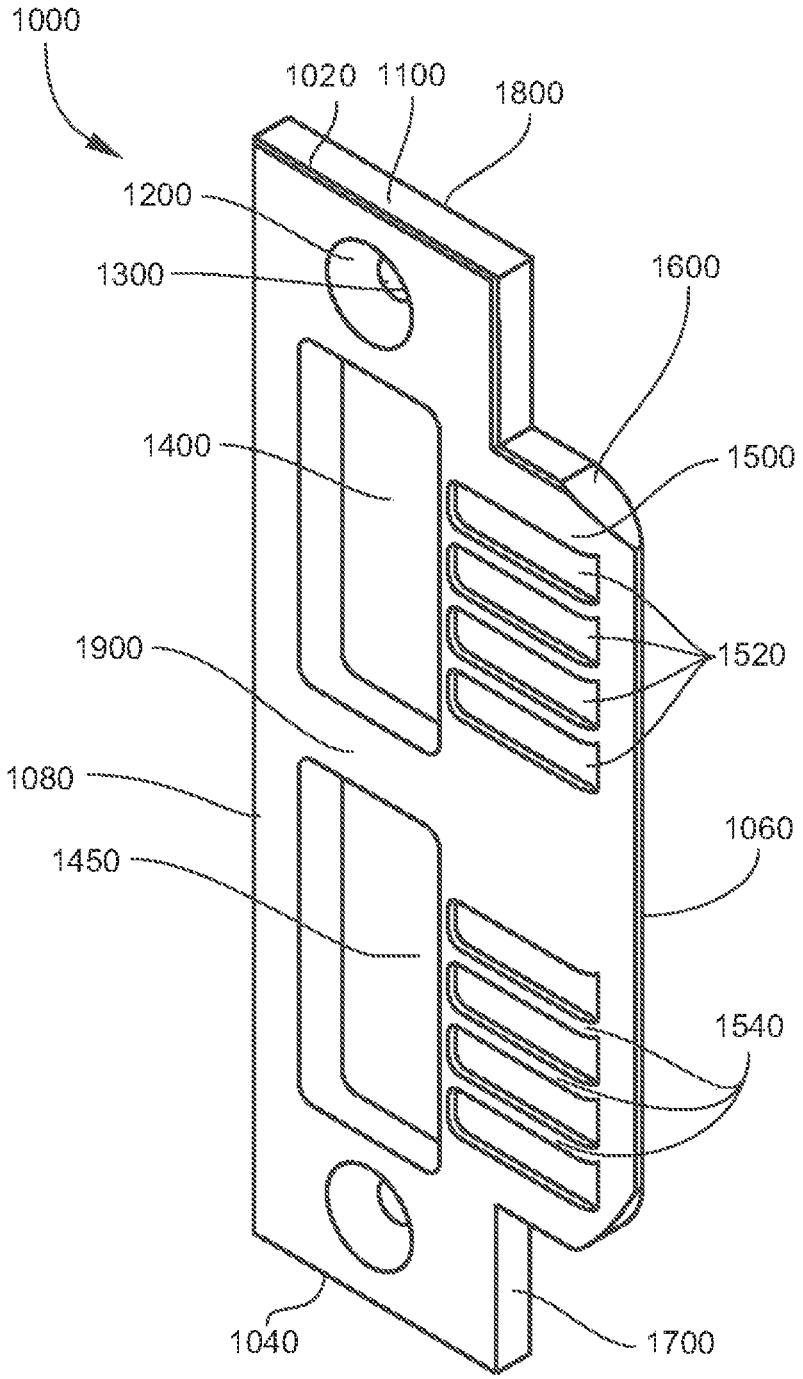
FIG. 1 is a perspective view of an exemplary embodiment of a strike plate 1000.

Certain exemplary embodiments can provide a strike plate adapted to receive bolts of latching and locking door hardware on a door. The strike plate can comprise a rigid material. The strike plate can have a lip on one side edge thereof. The strike plate can have a thickness such that, when installed, the strike plate protrudes from a plane of a rabbet of a door frame such that a clearance between the locking door hardware and the strike plate is reduced.

Certain exemplary embodiments provide a strike plate adapted for latching and/or locking door hardware devices. The strike plate can comprise a rigid material of a thickness sufficient to reduce the clearance between door hardware and the strike plate to within acceptable tolerances, such as an industry standard. The strike plate can be installed into a mortised pocket in a door jamb. The strike plate can define a cutout that is adapted to receive a door hardware bolt. The strike plate can comprise a lip that extends to one side edge, the surface of which is relieved to reduce friction between the door hardware bolts and the strike plate. The strike plate comprises screw holes for mounting the strike plate to the door jamb.

Certain exemplary embodiments are adapted to replace strike plates that were made from relatively thin flat sheets of brass or stainless steel that were cut to shape by a stamping die. Certain strike plates are designed to fit into a standardized pocket that is mortised in the rabbet of the door frame or in the vertical edge of one leaf of a pair of doors. The plane of the front surface of the strike plates can fit substantially flush with the plane of the rabbet of the door frame or the plane of the door edge when installed on the inactive leaf of a pair of doors.

Certain exemplary embodiments provide multiple sizes and shapes of strike plates. Certain exemplary embodiments are adapted to be mounted in doors and door frames that do not meet one or more industry standard tolerances. For example, certain door frames can be specified to be installed with lock and hinge jamb members plumb to a tolerance of approximately plus or minus one eighth of an inch. As another example, a head member of the door frame can be specified to be installed level to a tolerance of approximately plus or minus one sixteenth of inch across its length. As another example, the corners formed by the intersection of the hinge and lock jamb members with the head member can be specified to be substantially square. As still another example, a door leaf width can be specified to be undersized by no more than approximately one fourth of an inch from an actual width of a door frame opening. When the doors and frames are installed within the above mentioned tolerances and the door leaves are undersized in width as described, the clearance dimension between the edges of the door and the rabbet of the door frame can be approximately one eighth of an inch, certain exemplary strike plates can meet certain standards for performance.

In many circumstances, doors and door frames are not installed within specified tolerances for a number of reasons. On non-residential building construction projects, sometimes door frames are located in masonry walls to be installed by masons as the walls are being erected very early in the construction process. Sometimes, this phase of a construction project is rough work. In other words, masons might not be particularly concerned with the details of how to accurately install door frames or problems that might be created when the door frames are not properly installed. Door frames located in drywall partitions are sometimes set in place by the rough carpenters or drywall installers. Sometimes, rough carpenters and drywall installers might not accurately install certain door frames. Sometimes, lesser skilled installer personnel are charged with installing door leaves and hardware products near the completion of the construction. Sometimes, clearance between the edges of the door and the rabbet of the door frame, or the meeting stiles of pairs of doors, can be greater than approximately one eighth of an inch and even greater than approximately one quarter of an inch.

In order to correct door to door frame clearance problem, sometimes removal and reinstallation of existing doors and door frames, or replace existing doors and door frames with new doors and door frames, can be effective. Removing a door frame can disturb the finished wall materials and sometimes the finished floor materials. Removing and reinstalling the doors and door frames can be relatively costly.

When the clearance between the edges of the door and the rabbet of the door frame is greater than approximately one eighth of an inch, several problems can ensue. Certain exemplary embodiments can correct an installation of swinging fire doors with builders hardware. Installation of swinging fire doors with builders hardware can be subject to standards specified by the National Fire Protection Association's publication NFPA 80, Standard for Fire Doors and Other Opening Protectives. In addition, the respective door, door frame, and hardware manufacturers' individual published listings can be subject to standards specified by nationally recognized testing laboratories such as Underwriters Laboratories and Intertek/Warnock Hersey. NFPA 80 specifies a clearance between the edges of the door and rabbet of the door frame, and the meeting stiles of pairs of doors, to be no greater than approximately one eighth of an inch. NFPA 80 allows an over-tolerance of approximately one sixteenth of an inch for fire doors classified as hollow metal fire doors, which results in a maximum clearance dimension of approximately three sixteenths of an inch for this type of fire door.

The reason the clearance between the edges of a fire door and the rabbet of the door frame is specified in NFPA 80 concerns the engagement of door hardware bolts into the strike plates of the door hardware. When the clearance dimension between the door and door frame is greater than that specified in NFPA 80, the dimension of the door bolt projection into the cutouts in the strike plates is proportionally reduced; thereby reducing the door hardware's ability to hold the door closed under fire conditions.

NFPA 80 mandates annual safety inspections of swinging fire doors with builders hardware to be performed and deficiencies documented during these safety inspections are supposed to be corrected without delay. The clearance dimension between edges of the doors and the door frame, and the meeting stiles of pairs of doors, is one of the inspection points specified for NFPA 80's safety inspections. According to NFPA 80's requirements, deficiencies on fire door assemblies constitute noncompliance and void the fire rating of the affected door assemblies.

Locking door hardware devices are designed to be installed on certain doors, both fire rated and nonfire rated, with a clearance no greater than approximately three sixteenths of an inch between the door and the door frame. In this case, the locking door hardware devices can have a security feature called an auxiliary deadlatch; sometimes also referred to as a guard bolt. The purpose of the auxiliary deadlatch is to block the rearward motion of the latch bolt when the door is closed and latched into the strike plate. By blocking the rearward motion of the latch bolt, the auxiliary deadlatch prevents the latch bolt from being manipulated by a tool or otherwise being forced open. The auxiliary deadlatch function is engaged by a spring loaded bar or lever that extends from the face of the door hardware; pressing against the face of the strike plate. The auxiliary deadlatch bar or lever does not project into a cutout in the strike plate; it is held in the depressed position by the strike plate. When the clearance between the door and door frame is too great the auxiliary deadlatch function is not engaged, which allows the latch bolt to be forced open, thereby defeating the security of the locking door hardware.

Another problem with certain strike plates is that the surface of the strike that extends outward from the cutout in the center of the strike face to the edge of the lip that projects past the edge of the door frame is flat. Such a flat surface can result in considerable friction as a beveled face of a door hardware bolt contacts and moves across the strike plate. The friction between the door hardware bolts and strike plates is sometimes enough to retard the movement of the door to the point of preventing the door from closing completely. When this condition occurs, door closing devices can be adjusted to a point where they reliably close the doors, causing the door hardware to become latched into the strike plates. While door closing devices can be adjusted to overcome the friction of the door hardware bolts, doing so often creates a noncompliance issue with accessibility standards like ICC/ANSI A117.1 Accessible and Usable Buildings and Facilities or the Americans with Disabilities Act Accessibility Guidelines (ADAAG). Both A117.1 and ADDAG specify nonfire rated doors with door closing devices to have an opening force no greater than approximately 5 pound force ("lbf"). Adjusting the closing power of door closing devices to overcome the friction of the door hardware bolts increases their opening force to more than approximately 5 lbf, which is noncompliant with certain accessibility standards.

NFPA 80 specifies swinging fire doors with builders hardware to close and positively latch every time they are opened. The ability for the door closing devices to reliably close the fire doors is also one of the inspection points under NFPA 80's annual safety inspections. When the friction between the strike plate and the door hardware bolts is too great, the doors do not reliably close.

Certain exemplary strike plates have oversized cutouts, or extra cutouts, in the center area of the strike front that allow a single strike plate to accommodate multiple door hardware devices with one or two bolts, which can be installed on doors of any hand; hand refers to the direction the door leaf swings. Certain exemplary strike plates can be designed with the correctly sized cutouts and without extra cutouts that are handed appropriately. NFPA 80 specifies that there be no unfilled holes in the doors, door frames, or hardware installed on fire rated doors. Consequently, certain strike plates on some fire doors can result in noncompliance with NFPA 80's requirements for those doors.

Certain exemplary strike plates define screw holes used to mount the strike plate to a door frame. The screw holes can be intentionally oversized in diameter, which reduces the perimeter surface of the screw hole that fits under the head of a corresponding screw. Such oversized screw holes can result in the strike plates becoming loose over time as there is little area under the head of the screw to form a proper purchase. Loose strike plates can affect operation of door hardware bolts, sometimes causing doors to not latch when closed or causing door hardware bolts to bind when a user attempts to open the door.

Certain exemplary strike plates will fit older brands and models of latching and locking door hardware that are no longer in production. Owners of such older latching and locking door hardware devices might have very few sources for purchasing replacement parts such as strike plates.

Certain exemplary strike plates have thicknesses that reduce clearances between door hardware or door edges and strike plates to within acceptable tolerances. Those of ordinary skill in the art will recognize that various thicknesses of materials can be used to fabricate strike plates. Accordingly, exemplary strike plates described herein can have any thickness.

In certain exemplary embodiments, a strike plate is formed from fire resistant material, which is necessary for installation on fire rated door assemblies. In accordance with one embodiment, the strike plate of the strike plate is formed from material that is not fire resistant, which is appropriate for installation on nonfire rate door assemblies. In certain exemplary embodiments, strike plates can be formed from such materials as wrought stainless steel, which is fire resistant and can be machined, such as via computer numerical control ("CNC"), to a final shape and size. Those of ordinary skill in the art will recognize that there are other materials and fabrication methods suitable to fabricate strike plates such as, but not limited to, brass, steel, and stainless steel that is cold-rolled, cast, wrought, extruded, or forged and shaped by stamping or milling or a combination thereof. Therefore, embodiments described herein are not limited to the materials or methods of fabrication to only CNC machined stainless steel as other materials and fabrication methods can be used.

In certain exemplary embodiments, the lip of the strike plate can extend beyond an edge of a mortised pocket in a door frame. In accordance with certain embodiments, the lip of the strike plate can extend partially along substantially the full height of the mortised pocket in the door frame. In accordance with certain embodiments, the front edge of the lip can fit substantially flush with the face of the door frame. In accordance with certain embodiments, the strike plate will not have a lip.

In certain exemplary embodiments, on doors where the friction of the door hardware bolts and the strike plate inhibit the closing of the doors, the strike plate can define a relieved portion in the surface area of the lip, which can be a series of grooves. The series of grooves can reduce friction between the door hardware bolts and the strike plate; thereby causing doors to close more easily. Those of ordinary skill in the art will recognize that other means could be used to relieve the surface of the strike lip such as, but not limited to, boring a series of blind or through holes, by dimpling (convex or concave), and/or by cutting out portions of the lip, etc. The embodiments shown with a series of grooves can accomplish this function, but it should be understood that such embodiments are not limited to only using a series of grooves to reduce the surface area of the strike lip, as other means can be used in other embodiments.

In certain exemplary embodiments, the strike plate can have a correct number of cutouts that are appropriately sized and shaped for a specific brand and model of latching and locking door hardware devices with which it is used. Those of ordinary skill in the art will recognize that there are a multitude of cutout patterns that include one or two cutouts of varying sizes and shapes that could be used for fabricating such strike plates. Therefore, the number, size, and/or shape of the cutouts in the embodiments shown herein are not limiting to this disclosure.

In certain exemplary embodiments, screw holes in the strike plate can be precisely sized to minimally fit the major diameter of screws and provide proper support when the screws are tightened securely.

In certain exemplary embodiments, a strike plate can have a thickness that causes a plane of a front surface of the strike plate to fit substantially flush with a plane of a door rabbet in a door frame or a plane of an edge of an inactive door leaf when strike plates are installed on pairs of doors. In certain exemplary embodiments; the strike plate can define grooves on a lip to reduce friction between a door hardware bolt and the strike plate.

In certain exemplary embodiments, the strike plate can be formed in any one of a variety of rigid materials of various thicknesses, with one or two appropriately sized cutouts adapted to receive door hardware bolts. The strike plate can be made, with and without a relieved area to reduce friction, and with full, partial, or no lip designs. Strike plates can be customized to fit all types of latching and locking door hardware devices and installed in doors and door frames of any material.

Certain exemplary strike plates can provide a cost effective and efficient means for building owners and facilities management personnel to repair existing fire doors and restore security to both fire rated and nonfire rated doors. Certain exemplary strike plates can fit into an existing mortised pocket in a door frame without any substantial modification to the door or door frame, thereby restoring proper door hardware bolt engagement and activation of an auxiliary deadlatch feature. An installer can remove an existing strike plate by removing its screws and replace it with one of the embodiments described herein; with no substantial modification to the door, door frame, or latching door hardware.

Certain embodiments can be provided in an array of user selectable thicknesses. For example, a user can measure a gap in a door and select a strike plate thickness based upon the gap. For example, exemplary thicknesses of any embodiment disclosed herein can be approximately, in inches, 0.09375, 0.125, 0.15625, 0.1875, 0.21875, 0.25, 0.28125, 0.3125, 0.34375, 0.375, 0.40625, 0.4375, 0.46875, 0.50, 0.53125, 0.5625, 0.49375, 0.625, 0.65625, 0.6875, 0.75 and/or any value therebetween.

Strike plates can be made and/or machined from Type 303 stainless steel. Recesses can be defined by a lip of the strike plate to reduce a surface area contacted by an engaging latch bolt, thereby reducing the friction between the latch bolt and the strike plate as the latch bolt moves across a face of the strike plate to engage a cutout in the strike plate. Certain exemplary strike plates can be produced without the reduced friction feature. Strike plate lip edge-to-center dimensions can be made to user specifications. Certain exemplary embodiments can have a dimension between an edge of a lip to a centerline of a cutout of approximately one and three eighths of an inch. Certain exemplary embodiments can comprise a curved lip edge having a radius. The radius can vary with the thickness of strike plate. The radius dimension can be approximately one thirtysecondth of an inch less than thickness of plate.

FIG. 1 is a perspective view of an exemplary embodiment of a strike plate 1000, which can have a thickness 1100. Strike plate 1000 can define a plurality of apertures such as screw holes 1300, a first cutout 1400, a second cutout 1450, and/or grooves 1500. Screw holes 1300 can comprise a tapered portion 1200, which can be adapted to receive a countersunk head of a fastener (e.g., a screw). In certain exemplary embodiments, a maximum separation between first cutout 1400 and second cutout 1450 can be approximately eleven thirtysecondths of an inch. In certain exemplary embodiments, a minimum separation between first cutout 1400 and second cutout 1450 can be approximately seven thirtysecondths of an inch. Grooves 1500 can be cast or cut to be any depth, such as approximately one thirtysecondth of an inch or greater. Grooves 1500 can be cast and/or cut to a desired width, such as approximately three sixteenths of an inch. Other dimensions of strike plate 1000 can be selected to be compatible with door handle hardware of a door system.

Strike plate 1000 can be adapted to receive a door hardware bolt (not illustrated) coupled to a swinging door (not illustrated). Strike plate 1000 can comprise a rigid material. Strike plate 1000 can have a lip 1600 on one side edge 1700 thereof. Strike plate 1000 having a selected thickness 1100 such that, when installed, strike plate 1000 protrudes from a plane of a rabbet (not illustrated) of a door frame (not illustrated) such that a clearance (not illustrated) between locking door hardware (not illustrated) and strike plate 1000 is reduced. Strike plate 1000 can define:

- at least one cutout (e.g., first cutout 1400 and second cutout 1450). The at least one cutout can be adapted to receive the door hardware bolt;
- plurality of screw holes 1300, wherein each of plurality of screw holes 1300 is adapted to couple strike plate 1000 to the door frame. Screw holes 1300 can have a diameter that is less than approximately two millimeters greater than a major diameter of screws (not illustrated) adapted to couple strike plate 1000 to the door frame; and
- plurality of grooves 1500 extending outwardly from near the at least one cutout to near an edge of lip 1600. Grooves 1500 can be adapted to reduce a surface area of strike plate 1000 contacting the bolt thereby reducing friction as the bolt moves across the strike plate.

Strike plate 1000 can comprise a fire resistant material, such as Type 303 stainless steel. The fire resistant material can conform to National Fire Protection Association's publication 80 specifications. Strike plate 1000 can be installed in order to achieve a National Fire Protection Association door fire rating. Thickness 1100 can be sufficient to reduce the clearance to within dimensional tolerances specified by National Fire Protection Association's publication 80. Strike plate 1000 can reduces the clearance to within an established standard dimensional tolerance thereby activating an auxiliary deadlatch function of locking door hardware as door hardware bolts project into strike plate 1000.

Strike plate 1000 can comprise a rigid fire resistant material. Strike plate 1000 can have a sufficient thickness to protrude beyond a plane of a rabbet of a door frame. Strike plate 1000 can be adapted to reduce a clearance between a door and a front face of strike plate 1000 to within dimensional tolerances specified by National Fire Protection Association's publication 80. Strike plate 1000 can comprise:

- a back face 1800 adapted to be placed in direct contact with a mortised pocket in the door frame;
- a front face 1900 that is opposing to back face 1800;
- a top edge 1020;
- a bottom edge 1040;
- a right side edge 1060; and
- a left side edge 1080, wherein one of right side edge 1060 and left side edge 1080 (in the illustrated embodiment, right side edge 1060) defines lip 1600 that extends from first cutout 1400 and second cutout 1450 of front face 1900 to beyond an edge of the mortised pocket;

Strike plate 1000 can define:

- first cutout 1400 and second cutout 1450; each of first cutout 1400 and second cutout 1450 can be adapted to receive a door hardware bolt;
- grooves 1500, which can extend from near first cutout 1400 and second cutout 1450 to near an edge of lip 1600. Grooves 1500 can define a plurality of recesses 1520 and raised planar faces 1540. Grooves 1500 can be adapted to reduce a surface area of strike plate 1000 that the door hardware bolt as the bolt moves across strike plate 1000; and
- plurality of screw holes 1300 in front face 1900. Screw holes 1300 can have a diameter that is less than approximately two millimeters greater than a major diameter of screws adapted to couple strike plate 1000 to the door frame in the mortised pocket.

Strike plate 1000 can comprise a rigid material. Strike plate 1000 can have a sufficient thickness 1100 to protrude beyond a plane of a rabbet in a door frame. When installed, strike plate 1000 can be adapted to reduce a clearance between door hardware and front face 1900 of strike plate 1000 to meet a predetermined dimensional tolerance and thereby activating an auxiliary deadlatch function of locking door hardware as a door hardware bolt projects into first cutout 1400 and/or second cutout 1450 of strike plate 1000. Strike plate 1000 can comprise:

- back face 1800, which can be adapted to directly contact a mortised pocket in the door frame;
- front face 1900, which is opposing to back face 1800;
- top edge 1020;
- bottom edge 1040;
- right side edge 1060; and
- left side edge 1080, wherein one of right side edge 1060 or left side edge 1080 (in the illustrated embodiment, right side edge 1060) comprises lip 1600, which extends from near an edge of first cutout 1400 and/or second cutout 1450 to beyond an edge of the mortised pocket;

Strike plate 1000 can define:

- first cutout 1400 and/or second cutout 1450, each of which can be adapted to receive a door hardware bolt;
- plurality of grooves 1500 extending from near first cutout 1400 and/or second cutout 1450 to near an edge of lip 1600. Grooves 1500 can be adapted to reduce a surface area of strike plate 1000 contacted by the door hardware bolt thereby reducing friction as the bolt moves across strike plate 1000;
- a plurality of screw holes 1300 in front face 1900, wherein screw holes 1300 are sized to dimensions minimally greater than a major diameter of screws used to attach strike plate 1000 to the door frame. The screws can be adapted to couple strike plate 1000 to the door frame in the mortised pocket.

Strike plate 1000 can comprise a rigid material. Strike plate 1000 can be adapted for latching and locking door hardware devices that are no longer in production. Strike plate 1000 can have:

back face 1800, which can be adapted to fit into a mortised pocket in a door frame;

front face 1900, which is opposing to back face 1800;

top edge 1020;

bottom edge 1040;

right side edge 1060; and left side edge 1080, wherein one of right side edge 1060 or left side edge 1080 (in the illustrated embodiment, right side edge 1060) comprises lip 1600 that extends from near an edge of first cutout 1400 and/or second cutout 1450 to beyond an edge of a mortised pocket defined by a door frame.

Strike plate 1000 can define:

first cutout 1400 and/or second cutout 1450. Each of first cutout 1400 and second cutout 1450 can be adapted to receive a door hardware bolt;

plurality of grooves 1500, which can extend from near first cutout 1400 and/or second cutout 1450 to near an edge of lip 1600, wherein grooves 1500 define plurality of recesses 1520 and raised planar faces 1540. Grooves 1500 can be adapted to reduce a surface area of strike plate 1000 in contact with the door hardware bolt as the bolt moves across strike plate 1000, which can cause doors to close relatively easily; and plurality of screw holes 1300, which can be sized to dimensions minimally greater than a major diameter of screws used to couple strike plate 1000 to the door frame. The screws can be adapted to couple strike plate 1000 to the door frame in the mortised pocket.

Strike plate 1000 can have thickness 1100, which can be adapted to reduce a clearance between door hardware and front face 1900 to within an industry standard dimensional tolerance thereby activating auxiliary deadlatch function of locking door hardware as the door hardware bolt(s) projects into first cutout 1400 and/or second cutout 1450.

Strike plate 1000 can comprise a rigid material. Strike plate 1000 can be adapted for latching or locking door hardware devices. Strike plate 1000 can comprise:

back face 1800, which can be adapted to fit into, and be in direct contact with, a mortised pocket in a door frame;

front face 1900, which is opposed to back face 1800;

top edge 1020;

bottom edge 1040;

right side edge 1060; and left side edge 1080, wherein one of right side edge 1060 or left side edge 1080 (in the illustrated embodiment, right side edge 1060) comprises lip 1600 that extends from near edges of pair of cutouts 1400 and 1450 to beyond an edge of the mortised pocket.

Strike plate 1000 can define:

first cutout 1400 and/or second cutout 1450, each of first cutout 1400 and/or second cutout 1450 can be adapted to receive a door hardware bolt of a pair of door hardware bolts coupled to a door;

plurality of grooves 1500, which can extend from near first cutout 1400 and/or second cutout 1450 to near an edge of lip 1600. Grooves 1500 can create plurality of recesses 1520 and raised planar faces 1540 thereby reducing surface area of strike plate 1000 contacting the door hardware bolts, thereby reducing friction of the door hardware bolts as the bolts move across strike plate 1000, thereby causing the door to close relatively easily; and plurality of screw holes 1300 in front face 1900, which can be sized to dimensions minimally greater than a major diameter of screws. The screws can be adapted to couple strike plate 1000 to the door frame.

Strike plate 1000 has a thickness 1100, which can be selected such that, when installed in the mortised pocket, a plane of front face 1900 of strike plate 1000 is substantially flush with a plane of a door rabbet in the door frame.

Strike plate 1000 can comprise a rigid material. Strike plate 1000 can be adapted for latching and locking door hardware devices. Strike plate 1000 can define:

first cutout 1400 and/or second cutout 1450, each of which can be adapted to receive a door hardware bolt; and plurality of grooves 1500, which can extend from near first cutout 1400 and/or second cutout 1450 to near an edge of lip 1600 of strike plate 1000; wherein grooves 1500 are adapted to reduce a surface area of strike plate 1000 contacting the door hardware bolt, thereby reducing friction of the door hardware bolt as the bolt moves across strike plate 1000.

Figure 2:
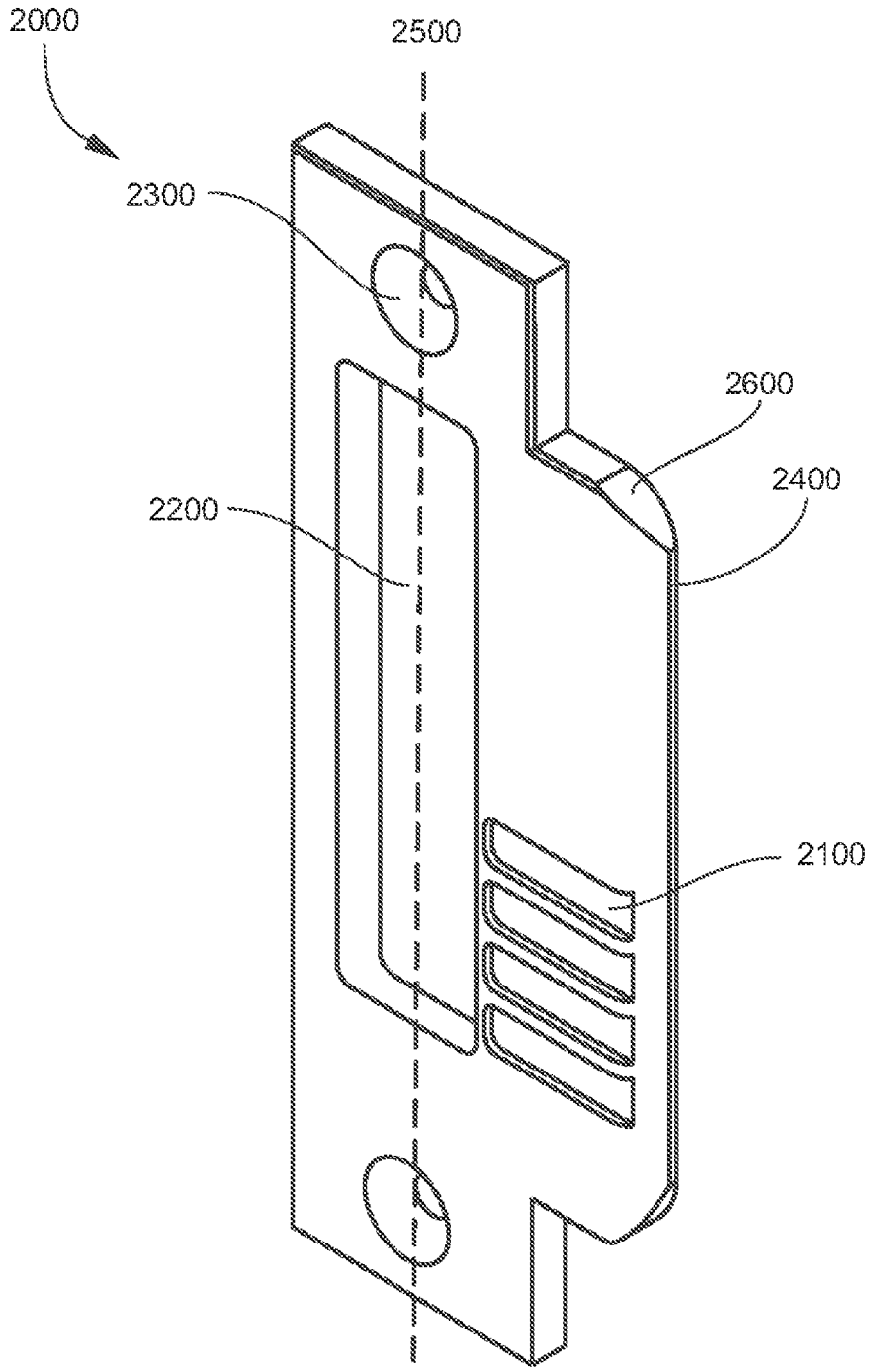
FIG. 2 is a perspective view of an exemplary embodiment of a strike plate 2000.

FIG. 2 is a perspective view of an exemplary embodiment of a strike plate 2000, which can comprise a lip 2600. Strike plate 2000 can define grooves 2100 (in part defined by lip 2600), a cutout 2200, and screw holes 2300. Grooves 2100 can be offset from a centerline of cutout 2200, as illustrated. Grooves 2100 can be adapted to reduce friction between a door hardware bolt and strike plate 2000 when a door is closing. Although four grooves are illustrated in this embodiment and a defined count of grooves are illustrated in other embodiments, any number of grooves can be used to reduce friction. In certain exemplary embodiments, a distance from a longitudinal centerline 2500 of cutout 2200 to an edge 2400 of strike plate 2000 can be approximately one and three eighths of an inch. Other lip edge-to-center dimensions can be made to user specifications.

Figure 3:
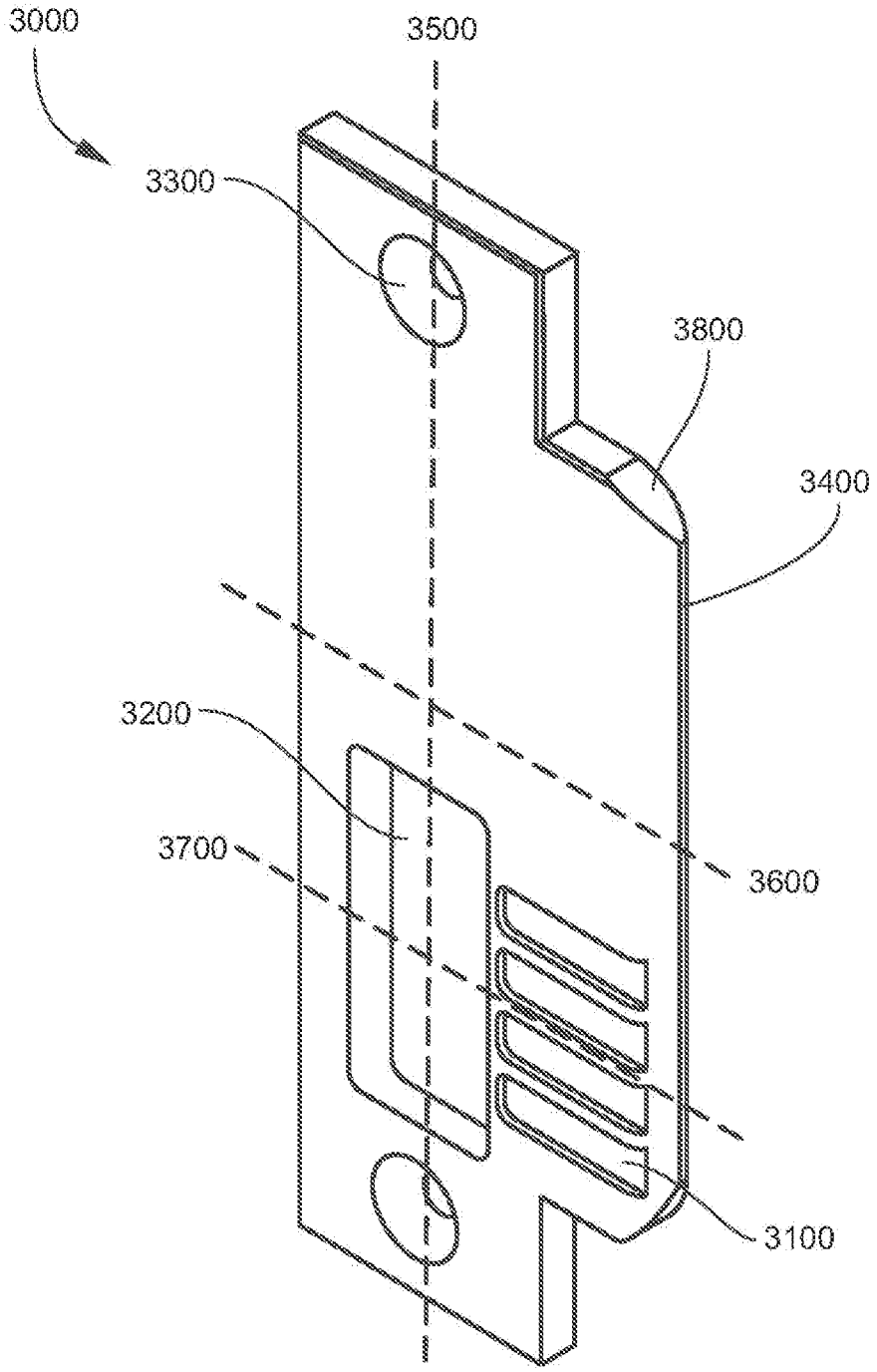
FIG. 3 is a perspective view of an exemplary embodiment of a strike plate 3000.

FIG. 3 is a perspective view of an exemplary embodiment of a strike plate 3000, which can comprise a lip 3800. Strike plate 3000 can define grooves 3100 (in part defined by lip 3800), a cutout 3200, and screw holes 3300. Grooves 3100 can be approximately centered with a centerline of cutout 3200, as illustrated. A latitudinal centerline 3700 of cutout 3200 can be offset from a latitudinal centerline 3600 of strike plate 3000 as illustrated. Grooves 3100 can be adapted to reduce friction between a door hardware bolt and strike plate 3000 when a door is closing. Although four grooves are illustrated in this embodiment and a defined count of grooves are illustrated in other embodiments, any number of grooves can be used to reduce friction. In certain exemplary embodiments, a distance from a longitudinal centerline 3500 of cutout 3700 to an edge 3400 of strike plate 3000 can be approximately one and three eighths of an inch. Other lip edge-to-center dimensions can be made to user specifications.

Figure 4:
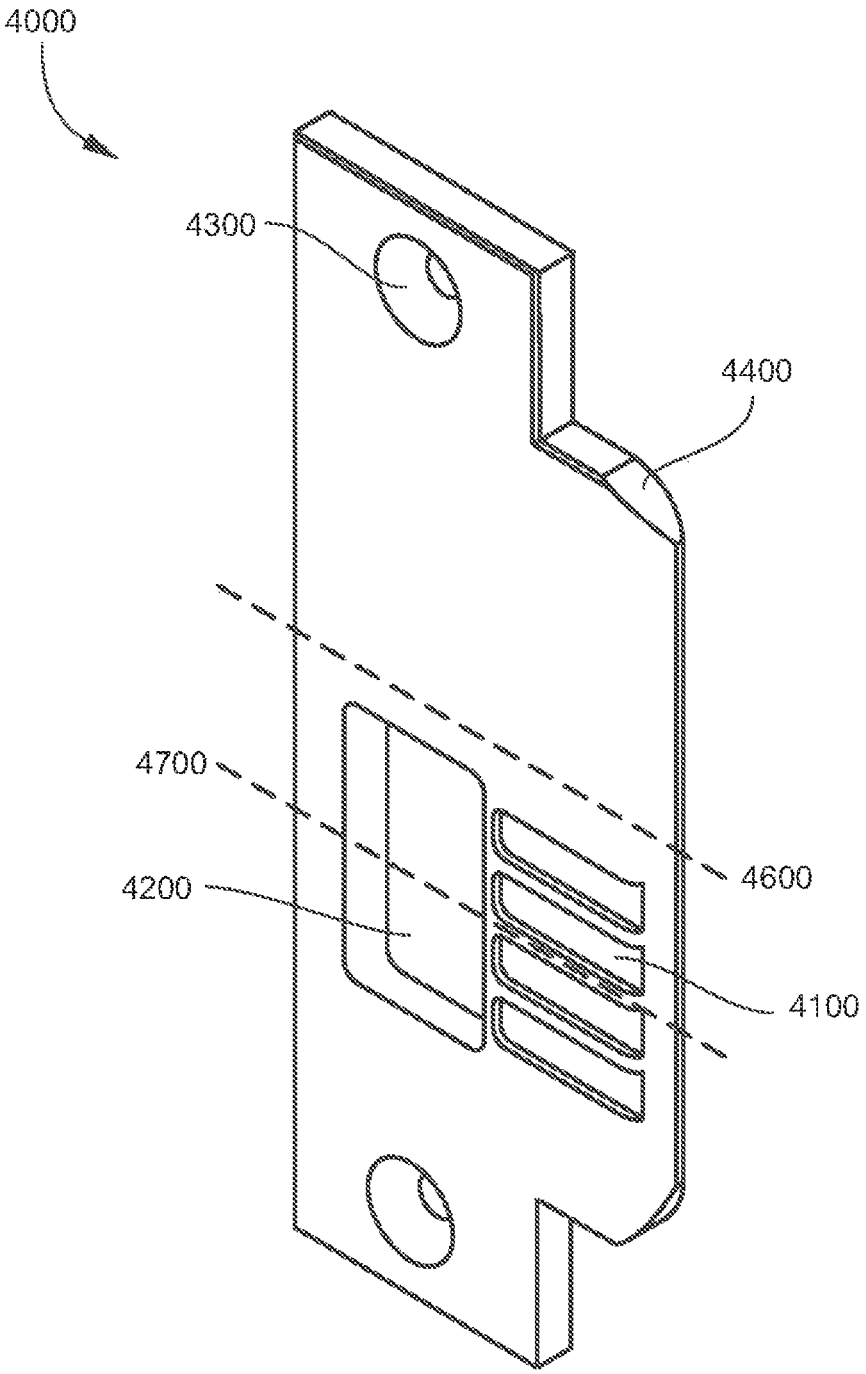
FIG. 4 is a perspective view of an exemplary embodiment of a strike plate 4000.

FIG. 4 is a perspective view of an exemplary embodiment of a strike plate 4000, which can comprise a lip 4400. Strike plate 4000 can define grooves 4100 (in part defined by lip 4400), a cutout 4200, and screw holes 4300. Grooves 4100 can be approximately centered with a centerline of cutout 4200, as illustrated. A latitudinal centerline 4700 of cutout 4200 can be offset from a latitudinal centerline 4600 of strike plate 4000 as illustrated. Grooves 4100 can be adapted to reduce friction between a door hardware bolt and strike plate 4000 when a door is closing. Although four grooves are illustrated in this embodiment and a defined count of grooves are illustrated in other embodiments, any number of grooves can be used to reduce friction.

Figure 5:
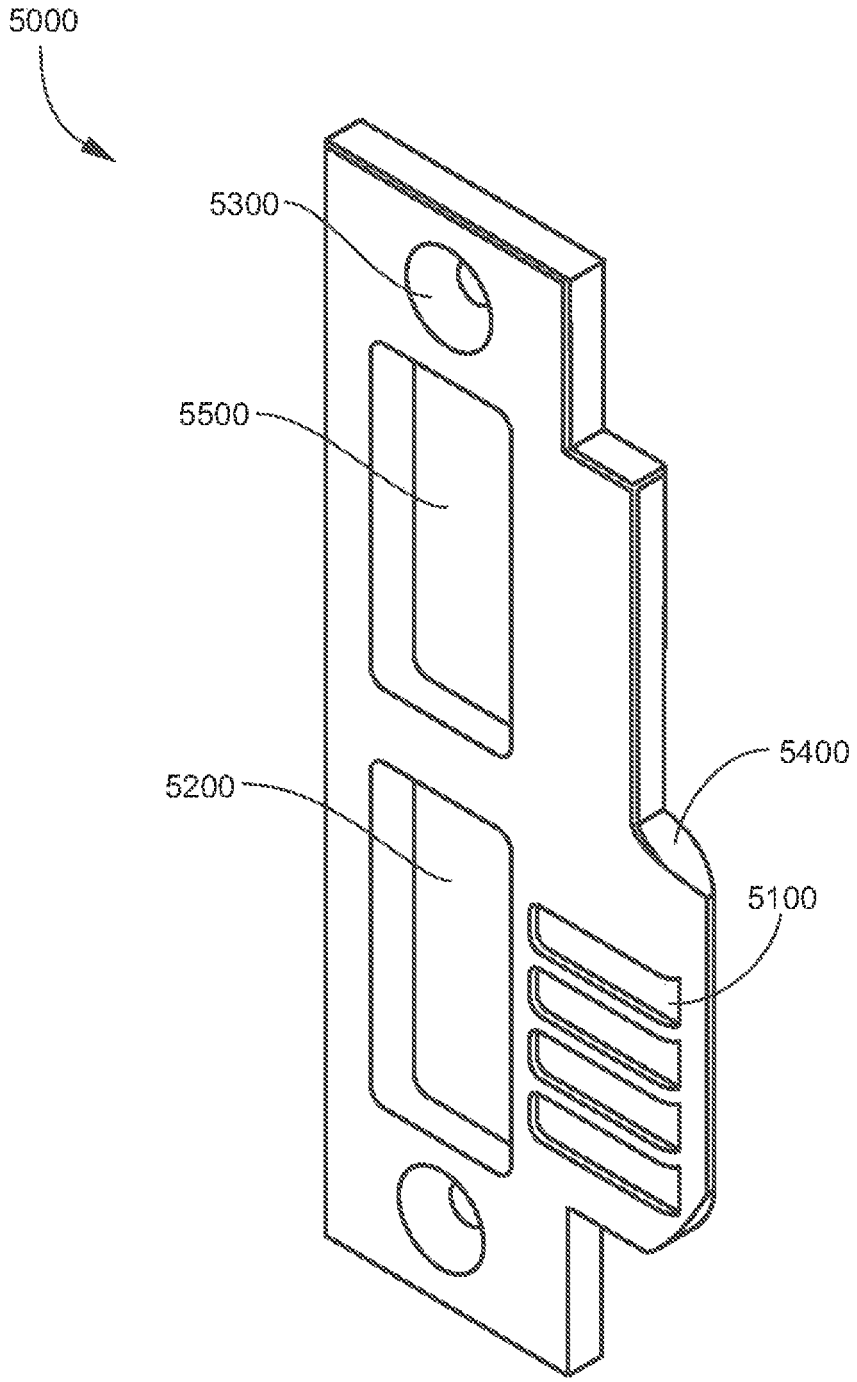
FIG. 5 is a perspective view of an exemplary embodiment of a strike plate 5000.

FIG. 5 is a perspective view of an exemplary embodiment of a strike plate 5000, which can comprise a lip 5400. Strike plate 5000 can define grooves 5100 (in part defined by lip 5400), a first cutout 5200, screw holes 5300, and a second cutout 5500. Grooves 5100 can be approximately centered with a latitudinal centerline of first cutout 5200, as illustrated. Grooves 5100 can be adapted to reduce friction between a door hardware bolt and strike plate 5000 when a door is closing. Although four grooves are illustrated in this embodiment and a defined count of grooves are illustrated in other embodiments, any number of grooves can be used to reduce friction.

Figure 6:
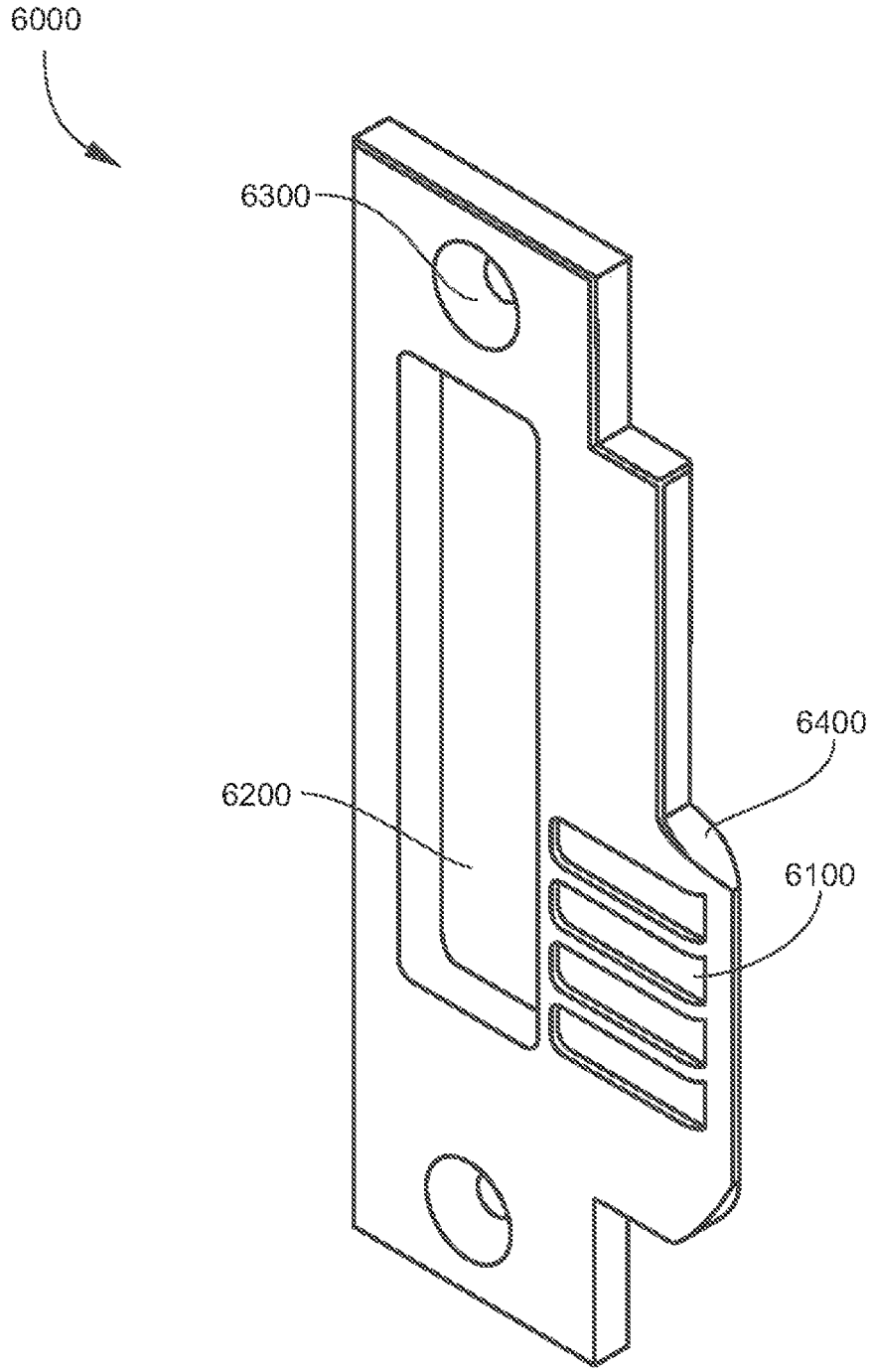
FIG. 6 is a perspective view of an exemplary embodiment of a strike plate 6000.

FIG. 6 is a perspective view of an exemplary embodiment of a strike plate 6000, which can comprise a lip 6400. Strike plate 6000 can define grooves 6100 (in part defined by lip 6400), a cutout 6200, and screw holes 6300. Grooves 6100 can be offset relative to a latitudinal centerline of cutout 6200, as illustrated. A latitudinal centerline of cutout 6200 can be offset from a latitudinal centerline of strike plate 6000 as illustrated. In other embodiments, a latitudinal centerline of cutout 6200 can be approximately aligned with the latitudinal centerline of strike plate 6000. Grooves 6100 can be adapted to reduce friction between a door hardware bolt and strike plate 6000 when a door is closing. Although four grooves are illustrated in this embodiment and a defined count of grooves are illustrated in other embodiments, any number of grooves can be used to reduce friction.

Figure 7:
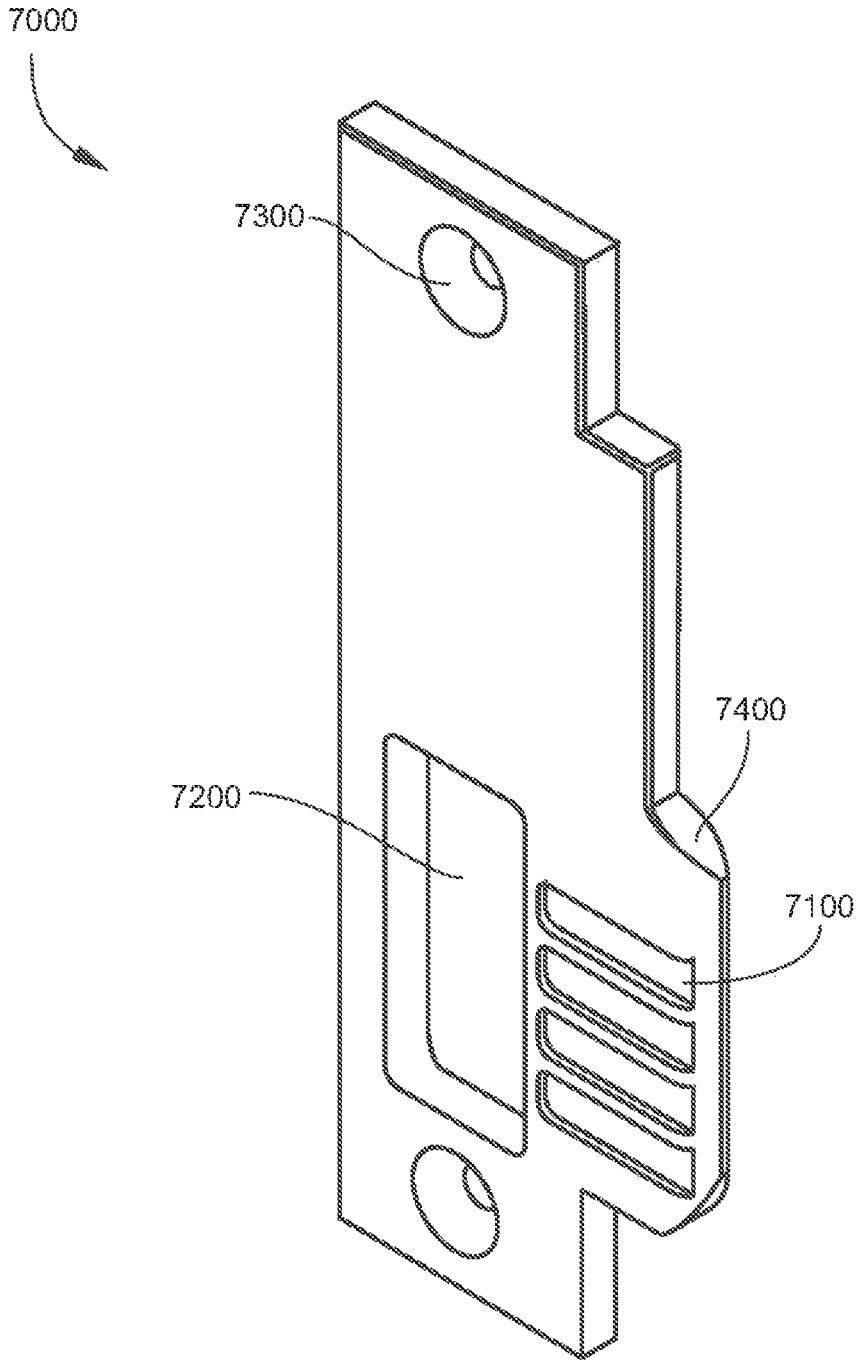
FIG. 7 is a perspective view of an exemplary embodiment of a strike plate 7000.

FIG. 7 is a perspective view of an exemplary embodiment of a strike plate 7000, which can comprise a lip 7400. Strike plate 7000 can define grooves 7100 (in part defined by lip 7400), a cutout 7200, and screw holes 7300. Grooves 7100 can be approximately centered relative to a latitudinal centerline of cutout 7200, as illustrated. A latitudinal centerline of cutout 7200 can be offset from a latitudinal centerline of strike plate 7000 as illustrated. Grooves 7100 can be adapted to reduce friction between a door hardware bolt and strike plate 7000 when a door is closing. Although four grooves are illustrated in this embodiment and a defined count of grooves are illustrated in other embodiments, any number of grooves can be used to reduce friction.

Figure 8:
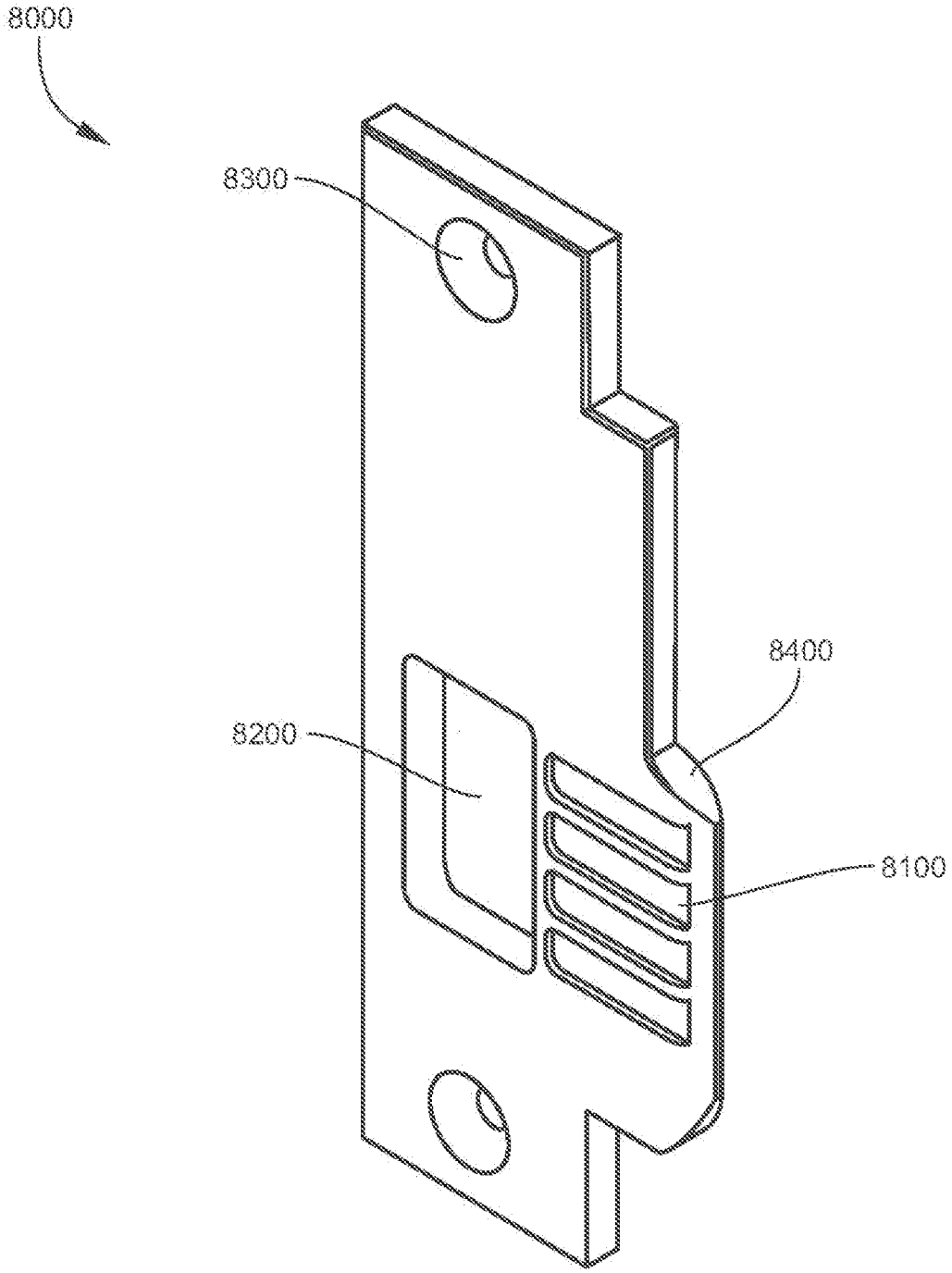
FIG. 8 is a perspective view of an exemplary embodiment of a strike plate 8000.

FIG. 8 is a perspective view of an exemplary embodiment of a strike plate 8000, which can comprise a lip 8400. Strike plate 8000 can define grooves 8100 (in part defined by lip 8400), a cutout 8200, and screw holes 8300. Grooves 8100 can be approximately centered relative to a latitudinal centerline of cutout 8200, as illustrated. A latitudinal centerline of cutout 8200 can be offset from a latitudinal centerline of strike plate 8000 as illustrated. Grooves 8100 can be adapted to reduce friction between a door hardware bolt and strike plate 8000 when a door is closing. Although four grooves are illustrated in this embodiment and a defined count of grooves are illustrated in other embodiments, any number of grooves can be used to reduce friction.

Figure 9:
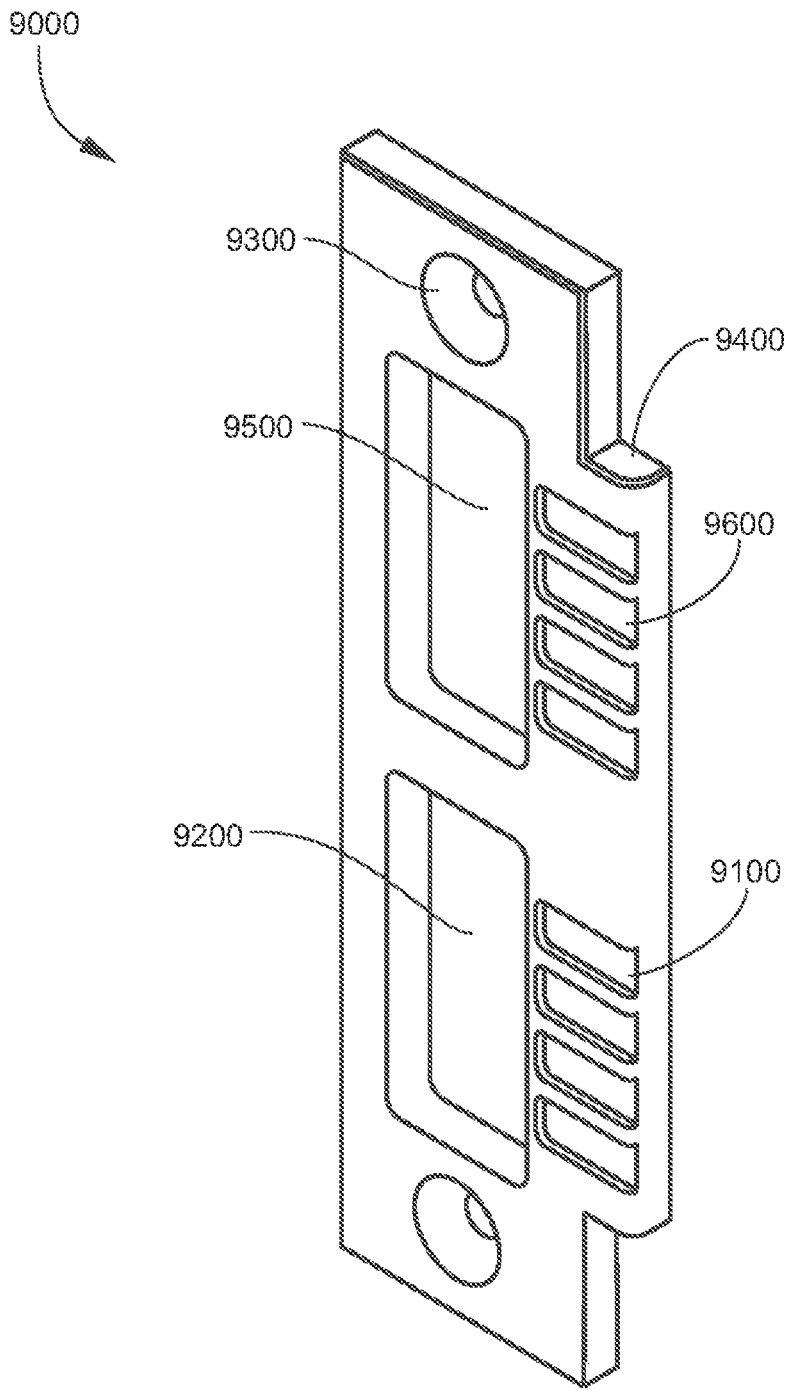
FIG. 9 is a perspective view of an exemplary embodiment of a strike plate 9000.

FIG. 9 is a perspective view of an exemplary embodiment of a strike plate 9000, which can comprise a lip 9400. Strike plate 9000 can define first set of grooves 9100, a first cutout 9200, screw holes 9300, a second cutout 9500, and a second set of grooves 9600. First set of grooves 9100 can be approximately centered relative to a latitudinal centerline of first cutout 9200, as illustrated. Second set of grooves 9600 can be approximately centered relative to a latitudinal centerline of second cutout 9500, as illustrated. First set of grooves 9100 and second set of grooves 9600 can be adapted to reduce friction between door hardware bolts and strike plate 9000 when a door is closing. Although four grooves are illustrated per cutout in this embodiment and a defined count of grooves are illustrated in other embodiments, any number of grooves can be used to reduce friction.

Figure 10:
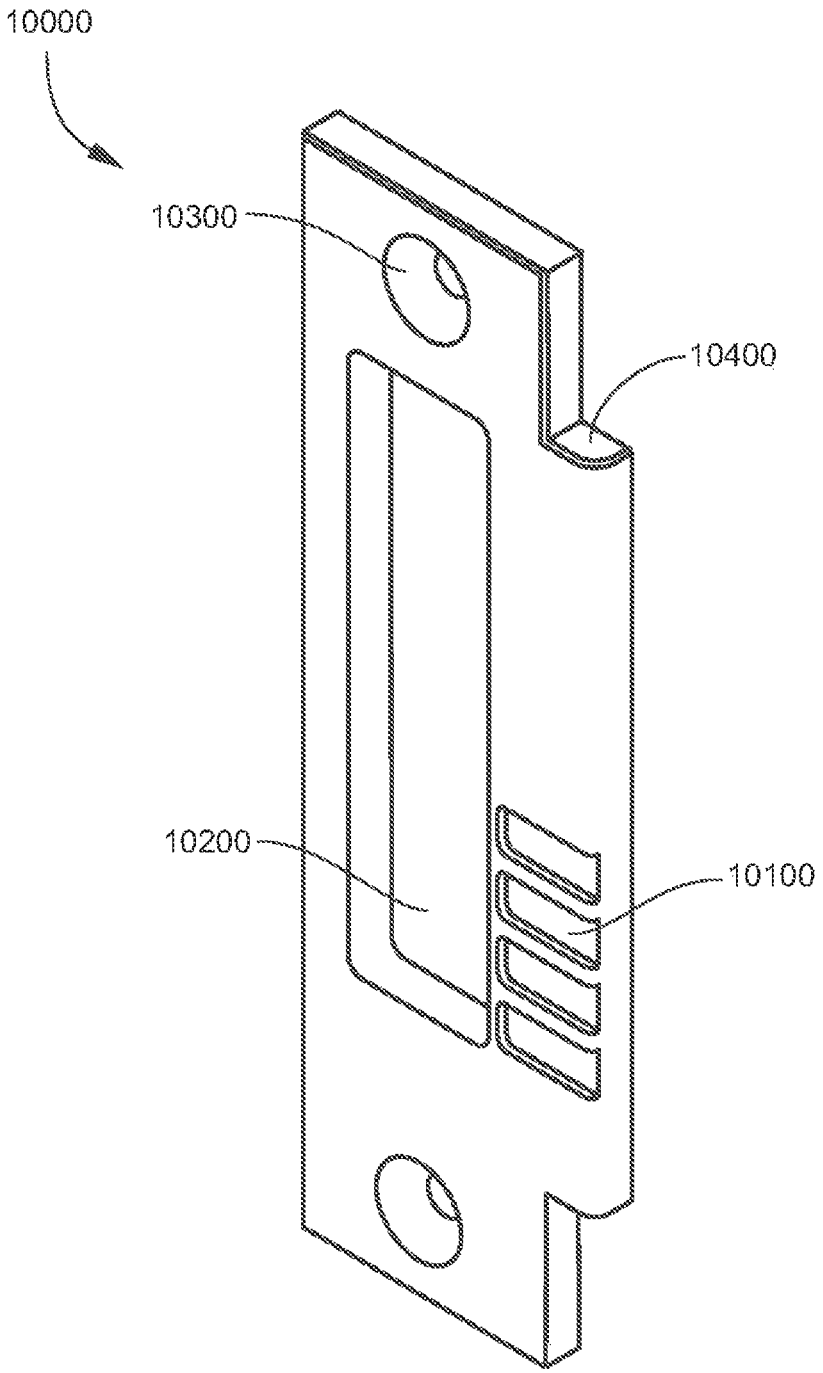
FIG. 10 is a perspective view of an exemplary embodiment of a strike plate 10000.

FIG. 10 is a perspective view of an exemplary embodiment of a strike plate 10000, which can comprise a lip 10400. Strike plate 10000 can define grooves 10100 (in part defined by lip 10400), a cutout 10200, and screw holes 10300. A latitudinal centerline of grooves 10100 can be offset relative to a latitudinal centerline of cutout 10200, as illustrated. A latitudinal centerline of cutout 10200 can be offset from a latitudinal centerline of strike plate 10000 as illustrated. Grooves 10100 can be adapted to reduce friction between a door hardware bolt and strike plate 10000 when a door is closing. Although four grooves are illustrated in this embodiment and a defined count of grooves are illustrated in other embodiments, any number of grooves can be used to reduce friction.

Figure 11:
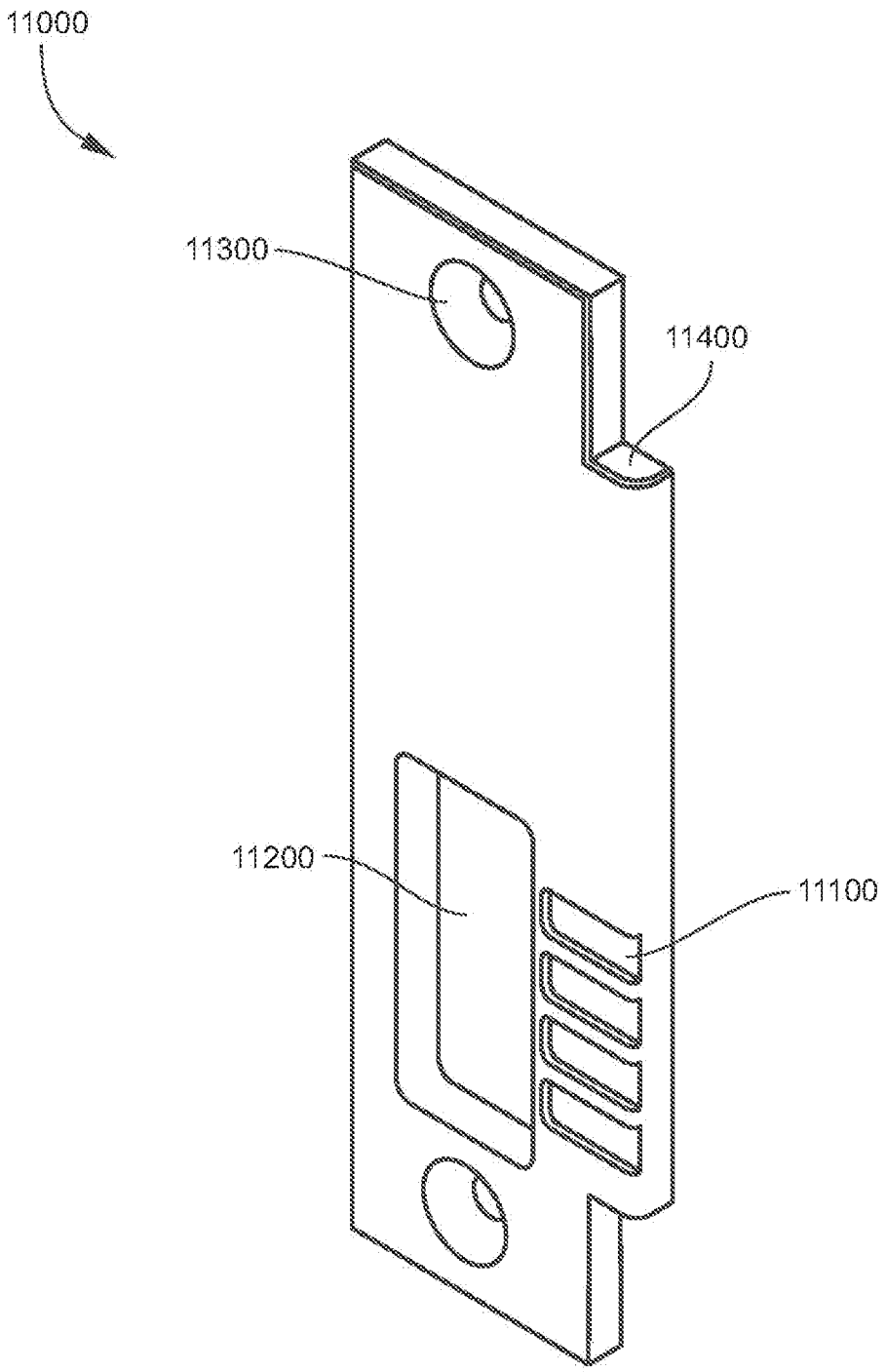
FIG. 11 is a perspective view of an exemplary embodiment of a strike plate 11000.

FIG. 11 is a perspective view of an exemplary embodiment of a strike plate 11000, which can comprise a lip 11400. Strike plate 11000 can define grooves 11100 (in part defined by lip 11400), a cutout 11200, and screw holes 11300. A latitudinal centerline of grooves 11100 can be approximately aligned with a latitudinal centerline of cutout 11200, as illustrated. A latitudinal centerline of cutout 11200 can be offset from a latitudinal centerline of strike plate 11000 as illustrated. Grooves 11100 can be adapted to reduce friction between a door hardware bolt and strike plate 11000 when a door is closing. Although four grooves are illustrated in this embodiment and a defined count of grooves are illustrated in other embodiments, any number of grooves can be used to reduce friction.

Figure 12:
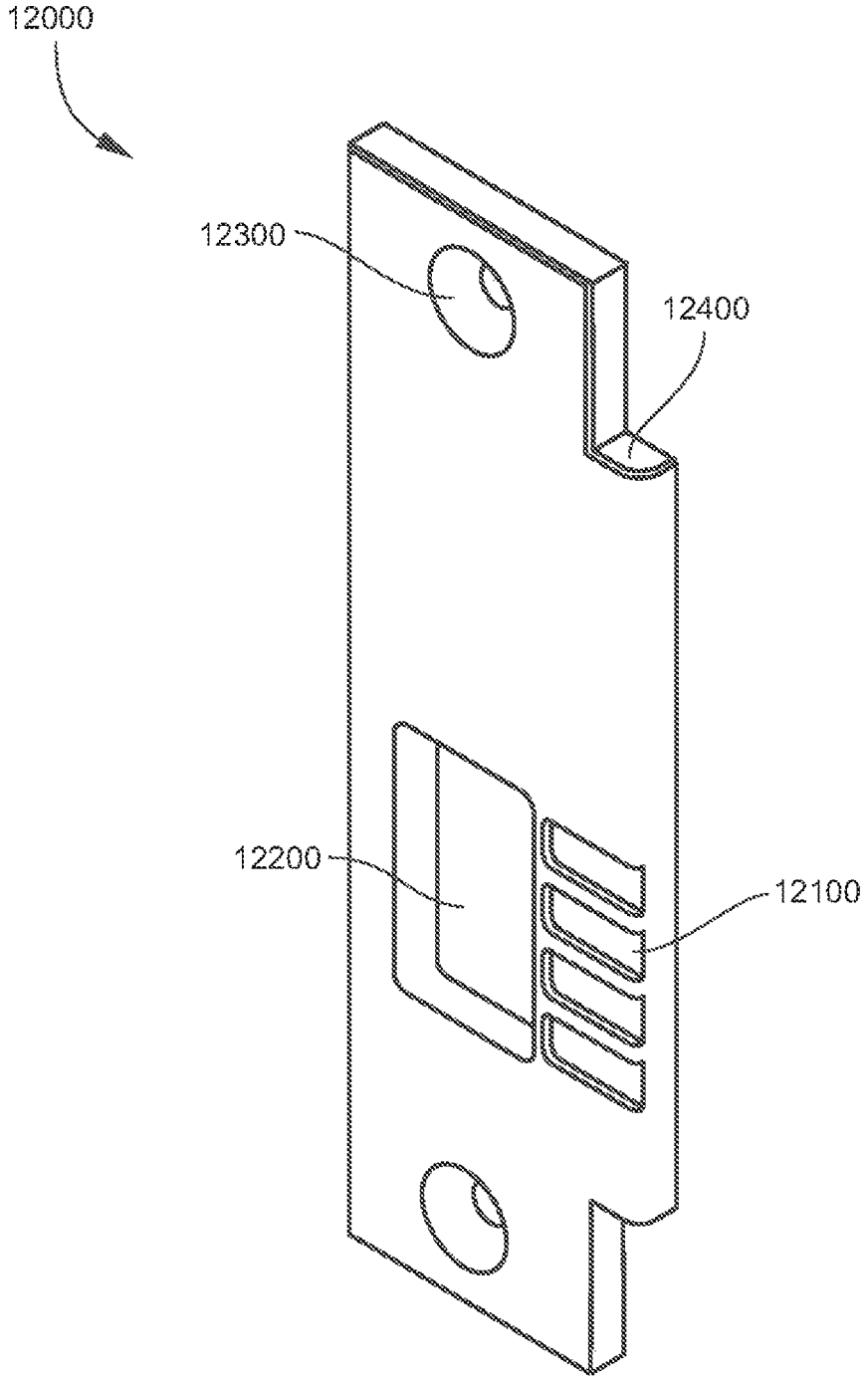
FIG. 12 is a perspective view of an exemplary embodiment of a strike plate 12000.

FIG. 12 is a perspective view of an exemplary embodiment of a strike plate 12000, which can comprise a lip 12400. Strike plate 12000 can define grooves 12100 (in part defined by lip 12400), a cutout 12200, and screw holes 12300. A latitudinal centerline of grooves 12100 can be approximately aligned with a latitudinal centerline of cutout 12200, as illustrated. A latitudinal centerline of cutout 12200 can be offset from a latitudinal centerline of strike plate 12000 as illustrated. Grooves 12100 can be adapted to reduce friction between a door hardware bolt and strike plate 12000 when a door is closing. Although four grooves are illustrated in this embodiment and a defined count of grooves are illustrated in other embodiments, any number of grooves can be used to reduce friction.

Figure 13:
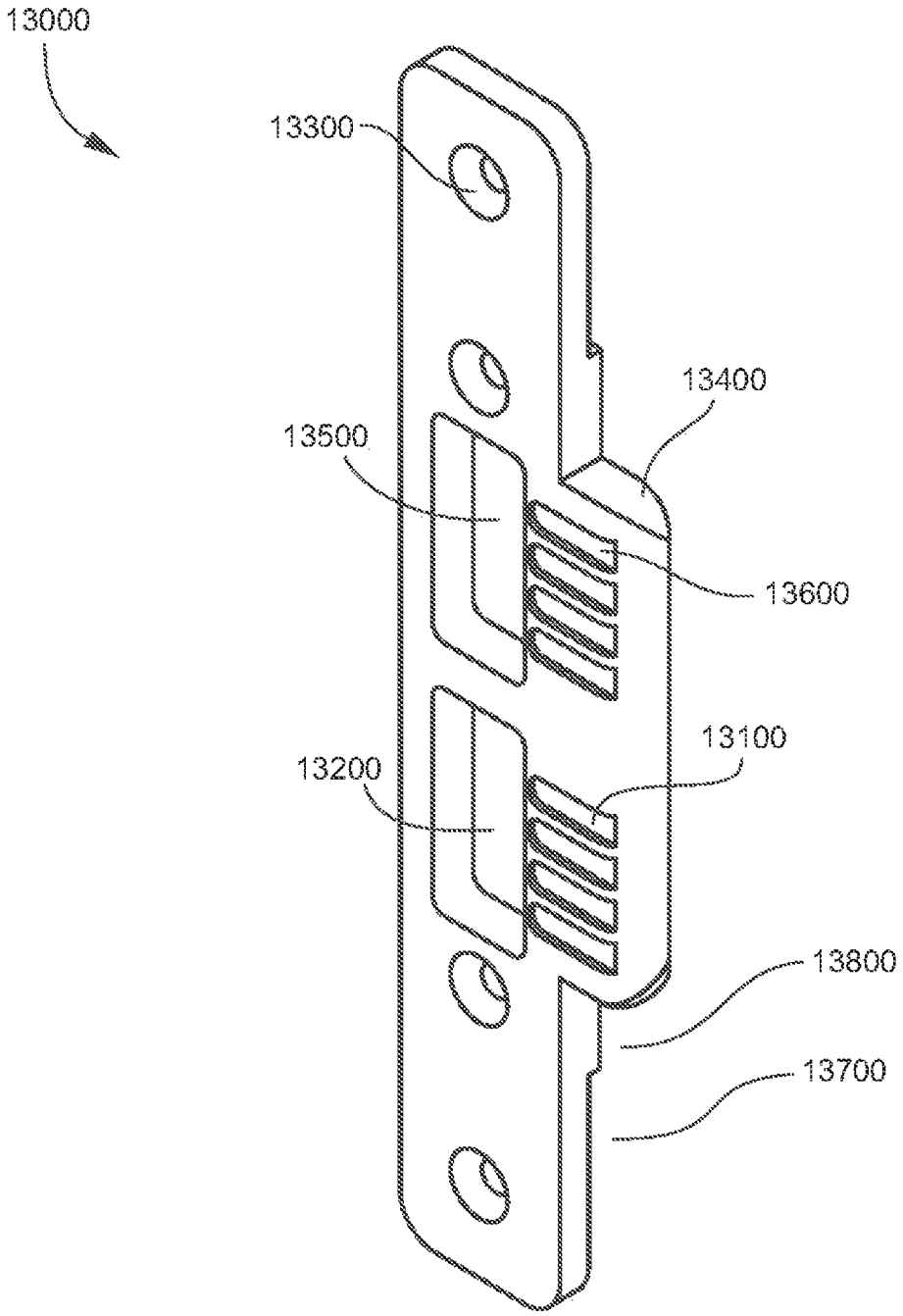
FIG. 13 is a perspective view of an exemplary embodiment of a strike plate 13000.

FIG. 13 is a perspective view of an exemplary embodiment of a strike plate 13000, which can comprise a lip 13400. Strike plate 13000 can define first set of grooves 13100, a first cutout 13200, screw holes 13300, a second cutout 13500, a second set of grooves 13600, and a plurality of reliefs 13700. First set of grooves 13100 can be approximately centered relative to a latitudinal centerline of first cutout 13200, as illustrated. Second set of grooves 13600 can be approximately centered relative to a latitudinal centerline of second cutout 13500, as illustrated. First set of grooves 13100 and second set of grooves 13600 can be adapted to reduce friction between door hardware bolts and strike plate 13000 when a door is closing. Although four grooves are illustrated per cutout in this embodiment and a defined count of grooves are illustrated in other embodiments, any number of grooves can be used to reduce friction. Reliefs 13700 can be adapted to allow back face 13800 of strike plate 13000 to fully seat in mortised pocket (not illustrated) in door frame (not illustrated). Although four screw holes are illustrated for strike plate 13000, one skilled in the art will recognize that fewer or more screw holes can be provided (e.g., two or six screw holes).

Figure 14:
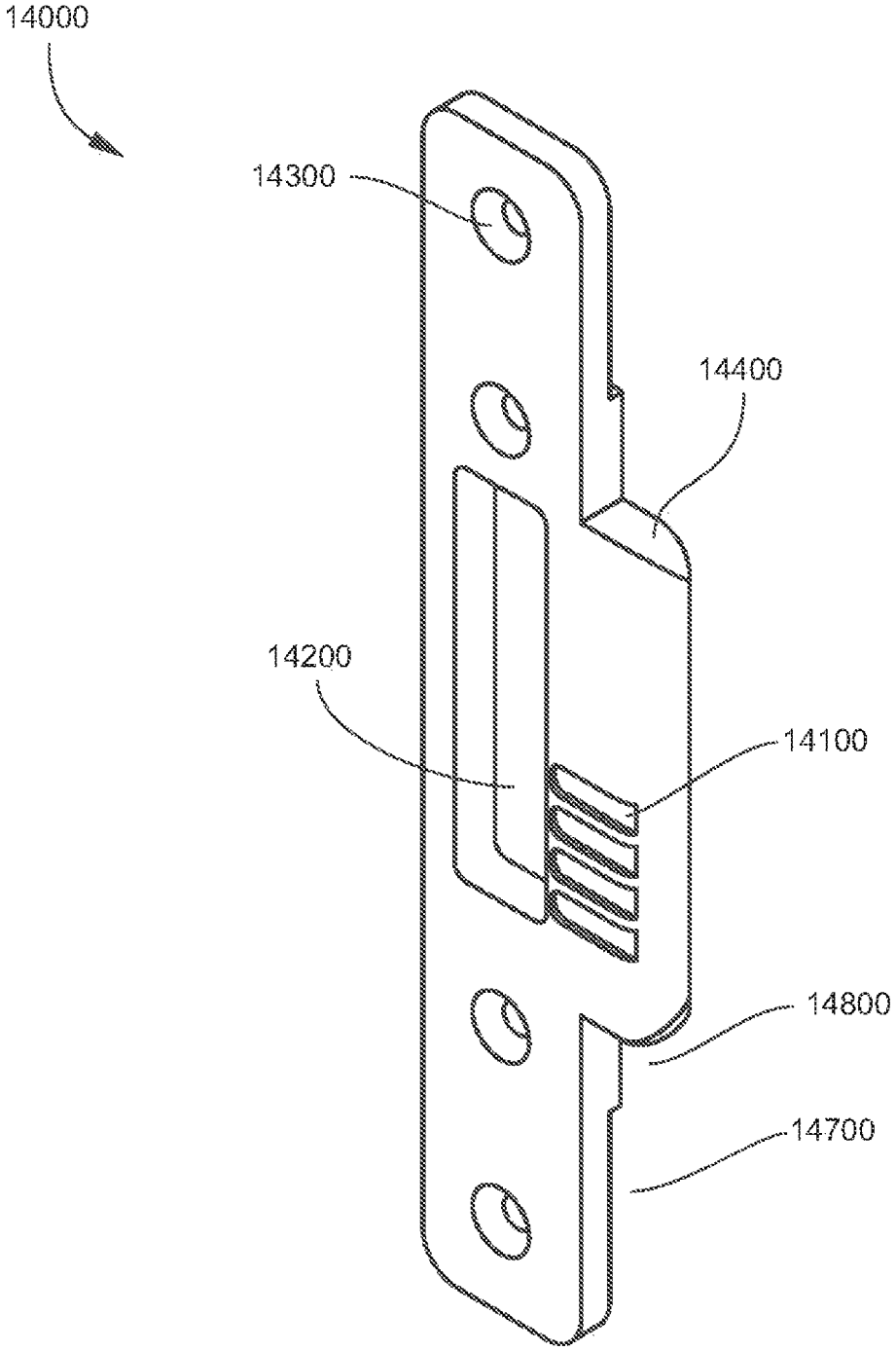
FIG. 14 is a perspective view of an exemplary embodiment of a strike plate 14000.

FIG. 14 is a perspective view of an exemplary embodiment of a strike plate 14000, which can comprise a lip 14400. Strike plate 14000 can define grooves 14100 (in part defined by lip 14400), a cutout 14200, a plurality of reliefs 14700, and screw holes 14300. A latitudinal centerline of grooves 14100 can be offset relative to a latitudinal centerline of cutout 14200, as illustrated. A latitudinal centerline of cutout 14200 can be offset from a latitudinal centerline of strike plate 14000 as illustrated. Grooves 14100 can be adapted to reduce friction between a door hardware bolt and strike plate 14000 when a door is closing. Although four grooves are illustrated in this embodiment and a defined count of grooves are illustrated in other embodiments, any number of grooves can be used to reduce friction. Reliefs 14700 can be adapted to allow back face 14800 of strike plate 14000 to fully seat in mortised pocket (not illustrated) in door frame (not illustrated). Although four screw holes are illustrated for strike plate 14000, one skilled in the art will recognize that fewer or more screw holes can be provided (e.g., two or six screw holes).

Figure 15:
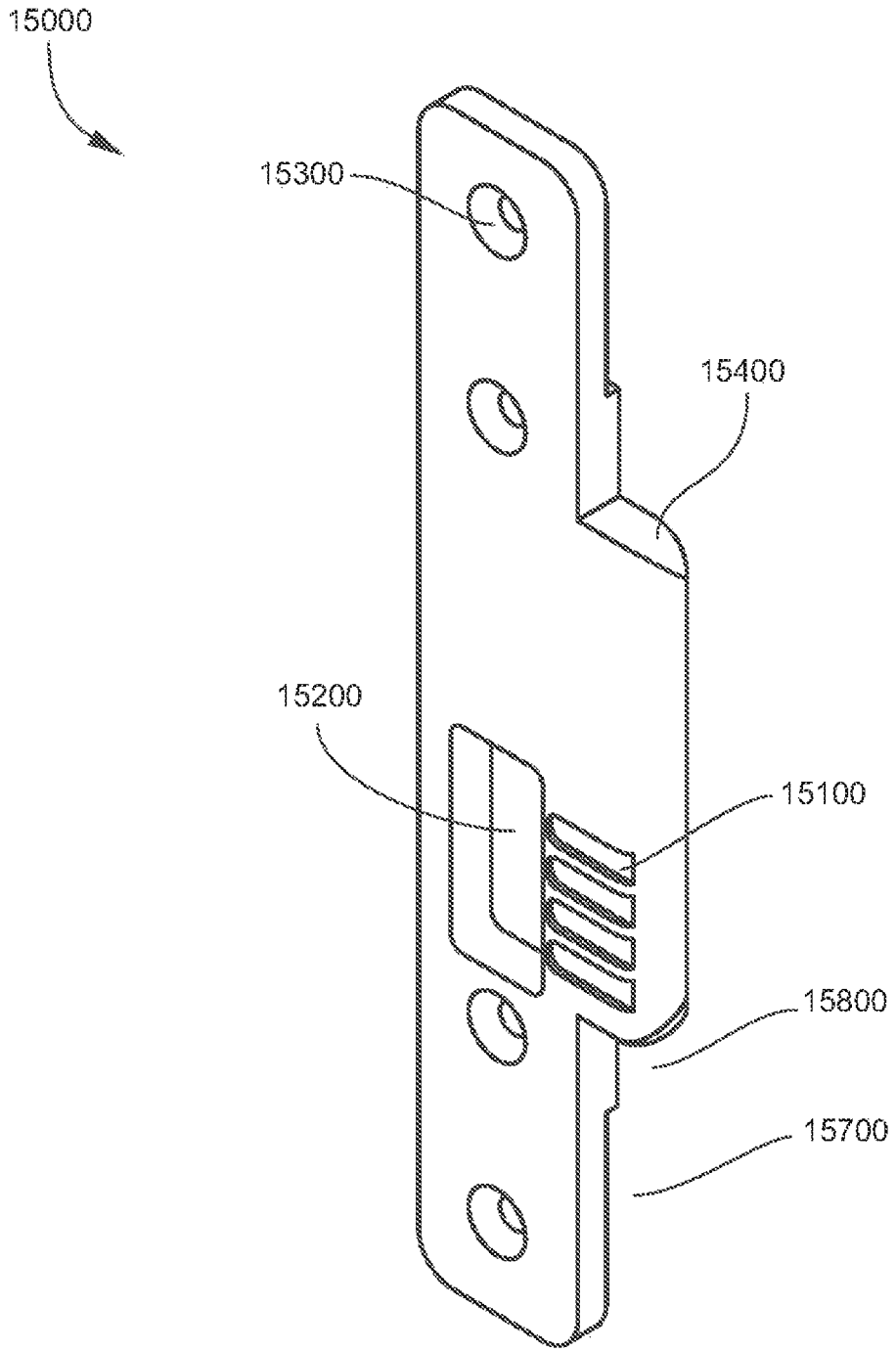
FIG. 15 is a perspective view of an exemplary embodiment of a strike plate 15000.

FIG. 15 is a perspective view of an exemplary embodiment of a strike plate 15000, which can comprise a lip 15400. Strike plate 15000 can define grooves 15100 (in part defined by lip 15400), a cutout 15200, a plurality of reliefs 15700, and screw holes 15300. A latitudinal centerline of grooves 15100 can be approximately aligned with a latitudinal centerline of cutout 15200, as illustrated. A latitudinal centerline of cutout 15200 can be offset from a latitudinal centerline of strike plate 15000 as illustrated. Grooves 15100 can be adapted to reduce friction between a door hardware bolt and strike plate 15000 when a door is closing. Although four grooves are illustrated in this embodiment and a defined count of grooves are illustrated in other embodiments, any number of grooves can be used to reduce friction. Reliefs 15700 can be adapted to allow back face 15800 of strike plate 15000 to fully seat in mortised pocket (not illustrated) in door frame (not illustrated). Although four screw holes are illustrated for strike plate 15000, one skilled in the art will recognize that fewer or more screw holes can be provided (e.g., two or six screw holes).

Figure 16:
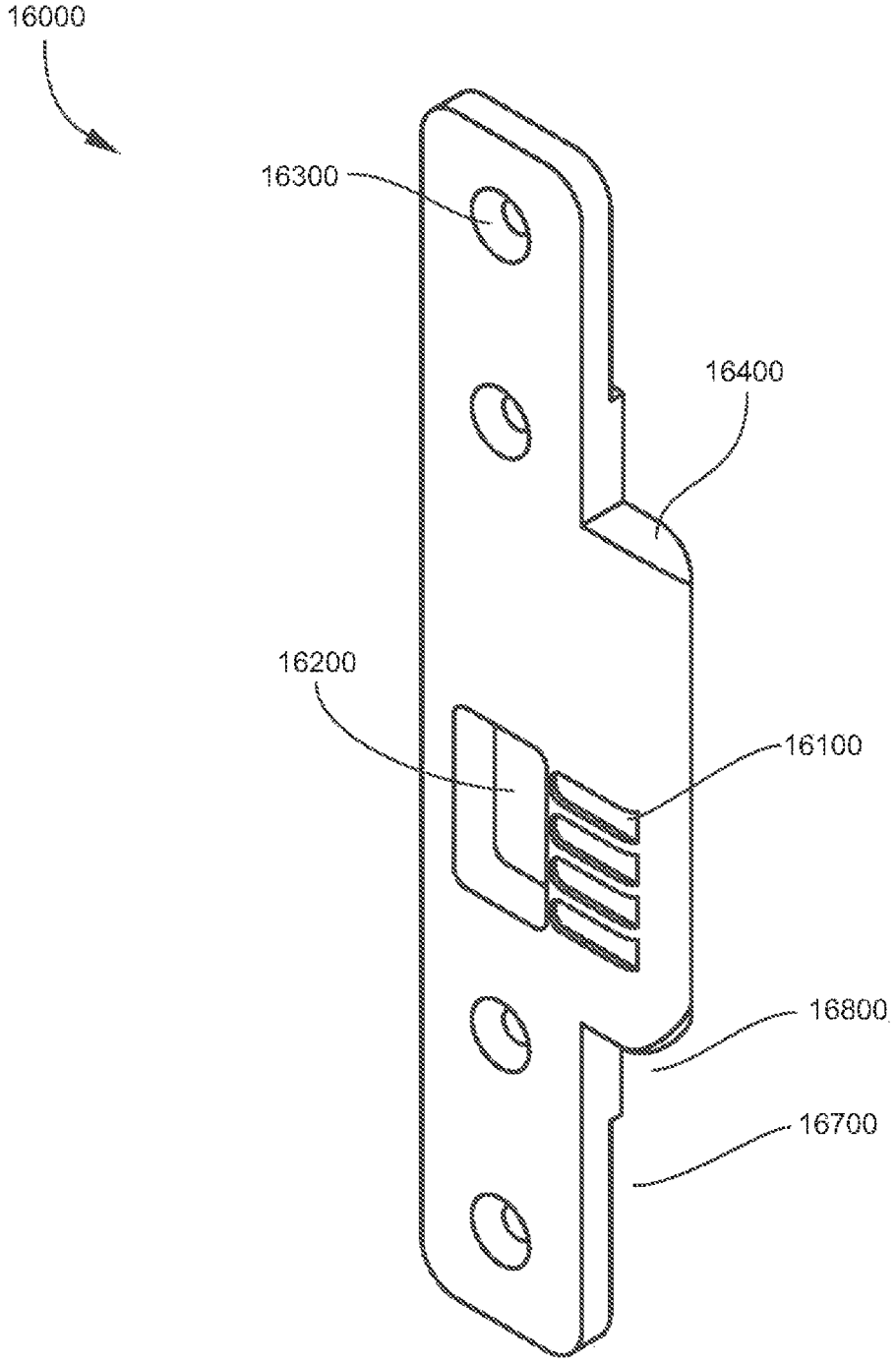
FIG. 16 is a perspective view of an exemplary embodiment of a strike plate 16000.

FIG. 16 is a perspective view of an exemplary embodiment of a strike plate 16000, which can comprise a lip 16400. Strike plate 16000 can define grooves 16100 (in part defined by lip 16400), a cutout 16200, a plurality of reliefs 16700, and screw holes 16300. A latitudinal centerline of grooves 16100 can be approximately aligned with a latitudinal centerline of cutout 16200, as illustrated. A latitudinal centerline of cutout 16200 can be offset from a latitudinal centerline of strike plate 16000 as illustrated. Grooves 16100 can be adapted to reduce friction between a door hardware bolt and strike plate 16000 when a door is closing. Although four grooves are illustrated in this embodiment and a defined count of grooves are illustrated in other embodiments, any number of grooves can be used to reduce friction. Reliefs 16700 can be adapted to allow back face 16800 of strike plate 16000 to fully seat in mortised pocket (not illustrated) in door frame (not illustrated). Although four screw holes are illustrated for strike plate 16000, one skilled in the art will recognize that fewer or more screw holes can be provided (e.g., two or six screw holes).

Figure 17:
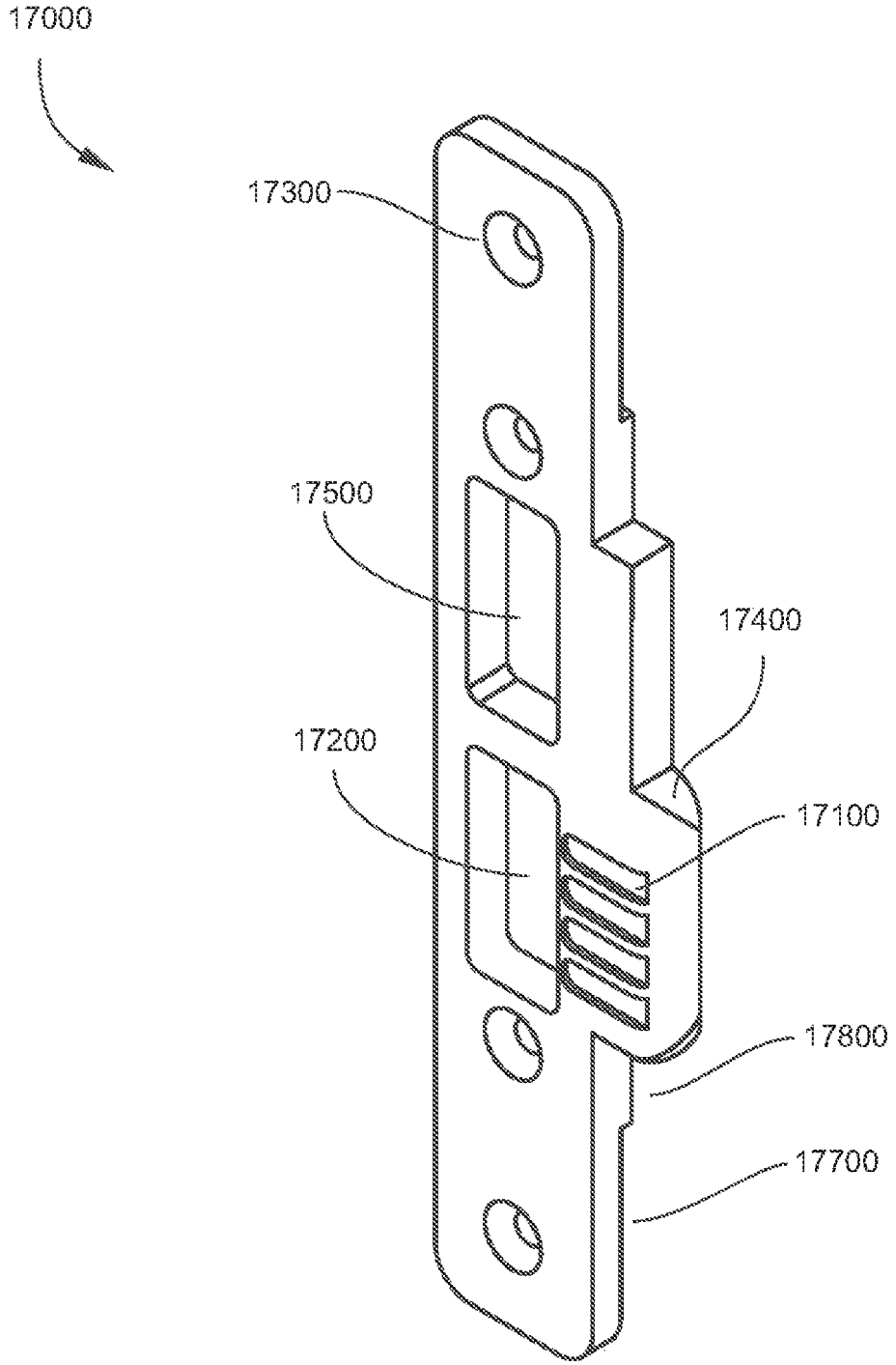
FIG. 17 is a perspective view of an exemplary embodiment of a strike plate 17000.

FIG. 17 is a perspective view of an exemplary embodiment of a strike plate 17000, which can comprise a lip 17400. Strike plate 17000 can define grooves 17100 (in part defined by lip 17400), a first cutout 17200, screw holes 17300, a second cutout 17500, and a plurality of reliefs 17700. Grooves 17100 can be approximately centered relative to a latitudinal centerline of first cutout 17200, as illustrated. Grooves 17100 can be adapted to reduce friction between door hardware bolts and strike plate 17000 when a door is closing. Although four grooves are illustrated per cutout in this embodiment and a defined count of grooves are illustrated in other embodiments, any number of grooves can be used to reduce friction. Reliefs 17700 can be adapted to allow back face 17800 of strike plate 17000 to fully seat in mortised pocket (not illustrated) in door frame (not illustrated). Although four screw holes are illustrated for strike plate 17000, one skilled in the art will recognize that fewer or more screw holes can be provided (e.g., two or six screw holes).

Figure 18:
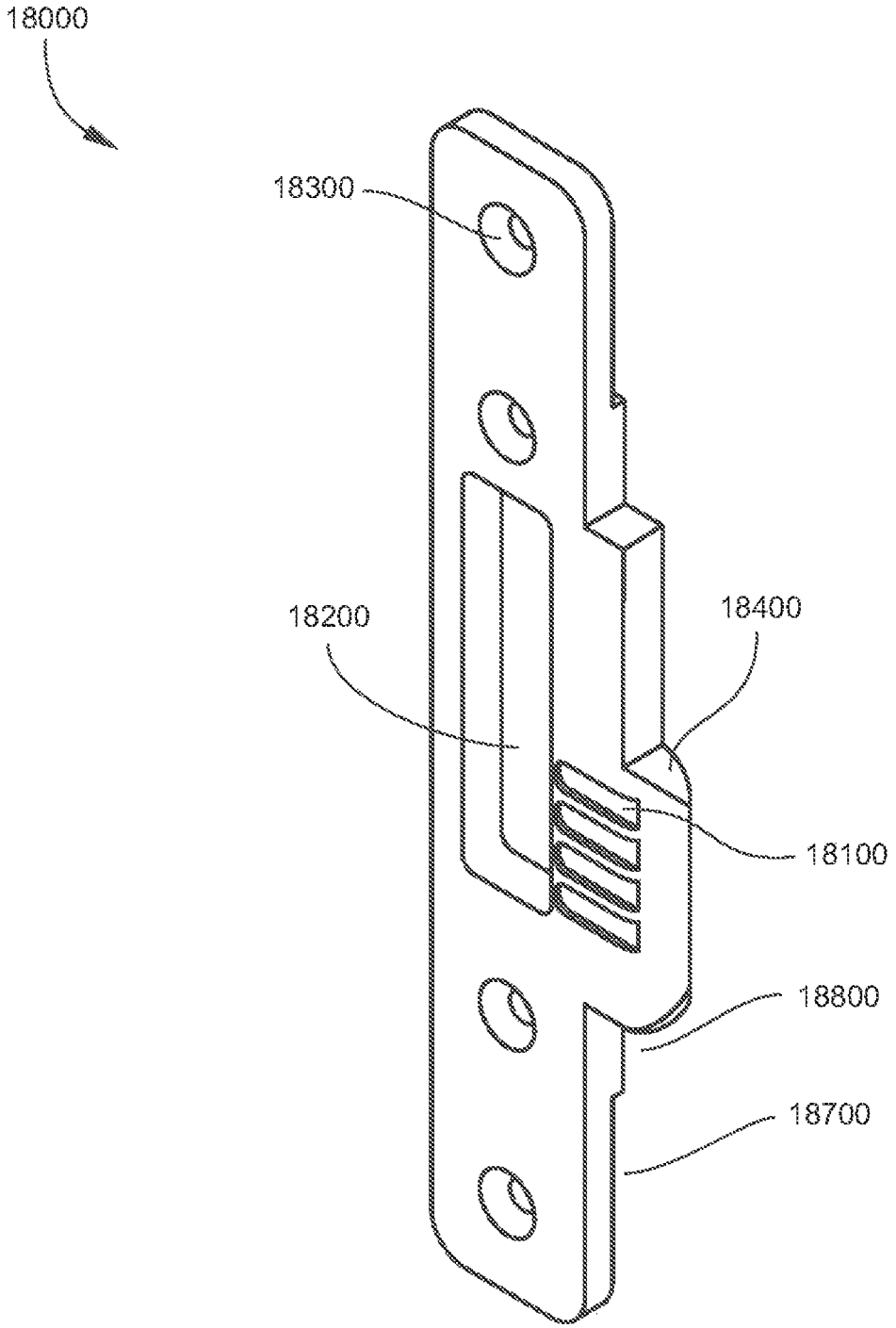
FIG. 18 is a perspective view of an exemplary embodiment of a strike plate 18000.

FIG. 18 is a perspective view of an exemplary embodiment of a strike plate 18000, which can comprise a lip 18400. Strike plate 18000 can define grooves 18100 (in part defined by lip 18400), a cutout 18200, a plurality of reliefs 18700, and screw holes 18300. A latitudinal centerline of grooves 18100 can be offset relative to a latitudinal centerline of cutout 18200, as illustrated. A latitudinal centerline of cutout 18200 can be offset from a latitudinal centerline of strike plate 18000 as illustrated. Grooves 18100 can be adapted to reduce friction between a door hardware bolt and strike plate 18000 when a door is closing. Although four grooves are illustrated in this embodiment and a defined count of grooves are illustrated in other embodiments, any number of grooves can be used to reduce friction. Reliefs 18700 can be adapted to allow back face 18800 of strike plate 18000 to fully seat in mortised pocket (not illustrated) in door frame (not illustrated). Although four screw holes are illustrated for strike plate 18000, one skilled in the art will recognize that fewer or more screw holes can be provided (e.g., two or six screw holes).

Figure 19:
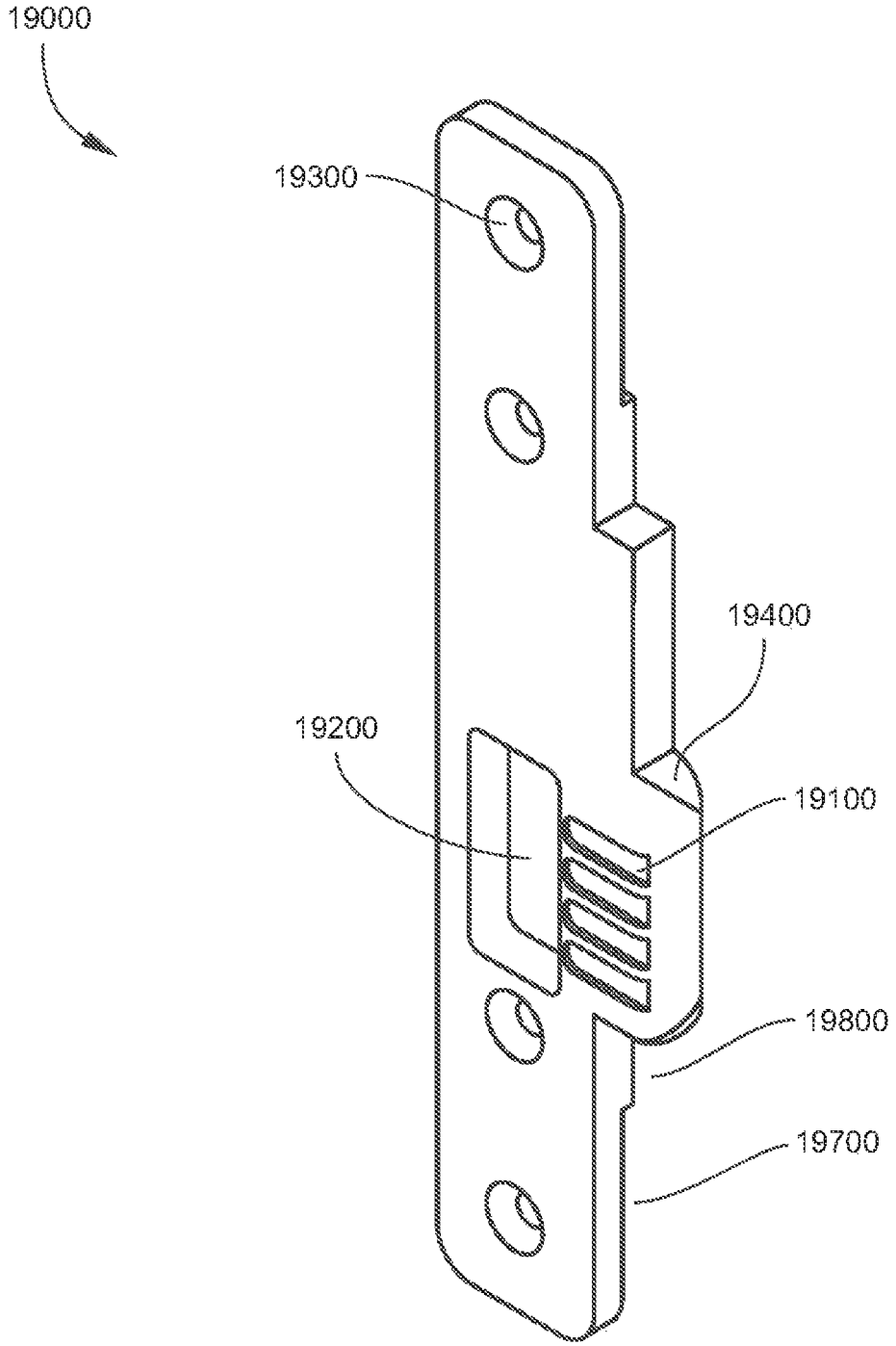
FIG. 19 is a perspective view of an exemplary embodiment of a strike plate 19000.

FIG. 19 is a perspective view of an exemplary embodiment of a strike plate 19000, which can comprise a lip 19400. Strike plate 19000 can define grooves 19100 (in part defined by lip 19400), a cutout 19200, a plurality of reliefs 19700, and screw holes 19300. A latitudinal centerline of grooves 19100 can be approximately aligned with a latitudinal centerline of cutout 19200, as illustrated. A latitudinal centerline of cutout 19200 can be offset from a latitudinal centerline of strike plate 19000 as illustrated. Grooves 19100 can be adapted to reduce friction between a door hardware bolt and strike plate 19000 when a door is closing. Although four grooves are illustrated in this embodiment and a defined count of grooves are illustrated in other embodiments, any number of grooves can be used to reduce friction. Reliefs 19700 can be adapted to allow back face 19800 of strike plate 19000 to fully seat in mortised pocket (not illustrated) in door frame (not illustrated). Although four screw holes are illustrated for strike plate 19000, one skilled in the art will recognize that fewer or more screw holes can be provided (e.g., two or six screw holes).

Figure 20:
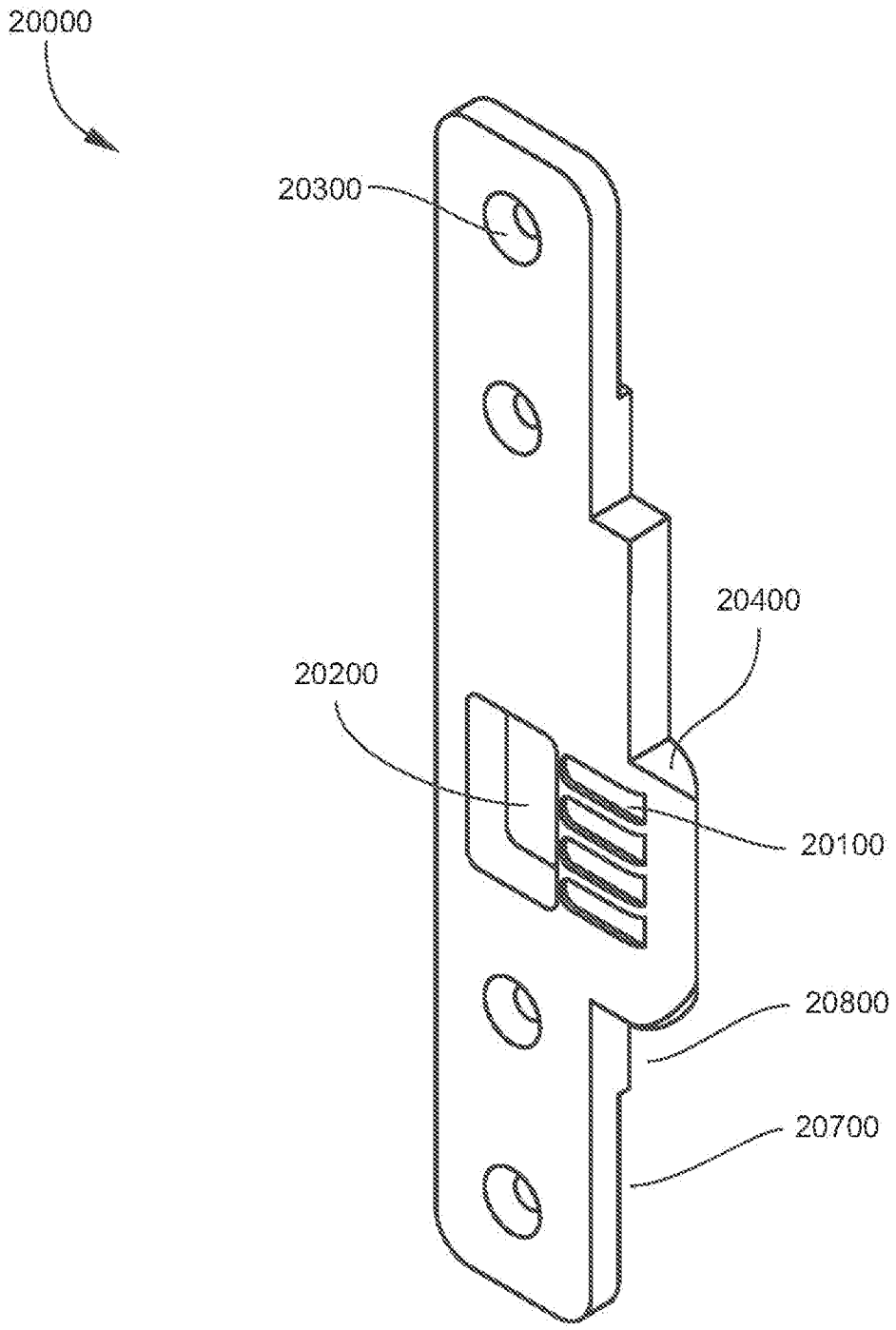
FIG. 20 is a perspective view of an exemplary embodiment of a strike plate 20000.

FIG. 20 is a perspective view of an exemplary embodiment of a strike plate 20000, which can comprise a lip 20400. Strike plate 20000 can define grooves 20100 (in part defined by lip 20400), a cutout 20200, a plurality of reliefs 20700, and screw holes 20300. A latitudinal centerline of grooves 20100 can be approximately aligned with a latitudinal centerline of cutout 20200, as illustrated. A latitudinal centerline of cutout 20200 can be offset from a latitudinal centerline of strike plate 20000 as illustrated. Grooves 20100 can be adapted to reduce friction between a door hardware bolt and strike plate 20000 when a door is closing. Although four grooves are illustrated in this embodiment and a defined count of grooves are illustrated in other embodiments, any number of grooves can be used to reduce friction. Reliefs 20700 can be adapted to allow back face 20800 of strike plate 20000 to fully seat in mortised pocket (not illustrated) in door frame (not illustrated). Although four screw holes are illustrated for strike plate 20000, one skilled in the art will recognize that fewer or more screw holes can be provided (e.g., two or six screw holes).

Figure 21:
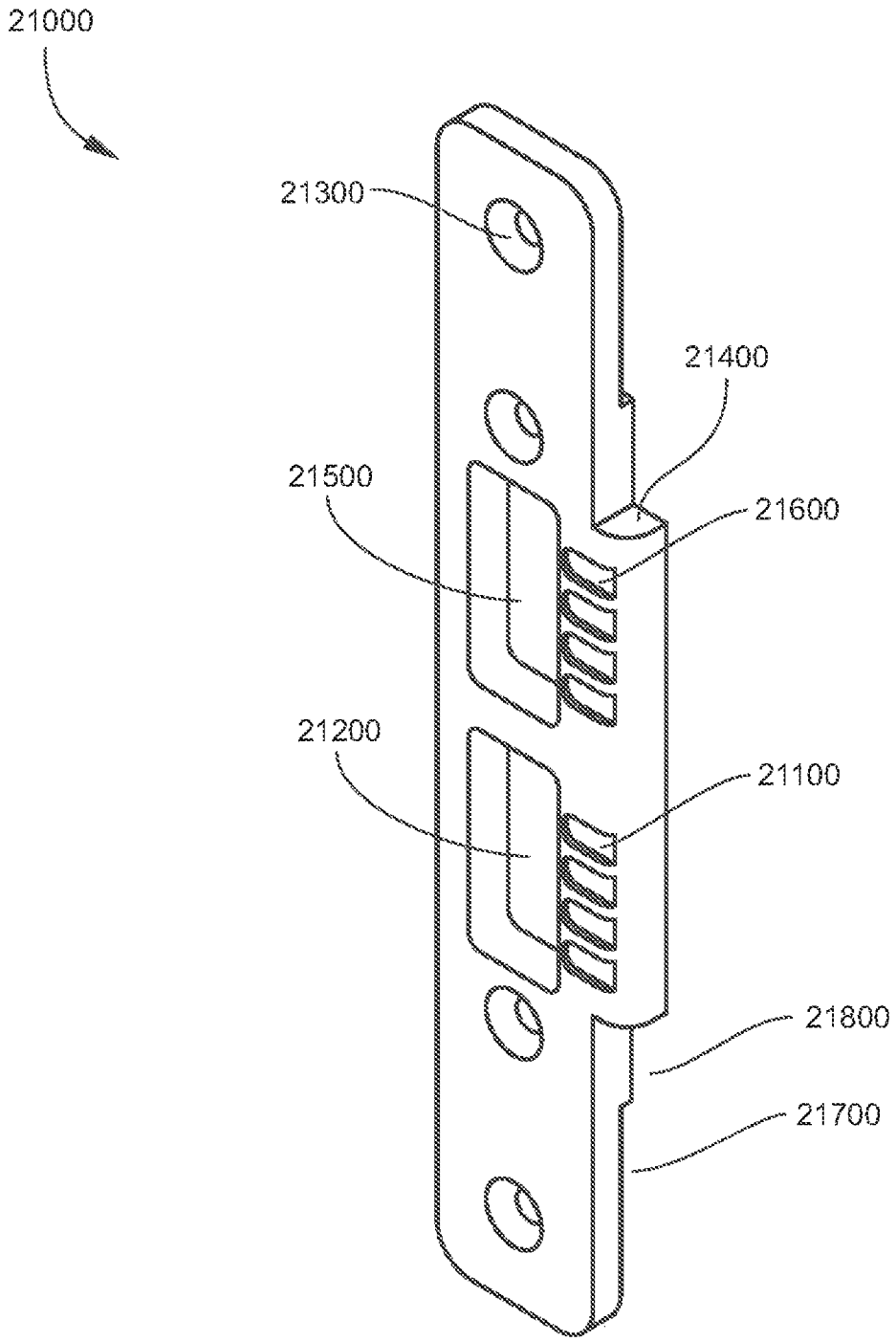
FIG. 21 is a perspective view of an exemplary embodiment of a strike plate 21000.

FIG. 21 is a perspective view of an exemplary embodiment of a strike plate 21000, which can comprise a lip 21400. Strike plate 21000 can define first set of grooves 21100, a first cutout 21200, screw holes 21300, a second cutout 21500, a second set of grooves 21600, and a plurality of reliefs 21700. First set of grooves 21100 can be approximately centered relative to a latitudinal centerline of first cutout 21200, as illustrated. Second set of grooves 21600 can be approximately centered relative to a latitudinal centerline of second cutout 21500, as illustrated. First set of grooves 21100 and second set of grooves 21600 can be adapted to reduce friction between door hardware bolts and strike plate 21000 when a door is closing. Although four grooves are illustrated per cutout in this embodiment and a defined count of grooves are illustrated in other embodiments, any number of grooves can be used to reduce friction. Reliefs 21700 can be adapted to allow back face 21800 of strike plate 21000 to fully seat in mortised pocket (not illustrated) in door frame (not illustrated). Although four screw holes are illustrated for strike plate 21000, one skilled in the art will recognize that fewer or more screw holes can be provided (e.g., two or six screw holes).

Figure 22:
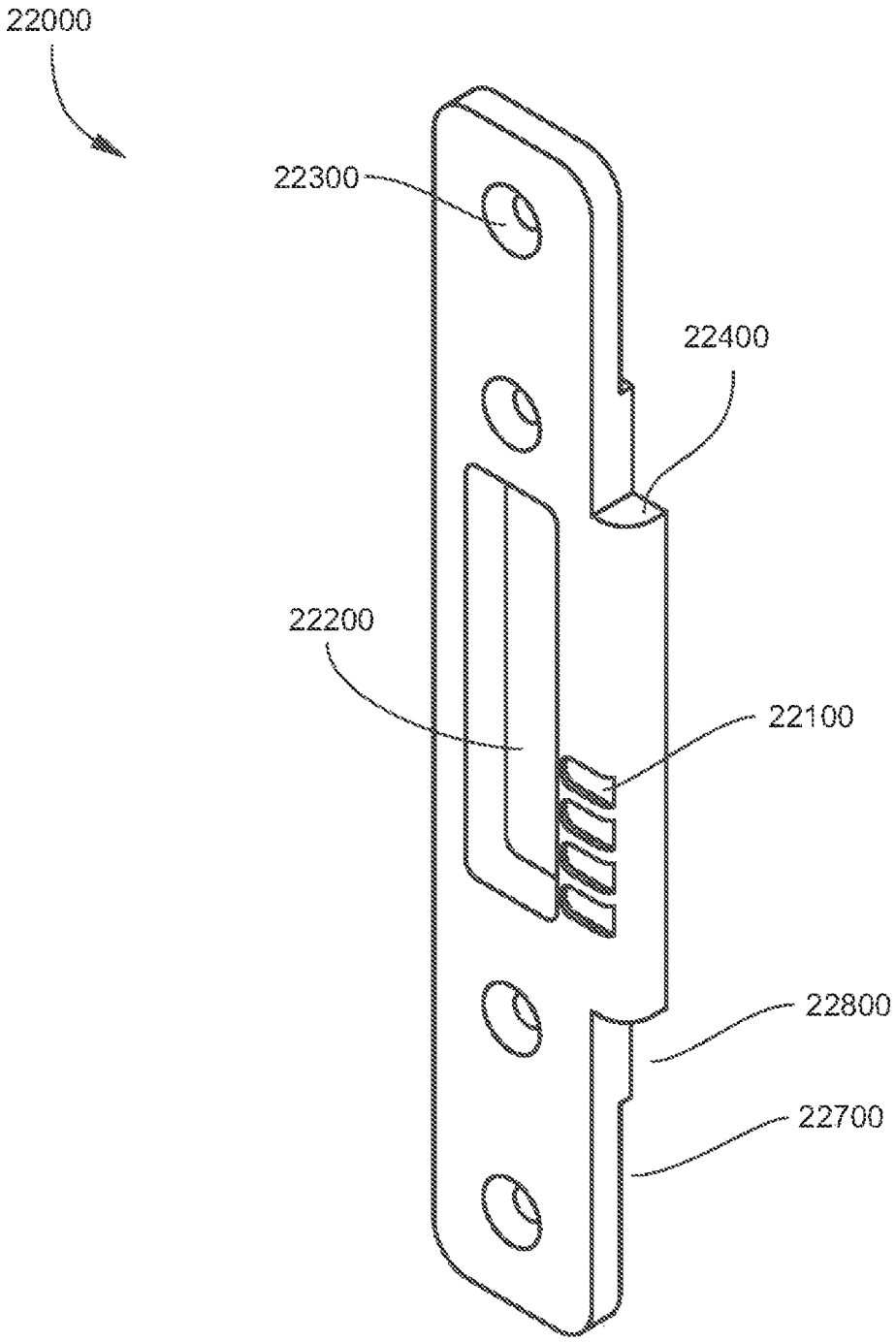
FIG. 22 is a perspective view of an exemplary embodiment of a strike plate 22000.

FIG. 22 is a perspective view of an exemplary embodiment of a strike plate 22000, which can comprise a lip 22400. Strike plate 22000 can define grooves 22100 (in part defined by lip 22400), a cutout 22200, a plurality of reliefs 22700, and screw holes 22300. A latitudinal centerline of grooves 22100 can be offset relative to a latitudinal centerline of cutout 22200, as illustrated. A latitudinal centerline of cutout 22200 can be offset from a latitudinal centerline of strike plate 22000 as illustrated. Grooves 22100 can be adapted to reduce friction between a door hardware bolt and strike plate 22000 when a door is closing. Although four grooves are illustrated in this embodiment and a defined count of grooves are illustrated in other embodiments, any number of grooves can be used to reduce friction, including a set of grooves that extends along approximately a full length of cutout 22200. Reliefs 22700 can be adapted to allow back face 22800 of strike plate 22000 to fully seat in mortised pocket (not illustrated) in door frame (not illustrated). Although four screw holes are illustrated for strike plate 22000, one skilled in the art will recognize that fewer or more screw holes can be provided (e.g., two or six screw holes).

Figure 23:
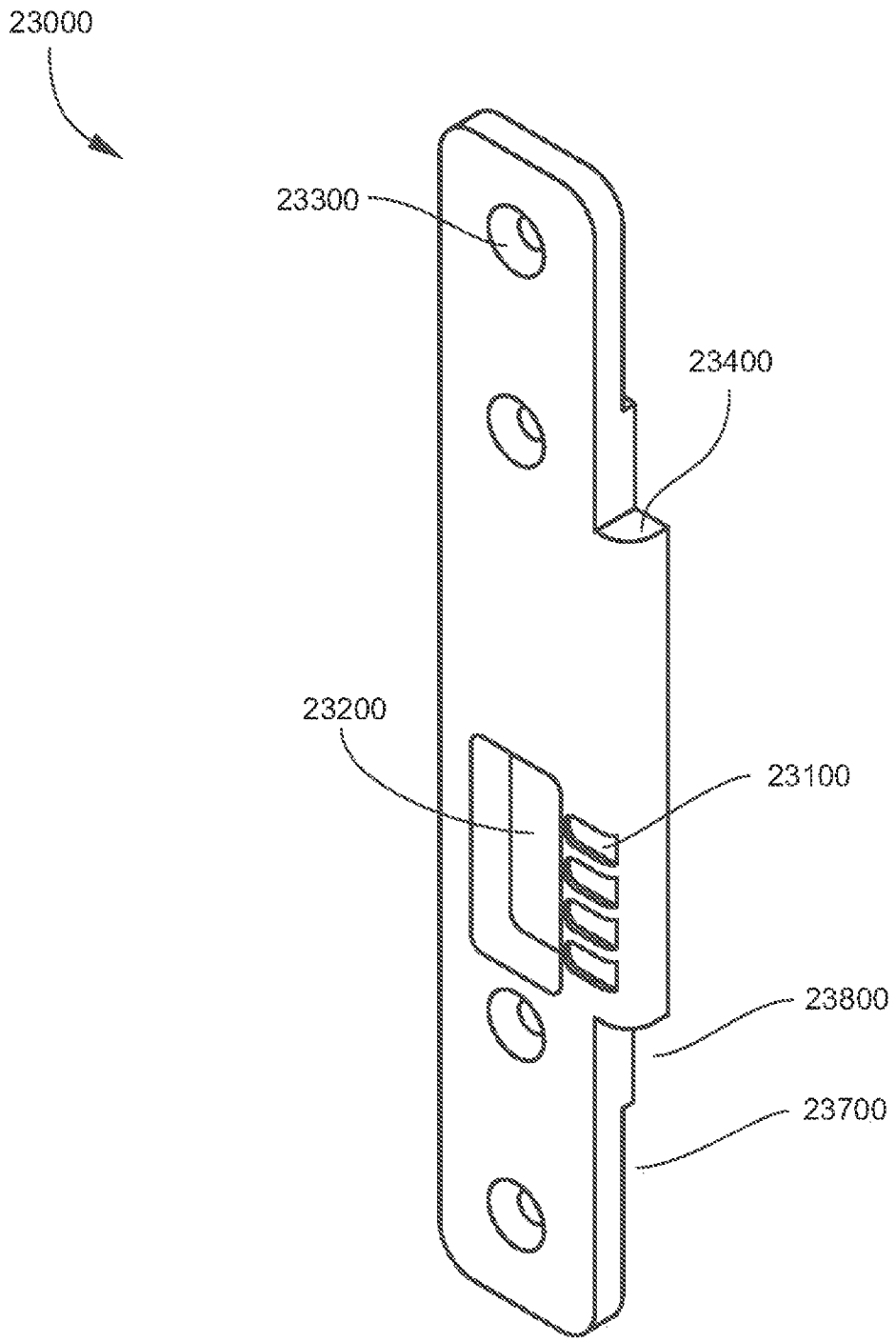
FIG. 23 is a perspective view of an exemplary embodiment of a strike plate 23000.

FIG. 23 is a perspective view of an exemplary embodiment of a strike plate 23000, which can comprise a lip 23400. Strike plate 23000 can define grooves 23100 (in part defined by lip 23400), a cutout 23200, a plurality of reliefs 23700, and screw holes 23300. A latitudinal centerline of grooves 23100 can be approximately aligned with a latitudinal centerline of cutout 23200, as illustrated. A latitudinal centerline of cutout 23200 can be offset from a latitudinal centerline of strike plate 23000 as illustrated. Grooves 23100 can be adapted to reduce friction between a door hardware bolt and strike plate 23000 when a door is closing. Although four grooves are illustrated in this embodiment and a defined count of grooves are illustrated in other embodiments, any number of grooves can be used to reduce friction. Reliefs 23700 can be adapted to allow back face 23800 of strike plate 23000 to fully seat in mortised pocket (not illustrated) in door frame (not illustrated). Although four screw holes are illustrated for strike plate 23000, one skilled in the art will recognize that fewer or more screw holes can be provided (e.g., two or six screw holes).

Figure 24:
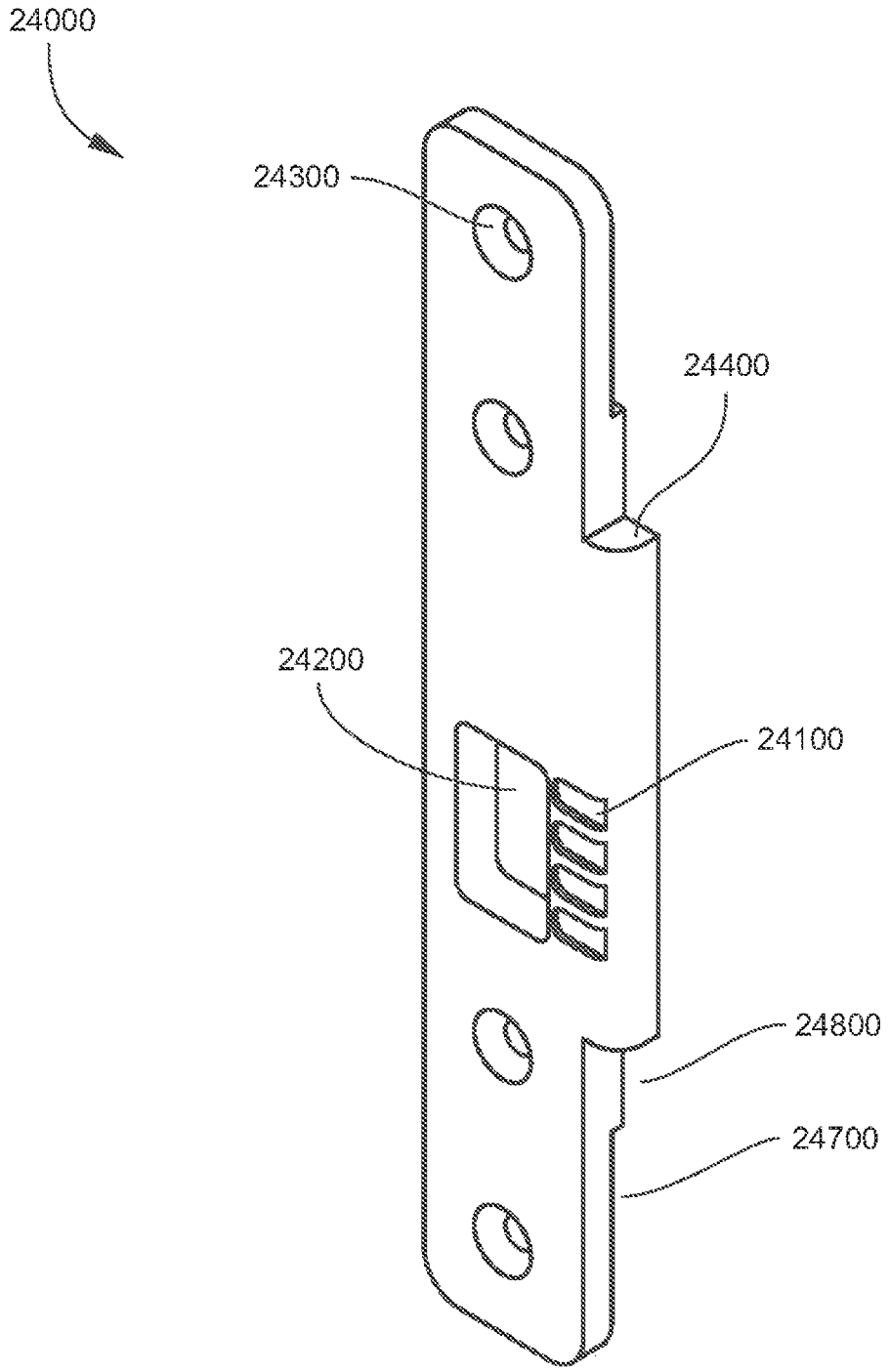
FIG. 24 is a perspective view of an exemplary embodiment of a strike plate 24000.

FIG. 24 is a perspective view of an exemplary embodiment of a strike plate 24000, which can comprise a lip 24400. Strike plate 24000 can define grooves 24100 (in part defined by lip 24400), a cutout 24200, a plurality of reliefs 24800, and screw holes 24300. A latitudinal centerline of grooves 24100 can be approximately aligned with a latitudinal centerline of cutout 24200, as illustrated. A latitudinal centerline of cutout 24200 can be offset from a latitudinal centerline of strike plate 24000 as illustrated. Grooves 24100 can be adapted to reduce friction between a door hardware bolt and strike plate 24000 when a door is closing. Although four grooves are illustrated in this embodiment and a defined count of grooves are illustrated in other embodiments, any number of grooves can be used to reduce friction. Reliefs 24700 can be adapted to allow back face 24800 of strike plate 24000 to fully seat in mortised pocket (not illustrated) in door frame (not illustrated). Although four screw holes are illustrated for strike plate 24000, one skilled in the art will recognize that fewer or more screw holes can be provided (e.g., two or six screw holes).

Figure 25:
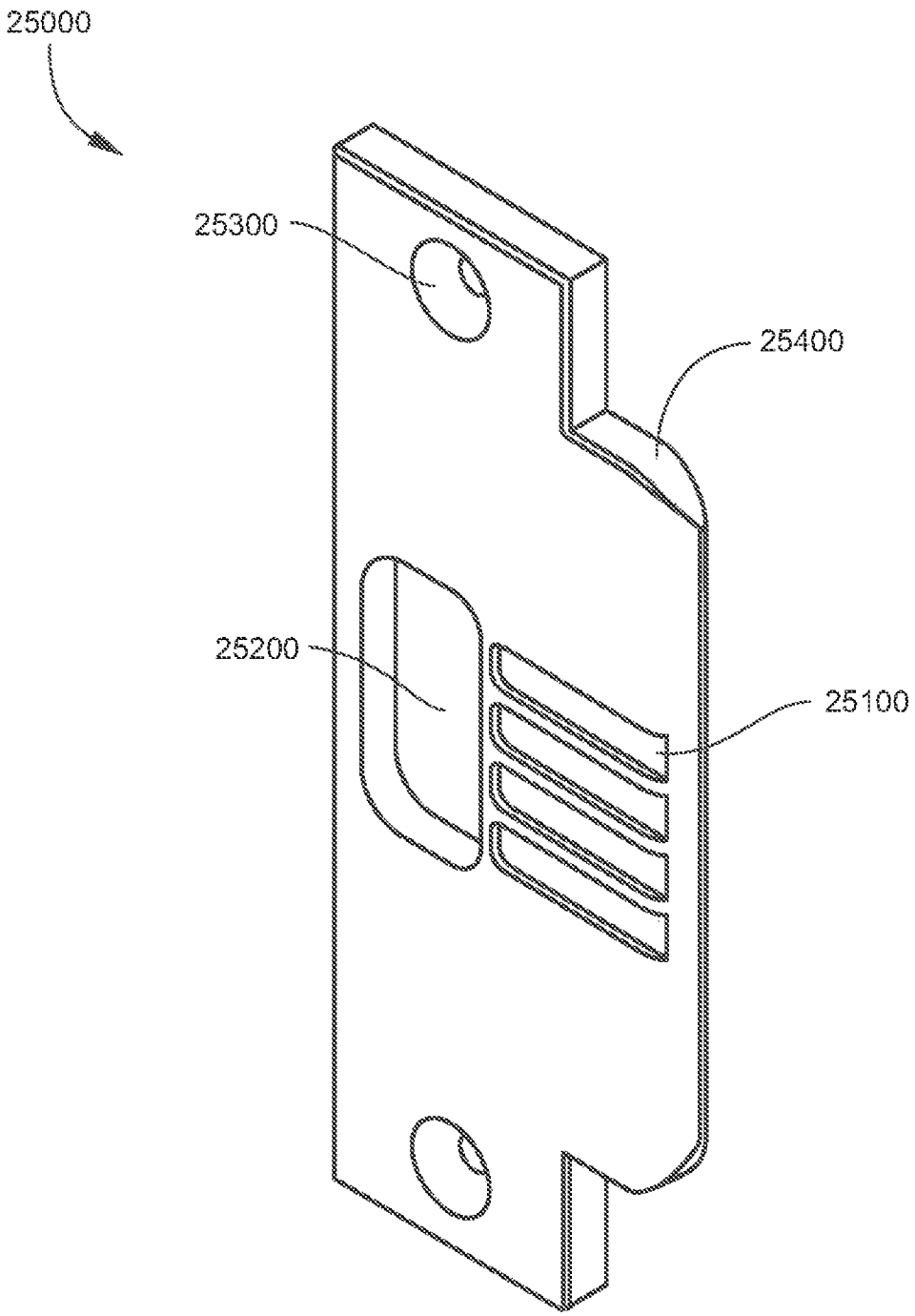
FIG. 25 is a perspective view of an exemplary embodiment of a strike plate 25000.

FIG. 25 is a perspective view of an exemplary embodiment of a strike plate 25000, which can comprise a lip 25400. Strike plate 25000 can define grooves 25100 (in part defined by lip 25400), a cutout 25200, and screw holes 25300. A latitudinal centerline of grooves 25100 can be approximately aligned with a latitudinal centerline of cutout 25200, as illustrated. A latitudinal centerline of cutout 25200 can be approximately aligned with a latitudinal centerline of strike plate 25000 as illustrated. Grooves 25100 can be adapted to reduce friction between a door hardware bolt and strike plate 25000 when a door is closing. Although four grooves are illustrated in this embodiment and a defined count of grooves are illustrated in other embodiments, any number of grooves can be used to reduce friction.

Figure 26:
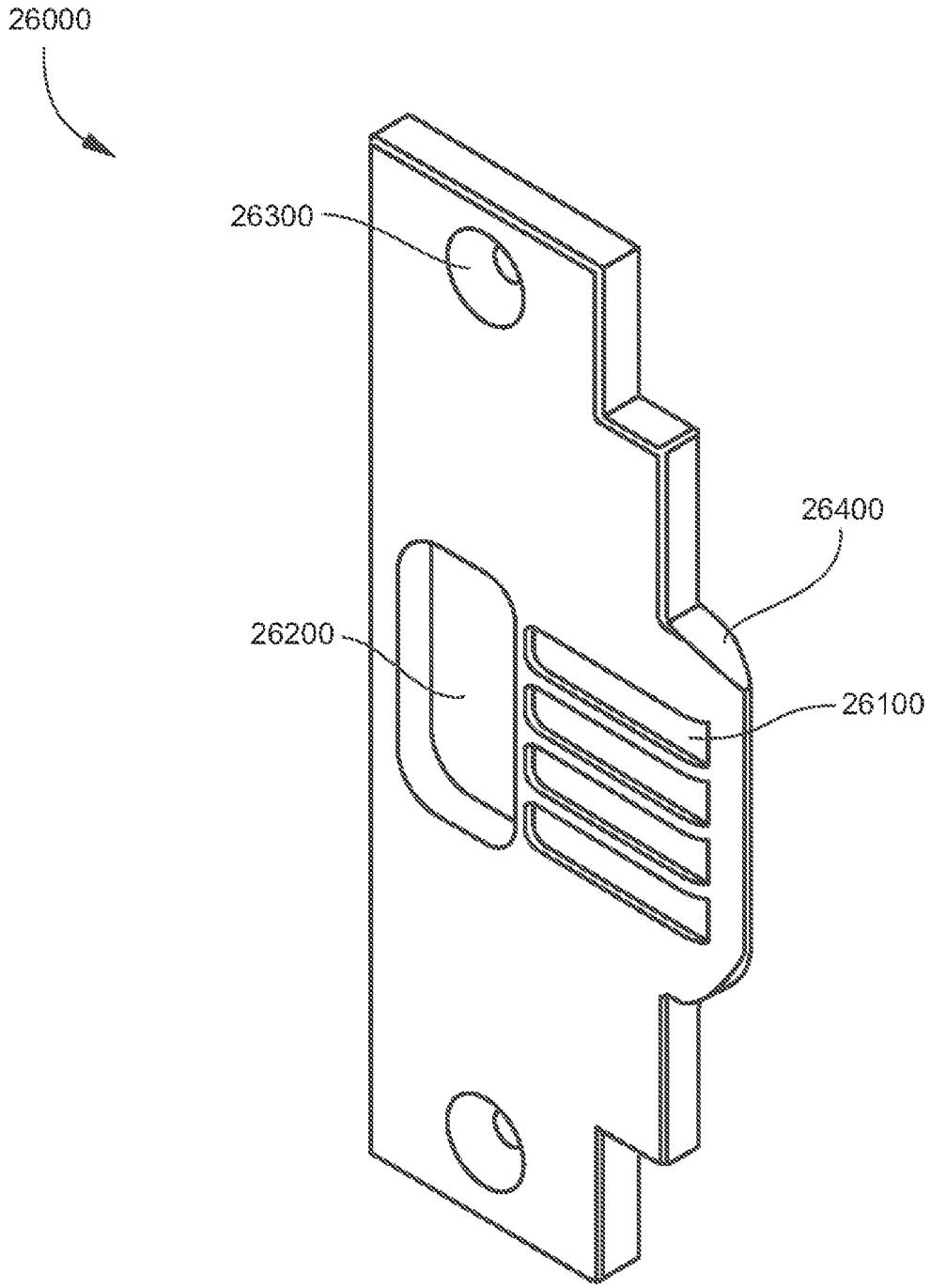
FIG. 26 is a perspective view of an exemplary embodiment of a strike plate 26000.

FIG. 26 is a perspective view of an exemplary embodiment of a strike plate 26000, which can comprise a lip 26400. Strike plate 26000 can define grooves 26100 (in part defined by lip 26400), a cutout 26200, and screw holes 26300. A latitudinal centerline of grooves 26100 can be approximately aligned with a latitudinal centerline of cutout 26200, as illustrated. A latitudinal centerline of cutout 26200 can be approximately aligned with a latitudinal centerline of strike plate 26000 as illustrated. Grooves 26100 can be adapted to reduce friction between a door hardware bolt and strike plate 26000 when a door is closing. Although four grooves are illustrated in this embodiment and a defined count of grooves are illustrated in other embodiments, any number of grooves can be used to reduce friction.

Figure 27:
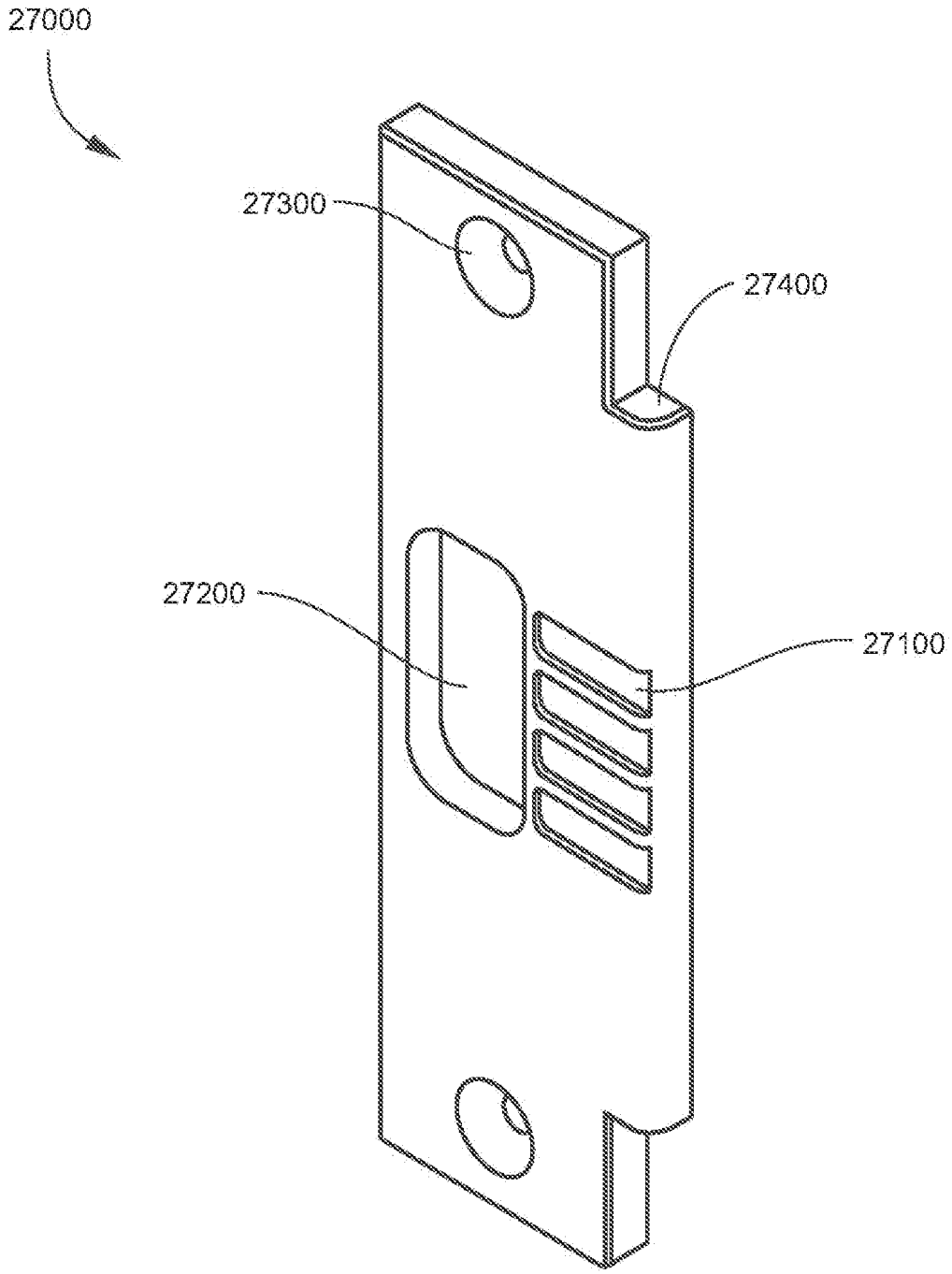
FIG. 27 is a perspective view of an exemplary embodiment of a strike plate 27000.

FIG. 27 is a perspective view of an exemplary embodiment of a strike plate 27000, which can comprise a lip 27400. Strike plate 27000 can define grooves 27100 (in part defined by lip 27400), a cutout 27200, and screw holes 27300. A latitudinal centerline of grooves 27100 can be approximately aligned with a latitudinal centerline of cutout 27200, as illustrated. A latitudinal centerline of cutout 27200 can be approximately aligned with a latitudinal centerline of strike plate 27000 as illustrated. Grooves 27100 can be adapted to reduce friction between a door hardware bolt and strike plate 27000 when a door is closing. Although four grooves are illustrated in this embodiment and a defined count of grooves are illustrated in other embodiments, any number of grooves can be used to reduce friction.

Figure 28:
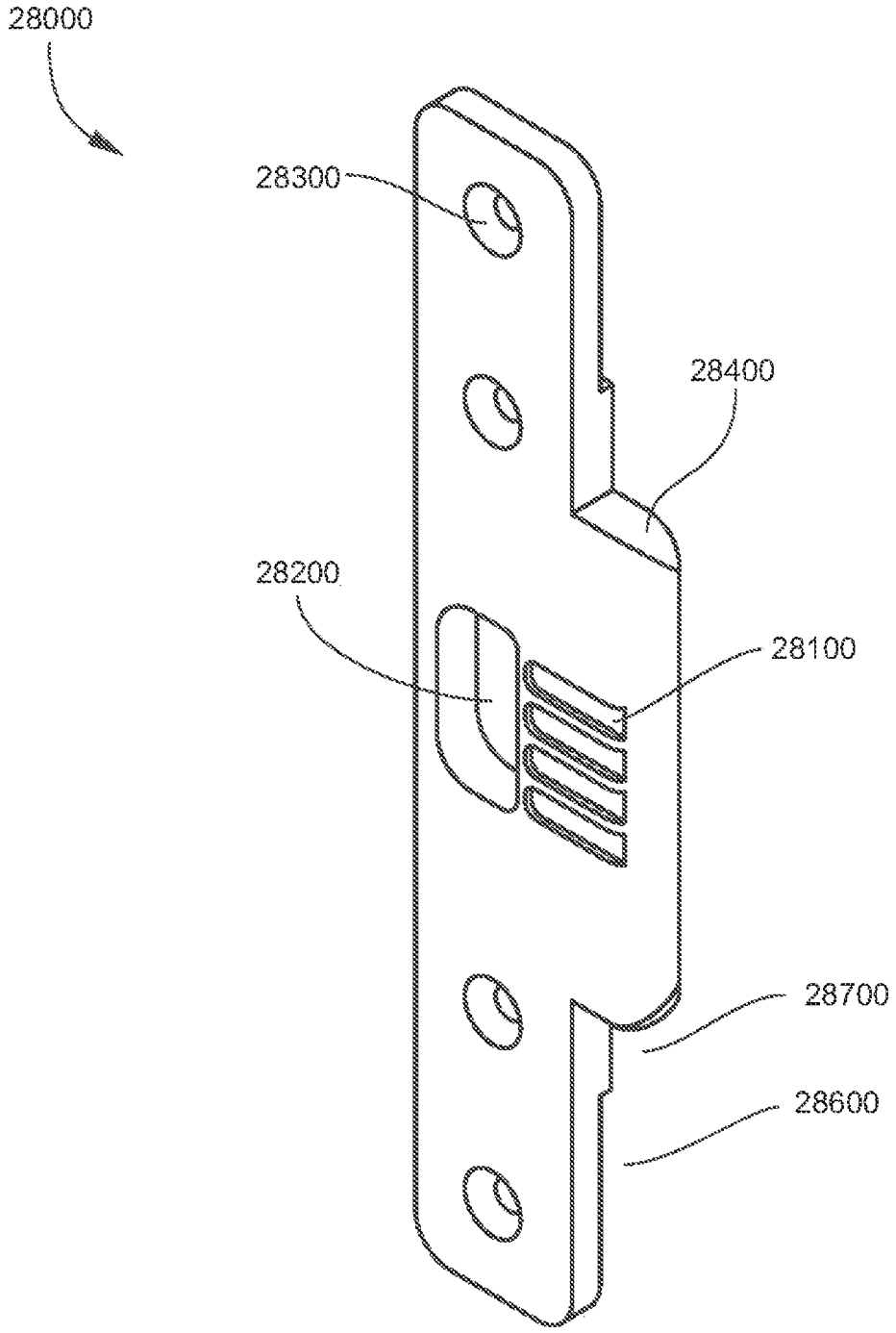
FIG. 28 is a perspective view of an exemplary embodiment of a strike plate 28000.

FIG. 28 is a perspective view of an exemplary embodiment of a strike plate 28000, which can comprise a lip 28400. Strike plate 28000 can define grooves 28100 (in part defined by lip 28400), a cutout 28200, a plurality of reliefs 28600, and screw holes 28300. A latitudinal centerline of grooves 28100 can be approximately aligned with a latitudinal centerline of cutout 28200, as illustrated. A latitudinal centerline of cutout 28200 can be approximately aligned with a latitudinal centerline of strike plate 28000 as illustrated. Grooves 28100 can be adapted to reduce friction between a door hardware bolt and strike plate 28000 when a door is closing. Although four grooves are illustrated in this embodiment and a defined count of grooves are illustrated in other embodiments, any number of grooves can be used to reduce friction. Reliefs 28600 can be adapted to allow back face 28700 of strike plate 28000 to fully seat in mortised pocket (not illustrated) in door frame (not illustrated). Although four screw holes are illustrated for strike plate 28000, one skilled in the art will recognize that fewer or more screw holes can be provided (e.g., two or six screw holes).

Figure 29:
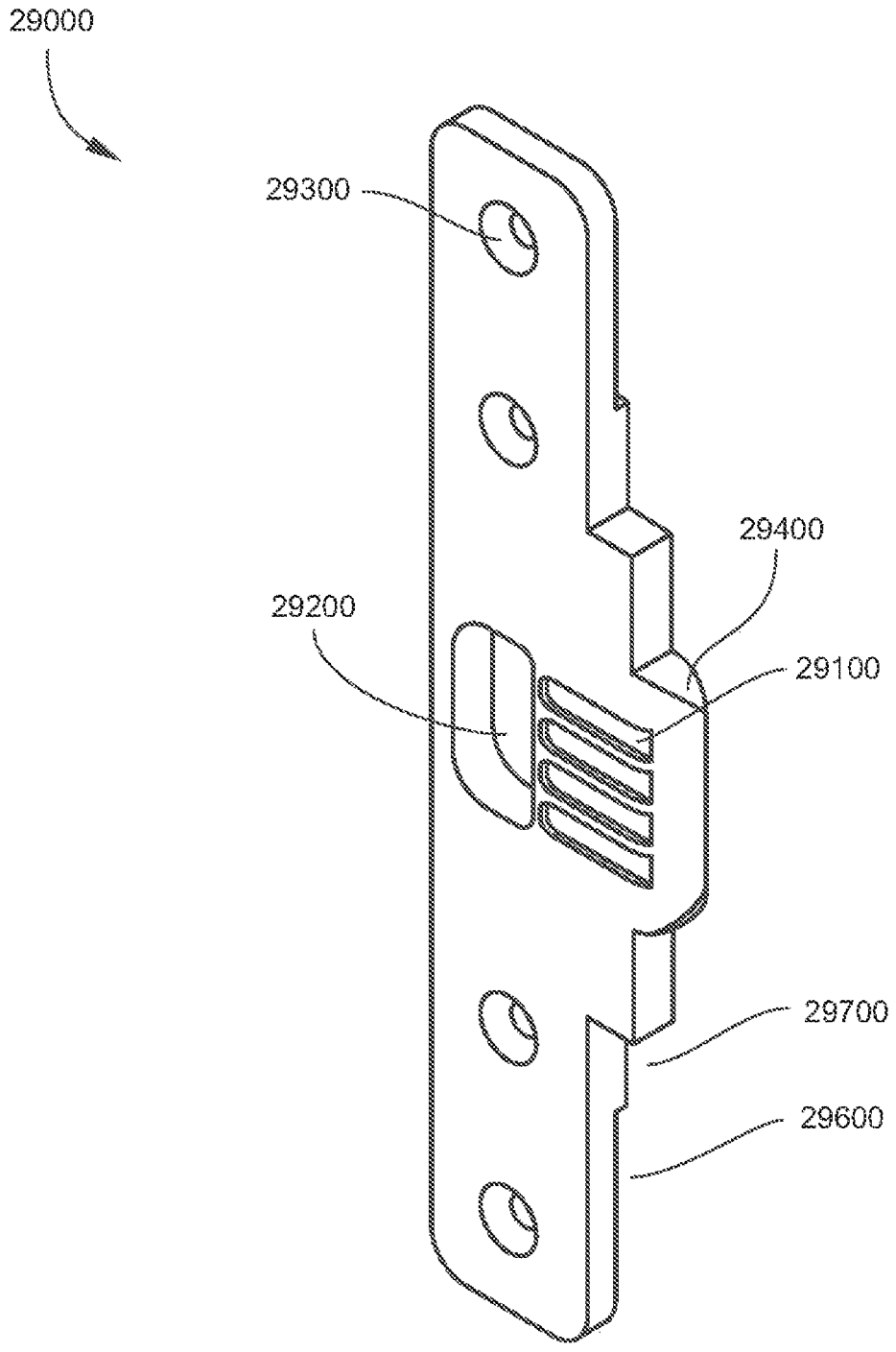
FIG. 29 is a perspective view of an exemplary embodiment of a strike plate 29000.

FIG. 29 is a perspective view of an exemplary embodiment of a strike plate 29000, which can comprise a lip 29400. Strike plate 29000 can define grooves 29100 (in part defined by lip 29400), a cutout 29200, a plurality of reliefs 29600, and screw holes 29300. A latitudinal centerline of grooves 29100 can be approximately aligned with a latitudinal centerline of cutout 29200, as illustrated. A latitudinal centerline of cutout 29200 can be approximately aligned with a latitudinal centerline of strike plate 29000 as illustrated. Grooves 29100 can be adapted to reduce friction between a door hardware bolt and strike plate 29000 when a door is closing. Although four grooves are illustrated in this embodiment and a defined count of grooves are illustrated in other embodiments, any number of grooves can be used to reduce friction. Reliefs 29600 can be adapted to allow back face 29700 of strike plate 29000 to fully seat in mortised pocket (not illustrated) in door frame (not illustrated). Although four screw holes are illustrated for strike plate 29000, one skilled in the art will recognize that fewer or more screw holes can be provided (e.g., two or six screw holes).

Figure 30:
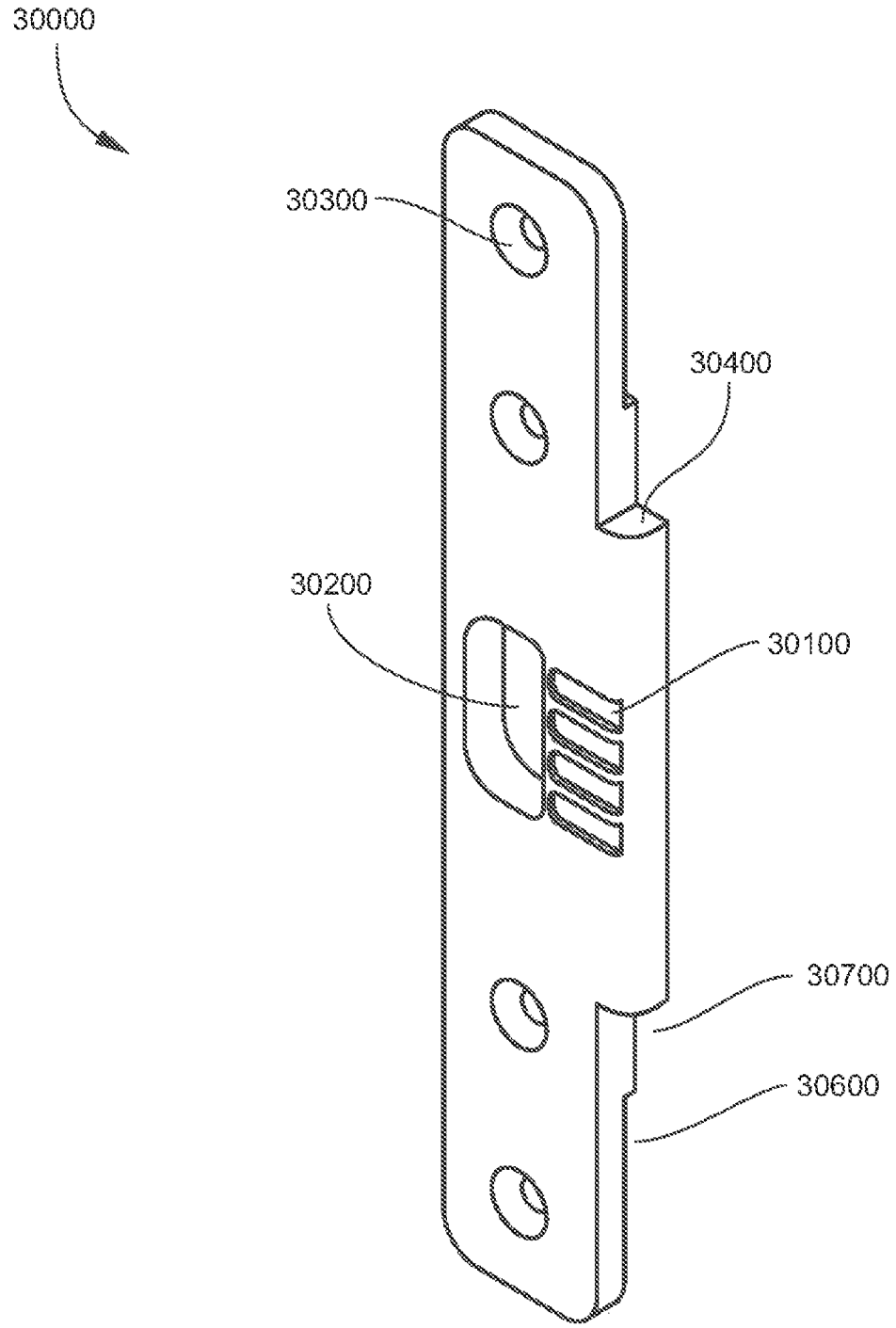
FIG. 30 is a perspective view of an exemplary embodiment of a strike plate 30000.

FIG. 30 is a perspective view of an exemplary embodiment of a strike plate 30000, which can comprise a lip 30400. Strike plate 30000 can define grooves 30100 (in part defined by lip 30400), a cutout 30200, a plurality of reliefs 30600, and screw holes 30300. A latitudinal centerline of grooves 30100 can be approximately aligned with a latitudinal centerline of cutout 30200, as illustrated. A latitudinal centerline of cutout 30200 can be approximately aligned with a latitudinal centerline of strike plate 30000 as illustrated. Grooves 30100 can be adapted to reduce friction between a door hardware bolt and strike plate 30000 when a door is closing. Although four grooves are illustrated in this embodiment and a defined count of grooves are illustrated in other embodiments, any number of grooves can be used to reduce friction. Reliefs 30600 can be adapted to allow back face 30700 of strike plate 30000 to fully seat in mortised pocket (not illustrated) in door frame (not illustrated). Although four screw holes are illustrated for strike plate 30000, one skilled in the art will recognize that fewer or more screw holes can be provided (e.g., two or six screw holes).

Figure 31:
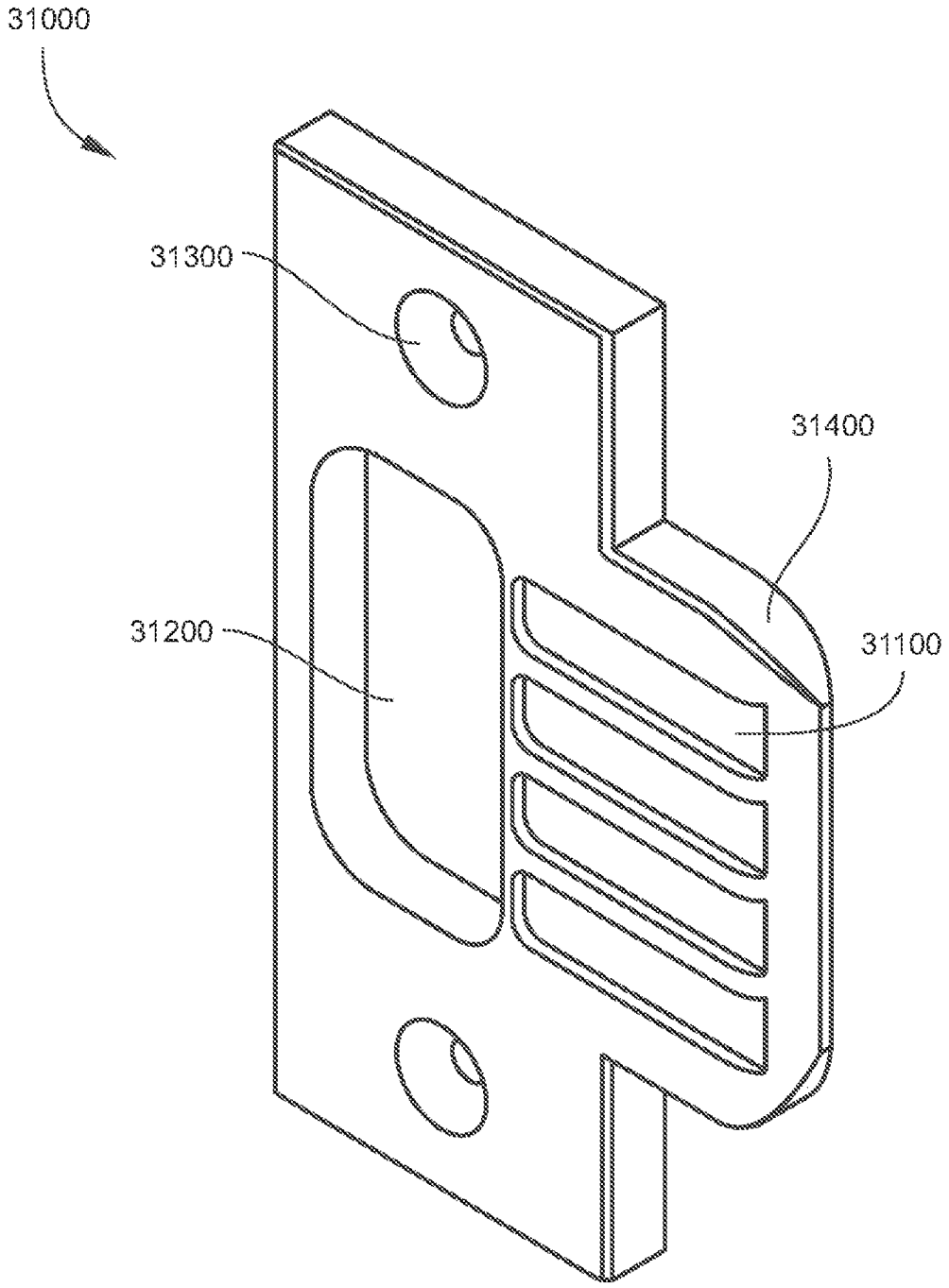
FIG. 31 is a perspective view of an exemplary embodiment of a strike plate 31000.

FIG. 31 is a perspective view of an exemplary embodiment of a strike plate 31000, which can comprise a lip 31400. Strike plate 31000 can define grooves 31100 (in part defined by lip 31400), a cutout 31200, and screw holes 31300. A latitudinal centerline of grooves 31100 can be approximately aligned with a latitudinal centerline of cutout 31200, as illustrated. A latitudinal centerline of cutout 31200 can be approximately aligned with a latitudinal centerline of strike plate 31000 as illustrated. Grooves 31100 can be adapted to reduce friction between a door hardware bolt and strike plate 31000 when a door is closing. Although four grooves are illustrated in this embodiment and a defined count of grooves are illustrated in other embodiments, any number of grooves can be used to reduce friction.

Figure 32:
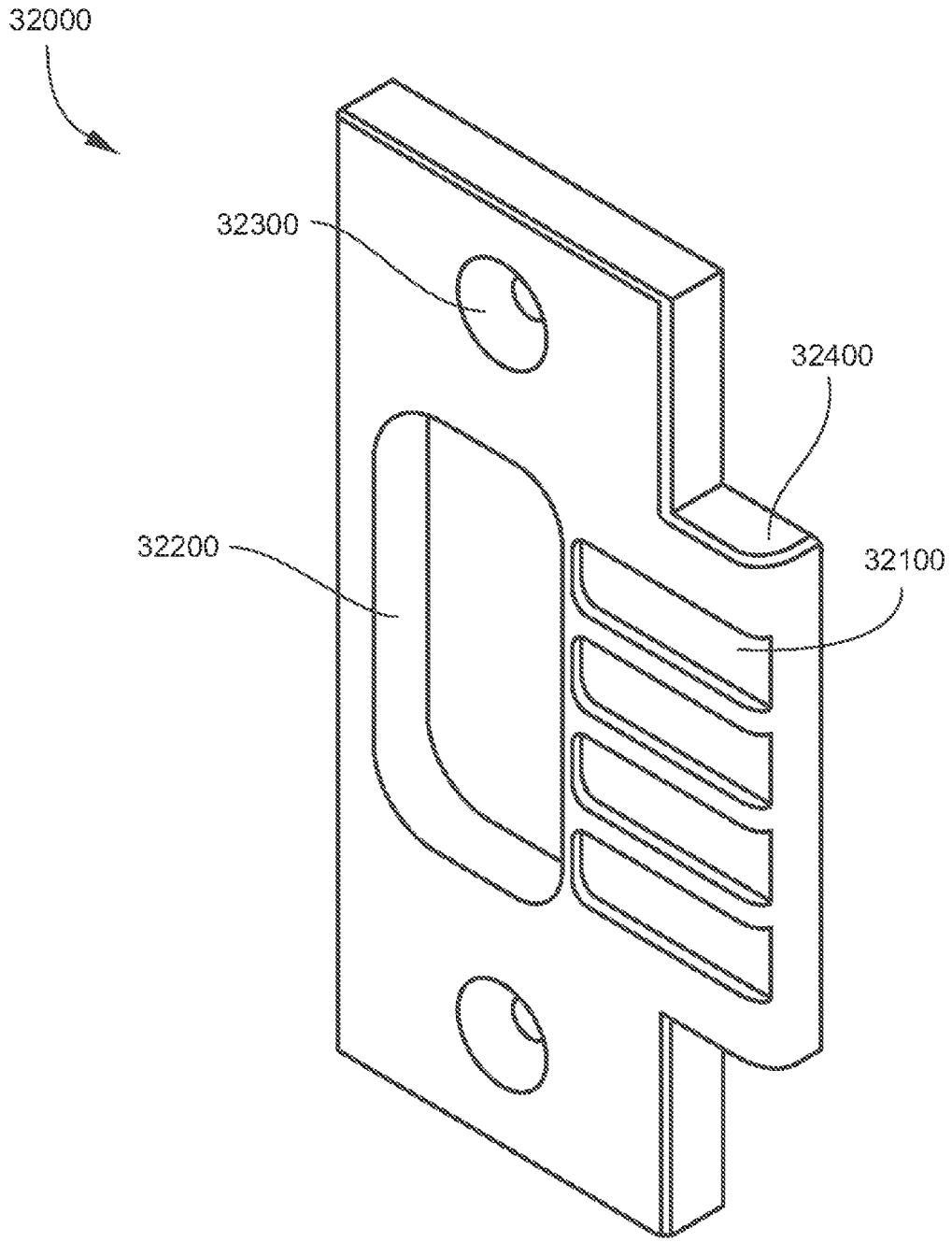
FIG. 32 is a perspective view of an exemplary embodiment of a strike plate 32000.

FIG. 32 is a perspective view of an exemplary embodiment of a strike plate 32000, which can comprise a lip 32400. Strike plate 32000 can define grooves 32100 (in part defined by lip 32400), a cutout 32200, and screw holes 32300. A latitudinal centerline of grooves 32100 can be approximately aligned with a latitudinal centerline of cutout 32200, as illustrated. A latitudinal centerline of cutout 32200 can be approximately aligned with a latitudinal centerline of strike plate 32000 as illustrated. Grooves 32100 can be adapted to reduce friction between a door hardware bolt and strike plate 32000 when a door is closing. Although four grooves are illustrated in this embodiment and a defined count of grooves are illustrated in other embodiments, any number of grooves can be used to reduce friction.

Figure 33:
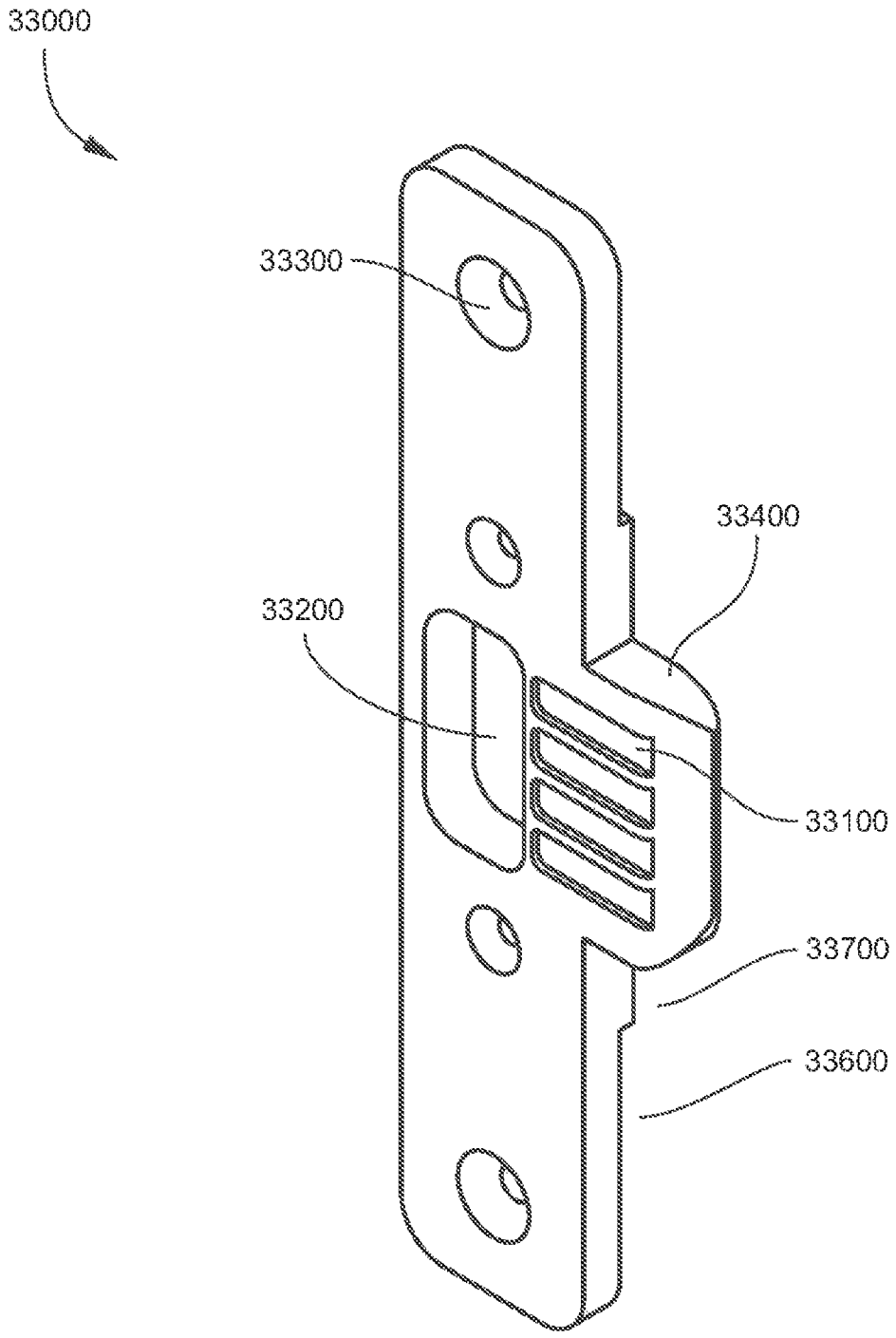
FIG. 33 is a perspective view of an exemplary embodiment of a strike plate 33000.

FIG. 33 is a perspective view of an exemplary embodiment of a strike plate 33000, which can comprise a lip 33400. Strike plate 33000 can define grooves 33100 (in part defined by lip 33400), a cutout 33200, a plurality of reliefs 33600, and screw holes 33300. A latitudinal centerline of grooves 33100 can be approximately aligned with a latitudinal centerline of cutout 33200, as illustrated. A latitudinal centerline of cutout 33200 can be approximately aligned with a latitudinal centerline of strike plate 33000 as illustrated. Grooves 33100 can be adapted to reduce friction between a door hardware bolt and strike plate 33000 when a door is closing. Although four grooves are illustrated in this embodiment and a defined count of grooves are illustrated in other embodiments, any number of grooves can be used to reduce friction. Reliefs 33600 can be adapted to allow back face 33700 of strike plate 30000 to fully seat in mortised pocket (not illustrated) in door frame (not illustrated). Although four screw holes are illustrated for strike plate 33000, one skilled in the art will recognize that fewer or more screw holes can be provided (e.g., two or six screw holes).

Figure 34:
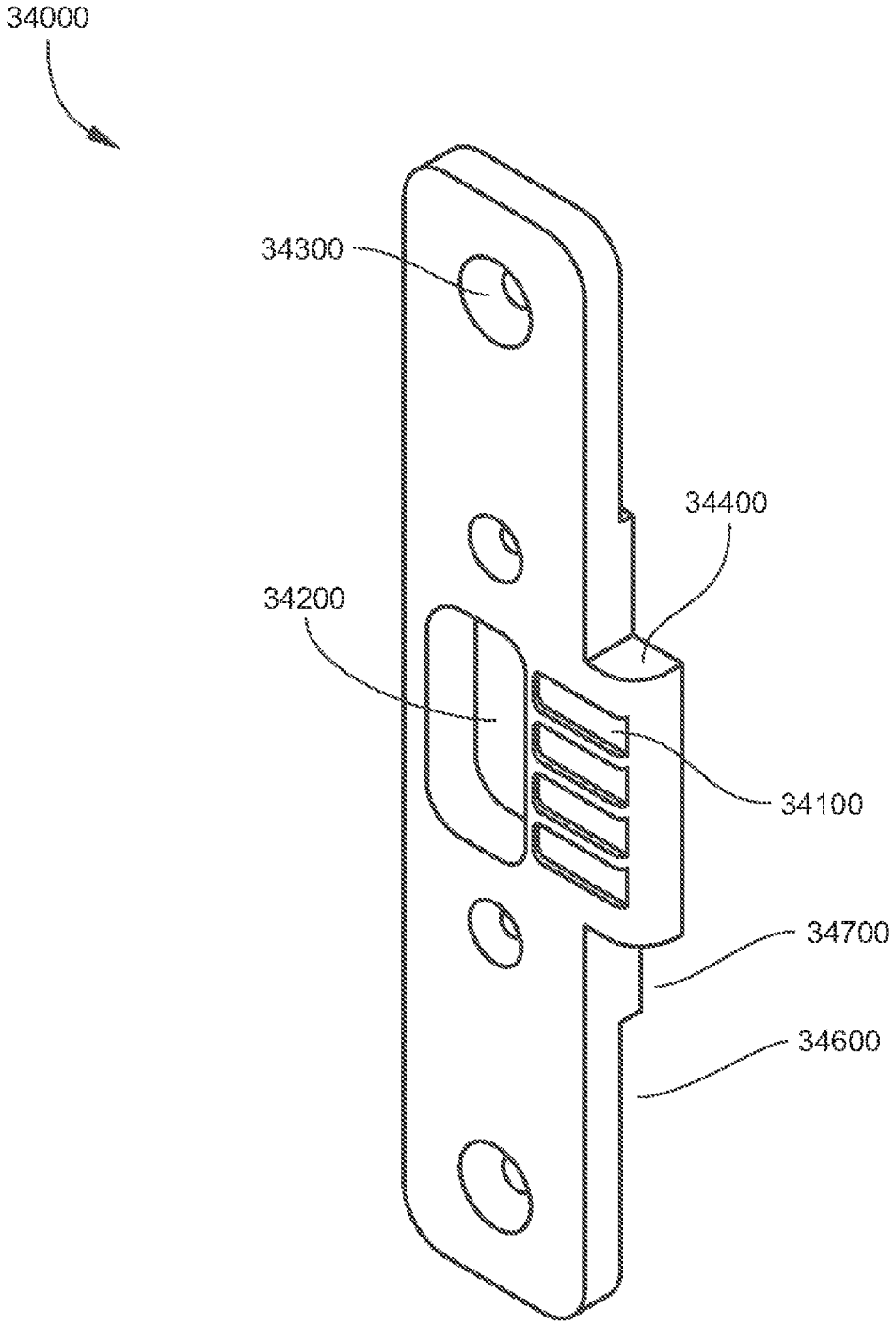
FIG. 34 is a perspective view of an exemplary embodiment of a strike plate 34000.

FIG. 34 is a perspective view of an exemplary embodiment of a strike plate 34000, which can comprise a lip 34400. Strike plate 34000 can define grooves 34100 (in part defined by lip 34400), a cutout 34200, a plurality of reliefs 34600, and screw holes 34300. A latitudinal centerline of grooves 34100 can be approximately aligned with a latitudinal centerline of cutout 34200, as illustrated. A latitudinal centerline of cutout 34200 can be approximately aligned with a latitudinal centerline of strike plate 34000 as illustrated. Grooves 34100 can be adapted to reduce friction between a door hardware bolt and strike plate 34000 when a door is closing. Although four grooves are illustrated in this embodiment and a defined count of grooves are illustrated in other embodiments, any number of grooves can be used to reduce friction. Reliefs 34600 can be adapted to allow back face 34700 of strike plate 34000 to fully seat in mortised pocket (not illustrated) in door frame (not illustrated). Although four screw holes are illustrated for strike plate 34000, one skilled in the art will recognize that fewer or more screw holes can be provided (e.g., two or six screw holes).

Figure 35:
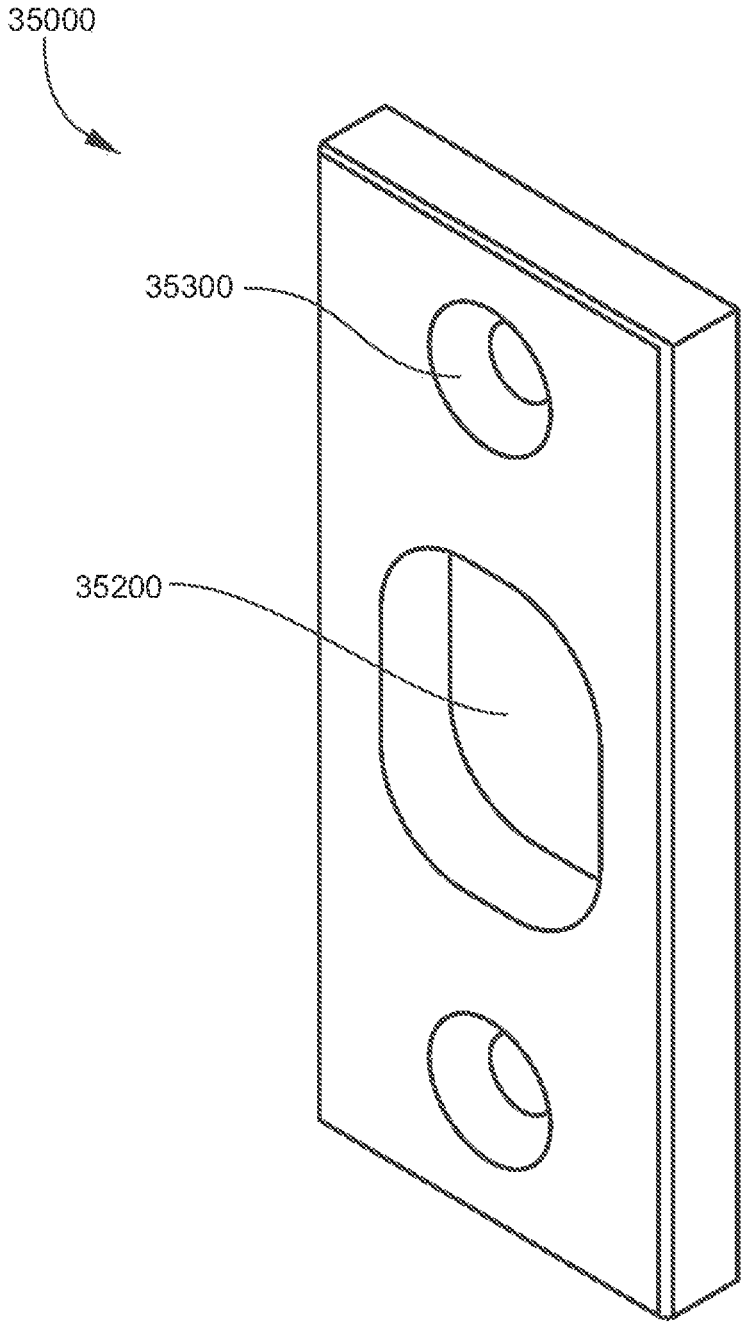
FIG. 35 is a perspective view of an exemplary embodiment of a strike plate 35000.

FIG. 35 is a perspective view of an exemplary embodiment of a strike plate 35000, which can define a cutout 35200 and screw holes 35300. A latitudinal centerline of cutout 35200 can be approximately aligned with a latitudinal centerline of strike plate 35000 as illustrated.

Figure 36:
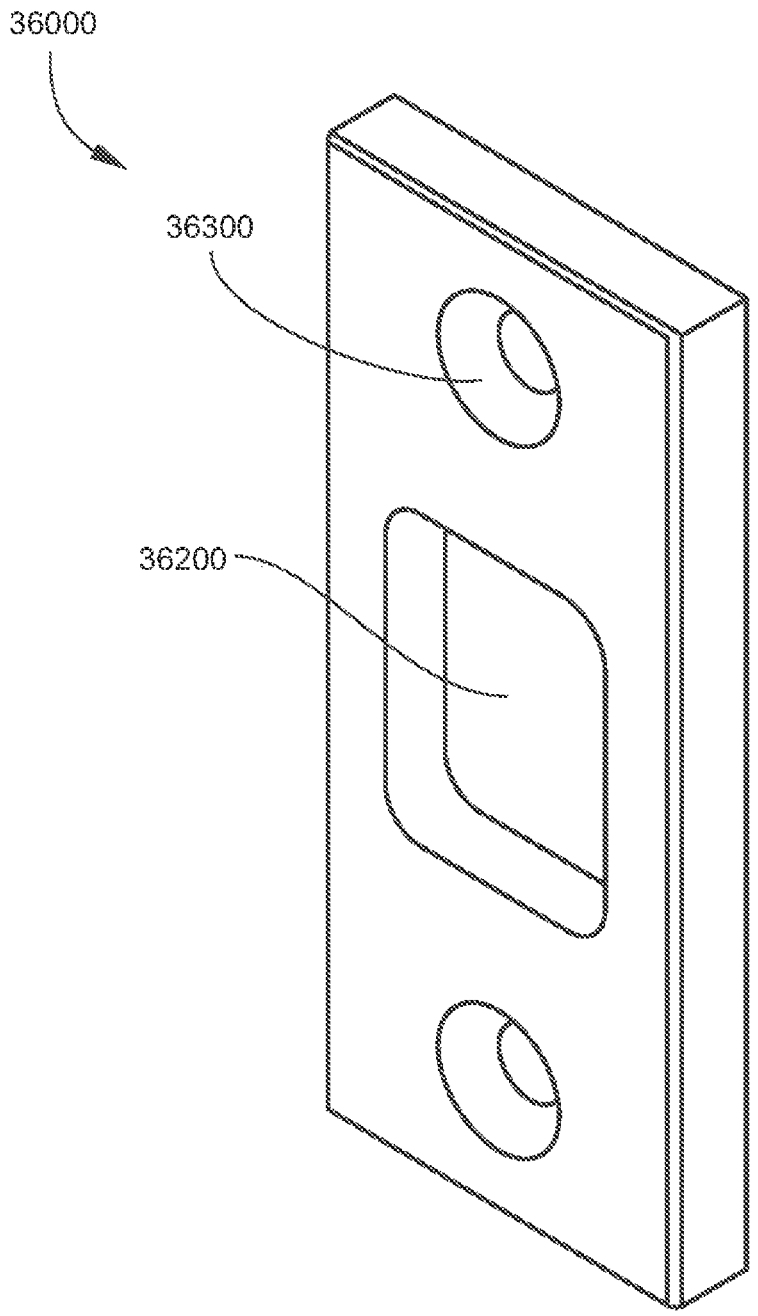
FIG. 36 is a perspective view of an exemplary embodiment of a strike plate 36000.

FIG. 36 is a perspective view of an exemplary embodiment of a strike plate 36000, which can define a cutout 36200 and screw holes 36300. A latitudinal centerline of cutout 36200 can be approximately aligned with a latitudinal centerline of strike plate 36000 as illustrated.

Figure 37:
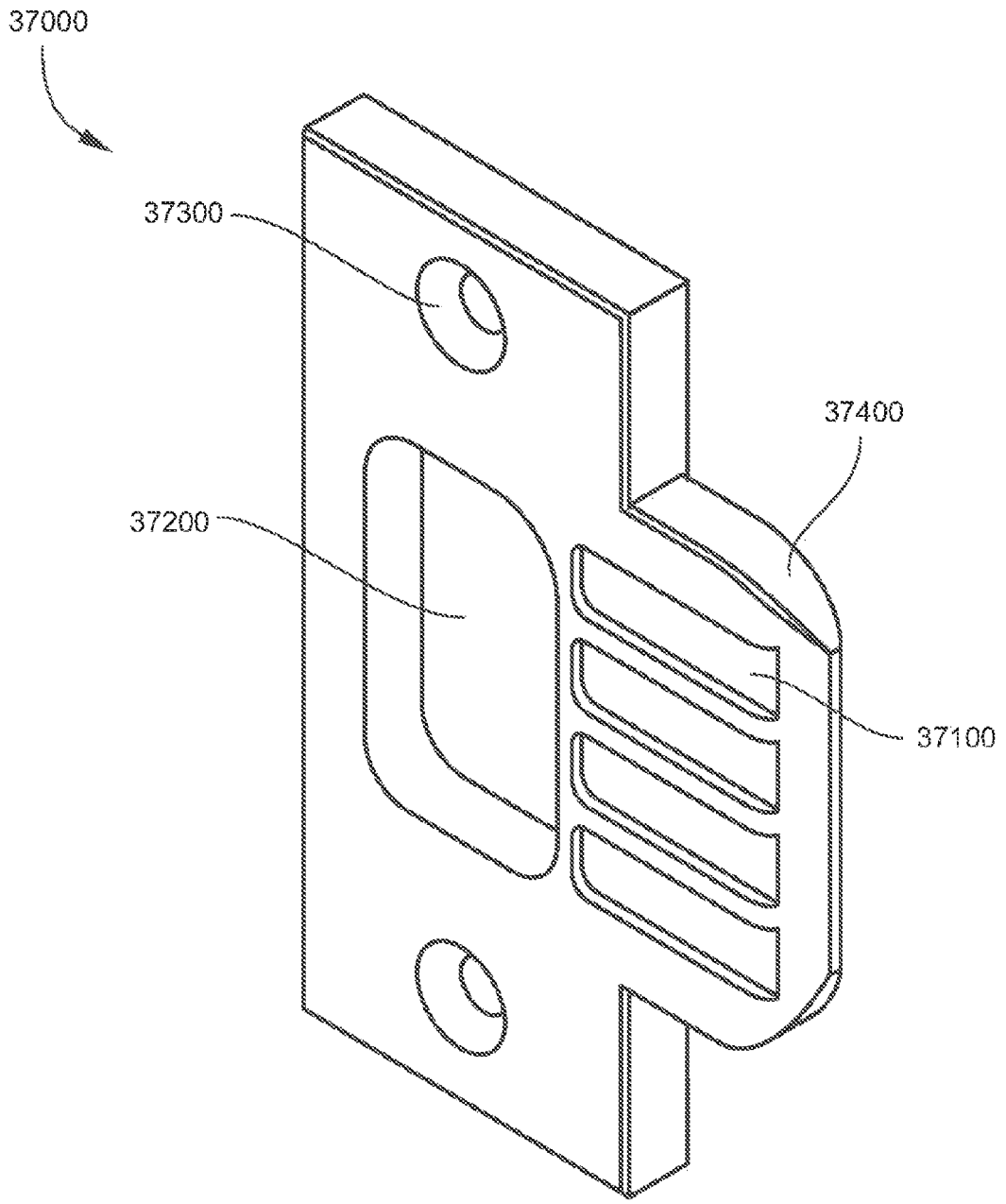
FIG. 37 is a perspective view of an exemplary embodiment of a strike plate 37000.

FIG. 37 is a perspective view of an exemplary embodiment of a strike plate 37000, which can comprise a lip 37400. Strike plate 37000 can define grooves 37100 (in part defined by lip 37400), a cutout 37200, and screw holes 37300. A latitudinal centerline of grooves 37100 can be approximately aligned with a latitudinal centerline of cutout 37200, as illustrated. A latitudinal centerline of cutout 37200 can be approximately aligned with a latitudinal centerline of strike plate 37000 as illustrated. Grooves 37100 can be adapted to reduce friction between a door hardware bolt and strike plate 37000 when a door is closing. Although four grooves are illustrated in this embodiment and a defined count of grooves are illustrated in other embodiments, any number of grooves can be used to reduce friction.

Figure 38:
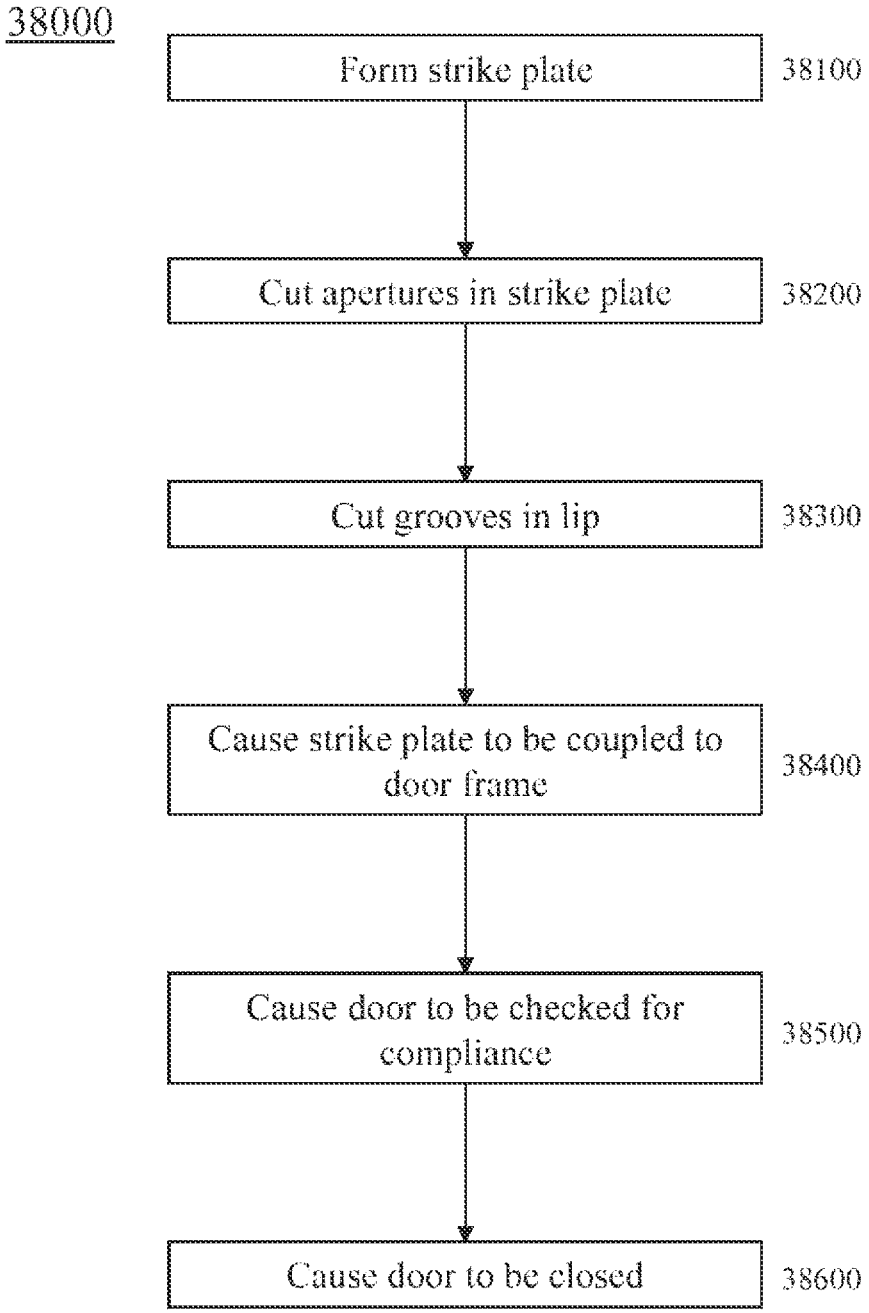
FIG. 38 is a flowchart of an exemplary embodiment of a method 38000.

FIG. 38 is a flowchart of an exemplary embodiment of a method 38000. At activity 38100, a strike plate can be formed. For example, the strike plate can be cut and/or machined out of Type 303 stainless steel. At activity 38200, apertures can be cut in the strike plate. The strike plate can be cast, machined, and/or drilled such that the strike plate defines a plurality of apertures, which can comprise a cutout adapted to receive a door hardware bolt and two or more screw holes. At activity 38300, grooves can be cut in a lip of the strike plate. At activity 38400, the strike plate can be caused to be coupled to a door frame. At activity 38500, the door frame can be caused to be checked for compliance with one or more specifications and/or standards. At activity 38600, the door can be caused to be closed.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
achieve—meet requirements for.
activity—an action, act, step, and/or process or portion thereof.
across—from one side to another.
adapted to—made suitable or fit for a specific use or situation.
adapter—a device used to effect operative compatibility between different parts of one or more pieces of an apparatus or system.
and/or—either in conjunction with or in alternative to.
apparatus—an appliance or device for a particular purpose.
approximate—near or approaching.
associate—to join, connect together, and/or relate.
auxiliary deadlatch function—a mechanical function that is activated when the guard bolt is depressed by the strike plate as the door closes, thereby blocking the movement of the projected latch bolt by any means other than operating trim of the lockset or latchset. The function prevents circumventing the security of the lockset or latchset by preventing manipulation of a latch bolt by such methods as an attempted opening via insertion of a credit card (i.e., biding) or other tools.
back face—a surface of a strike plate that, when installed, is in direct contact with a mortised pocket of a door frame.
beyond—further on than.
bottom edge—an edge of a strike plate that is most downward when the strike plate is installed in a mortised pocket of a door frame.
can—is capable of, in at least some embodiments.
cause—to produce an effect.
clearance—a spacing distance between two objects.
close easily—to shut and latch with less difficulty than a level of difficulty associated with shutting and latching when a door hardware bolt moves across an ungrooved strike plate.
comprising—including but not limited to.
configure—to make suitable or fit for a specific use or situation.
connect—to join or fasten together.
contact—to directly touch.
convert—to transform, adapt, and/or change.
couple—to join, connect, and/or link together.
create—to bring into being.
cutout—a strike plate aperture adapted to receive a door hardware bolt.
define—to establish the outline, form, or structure of.
device—a machine, manufacture, and/or collection thereof.
diameter—a straight line distance from side to side of a body, and through the body's center.
dimensional tolerance—a maximum permitted variation in a measurement of an object.
direct contact—touching.
door frame—a structure that partially surrounds a doorway, including two jambs and a lintel, or head.
door hardware bolt—a mechanism coupled to a door that is adapted to engage with a strike plate to keep the door from opening unless an action (e.g., turning a handle or a key) is taken to retract the door hardware bolt from the strike plate.
edge—a border at which a surface terminates.
established standard—a predetermined dimension.
extend—to protrude.
fire rating—a measure of the extent to which a system can withstand a predetermined set of fire resistance test conditions.
fire resistant—substantially unburnable under a given set of conditions.
friction—surface resistance to relative motion of one body against another.
front face—a surface of a strike plate that is an opposing surface to its back face.
groove—a channel or furrow in a surface.
industry standard—an established norm or requirement in regard to door systems.
install—to connect or set in position and prepare for use.
latch—to close or fasten via a bolt sliding into a cutout in a door frame.
left side edge—an edge of a strike plate that is leftmost, viewed from the perspective of one in a doorway facing the strike plate, when the strike plate is installed in a mortised pocket on a door.
lip—a projecting edge of a strike plate that extends beyond a mortised pocket on a door.
lock—to secure a door from opening via a system comprising at least one bolt propelled and withdrawn by a mechanism operable by a key.
locking door hardware—components that comprise a locking or latching mechanism coupled to a swinging door.
major diameter—a largest diameter of a threaded portion of a screw.
may—is allowed and/or permitted to, in at least some embodiments.
method—a process, procedure, and/or collection of related activities for accomplishing something.
minimally greater than—only sufficiently large for an object of a predetermined size to pass through, but not substantially larger.

mortised pocket—a recessed portion of a door frame that has been cut so as to receive a strike plate.

move—to traverse from a first location to a second location.

National Fire Protection Association—a United States trade association that creates and maintains private, copyrighted, standards and codes for usage and adoption by local governments and having a business address of 1 Batterymarch Park, Quincy, Mass. 02169-7471

National Fire Protection Association's publication 80 specifications—a Standard for Fire Doors and Other Opening Protectives established by the National Fire Protection Association.

near—in close proximity to.

no longer in production—not currently being made.

opening—an aperture.

oppose—to be on an opposite side of.

outwardly—towards an edge of an object.

plane—a substantially flat surface.

plurality—the state of being plural and/or more than one.

predetermined—established in advance.

project—to protrude.

protrude—to extend out from.

provide—to furnish, supply, give, and/or make available.

rabbet—a recess or step, usually of rectangular section, cut into a surface or along the edge of a door frame.

raised planar faces—surfaces of a strike plate that extend above recesses in a grooved portion of the strike plate.

receive—to get as a signal, take, acquire, and/or obtain.

recesses—receding portions of strike plate grooves.

reduce—to diminish to some extent.

right side edge—an edge of a strike plate that is rightmost, viewed from the perspective of one in a doorway facing the strike plate, when the strike plate is installed in a mortised pocket on a door.

rigid material—a substance that is substantially inflexible to forces directly exerted by a human.

screw—a metal fastener having a tapered shank with a helical thread, and topped with a slotted head, driven into a substance by rotating, such as by with a screwdriver.

screw holes—apertures in a strike plate that are adapted to receive threaded fasteners and thereby fasten the strike plate to a mortised pocket of a door frame.

select—to choose from a plurality of available options.

set—a related plurality.

strike plate—a plate defining one or more cutouts, the metal plate adapted to be affixed to a mortised pocket in a door frame. Each cutout is adapted to receive a door hardware bolt. When a door is closed, the door hardware bolt(s) extends into the cutout(s) and hold the door closed. The strike plate shields the mortised pocket against friction from the bolt and increases security in cases where the mortised pocket made of a softer material (such as wood) than the strike plate.

substantially—to a great extent or degree.

sufficient—adequate to accomplish a purpose.

surface area—a dimensional extent of one or more faces of an object that are touchable by another object.

swinging door—a hinged, barrier at the entrance to a building or room that is coupled to a door hardware bolt.

support—to bear the weight of, especially from below.

system—a collection of mechanisms, devices, machines, articles of manufacture, processes, data, and/or instructions, the collection designed to perform one or more specific functions.

thickness—measure of a distance from a back face of a strike plate to a front face of the strike plate, the back face of the strike plate adapted to directly contact a mortised pocket on a door when the strike plate is installed in a door frame.

top edge—an edge of a strike plate that is most upward when the strike plate is installed in a mortised pocket on a door.

via—by way of and/or utilizing.

NOTE

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A strike plate connectable within a door frame to receive and secure a latch bolt disposed within a side of a door, the strike plate comprising:

a strike plate body including a front surface and a back surface, wherein the back surface is mounted against a surface of a mortised pocket within a rabbet of the door frame, adapted to receive the door latch bolt and having a thickness such that, when installed in the pocket of the door frame, protrudes beyond an outermost surface of the rabbet such that a gap between the side of the door and the strike plate is reduced, thereby increasing the door latch bolt projection into the strike plate, the strike plate including:

a lip extending from one side thereof;

at least one cutout adapted to receive and secure the door latch bolt; and a plurality of screw holes each adapted to receive a screw there through to couple the strike plate to the door frame, each screw hole having a diameter that is greater than a major diameter of screws adapted to couple the strike plate to the door frame.

2. The strike plate of claim 1, further comprising:

a plurality of grooves disposed in parallel and extending lengthwise between at least one respective cutout and an outermost edge of the lip such that the door latch bolt slides continuously along the length of the plurality of grooves as the doors swings between an open and closed position, thereby reducing friction as the door latch bolt contacts and moves across the strike plate.

3. The strike plate of claim 1, wherein:

the strike plate comprises a fire resistant material.

4. The strike plate of claim 1, wherein:

the strike plate reduces the gap between the side edge of a door and the strike plate, causing a spring loaded bar extending from the side edge of a door to be depressed, thereby activating an auxiliary deadlatch function of locking door hardware as the door latch bolt projects into said strike plate.

5. A strike plate having a front surface and a back surface disposable within a door frame adjacent to a door stop to receive a latch bolt in a door as the door closes within the frame, the strike plate comprising:

at least one cutout adapted to receive the door latch bolt; and a plurality of grooves extending through the front surface of the strike plate, the grooves being disposed in parallel and extending lengthwise between each respective cutout and an outermost edge of the strike plate opposite to an edge adjacent to the door stop such that the door latch bolt slides continuously along the length of the plurality of grooves as the door swings between an open and closed position, thereby reducing friction as the door latch bolt contacts and moves across the strike plate.

6. A strike plate having a front surface and a back surface usable within a door frame to receive a latch bolt of a door, the strike plate comprising:

an elongated rectangular body;

at least one cutout disposed therein to receive a respective latch bolt of the door;

at least one screw hole disposed at each end of the rectangular body to receive a coupling screw to couple the elongated body to the door frame;

a lip extending in width from one side of the rectangular body while tapering in thickness to an edge of the lip, the lip having a length along the elongated body less than a length between the screw holes at opposite ends of the rectangular body; and a plurality of grooves extending through the front surface of the strike plate, the grooves being disposed in parallel with each other and extending across the width of the lip between at least one cutout and the tapered edge of the lip, thereby reducing friction as the door latch bolt contacts and moves across the strike plate.

7. The strike plate of claim 6, wherein the at least one cutout includes two cutouts, the two cutouts being disposed one directly below the other and between the screw holes at opposite ends of the rectangular body.

8. The strike plate of claim 7, wherein the plurality of grooves are disposed between each of the two cutouts and the tapered edge of the lip.

9. A strike plate having a front surface and a back surface configured to be coupled within a door frame adjacent to a door stop to receive a latch bolt in a door as the door closes within the frame, the strike plate comprising:

at least one cutout adapted to receive the door latch bolt; and a plurality of dimples disposed in parallel rows and extending lengthwise between at least one cutout and an outermost edge of the front surface of the strike plate opposite to an edge adjacent to the door stop such that the door latch bolt slides along the length of the plurality of dimples as the door swings between an open and closed position, thereby reducing friction as the door latch bolt contacts and moves across the strike plate.

10. The strike plate of claim 9, wherein the at least one cutout includes two cutouts, one above the other, and the plurality of dimples are disposed between the lower and/or the upper cutout and an edge of the strike plate opposite to an edge adjacent to the door stop such that the door latch bolt slides along the length of the plurality of dimples as the door swings between an open and closed position and the lower cutout is configured to receive a latch bolt.

* * * * *